US011571051B2

(12) United States Patent
Tieu

(10) Patent No.: US 11,571,051 B2
(45) Date of Patent: Feb. 7, 2023

(54) EXPANDABLE LUGGAGE ASSEMBLIES

(71) Applicant: Trung Tieu, Calgary (CA)

(72) Inventor: Trung Tieu, Calgary (CA)

( * ) Notice: Subject to any disclaimer, the term of this patent is extended or adjusted under 35 U.S.C. 154(b) by 38 days.

(21) Appl. No.: 16/979,856

(22) PCT Filed: Mar. 8, 2019

(86) PCT No.: PCT/CA2019/000032
§ 371 (c)(1),
(2) Date: Sep. 10, 2020

(87) PCT Pub. No.: WO2019/173897
PCT Pub. Date: Sep. 19, 2019

(65) Prior Publication Data

US 2021/0037935 A1 Feb. 11, 2021

Related U.S. Application Data

(60) Provisional application No. 62/641,380, filed on Mar. 11, 2018.

(51) Int. Cl.

| | |
|---|---|
| ***A45C 7/00*** | (2006.01) |
| ***A45C 5/14*** | (2006.01) |
| ***A45C 9/00*** | (2006.01) |
| ***A45C 13/04*** | (2006.01) |

(52) U.S. Cl.
CPC ..... *A45C 7/0031* (2013.01); *A45C 5/14* (2013.01); *A45C 7/0027* (2013.01); *A45C 9/00* (2013.01); *A45C 13/04* (2013.01)

(58) Field of Classification Search
CPC ..... A45C 7/0031
USPC ..... 62/457.1; 455/344
See application file for complete search history.

(56) References Cited

U.S. PATENT DOCUMENTS 2,258,582 A * 10/1941 Berg, Jr. ..... A45C 11/02 206/8
4,295,432 A * 10/1981 Hulke ..... A47B 43/006 D6/514
5,307,908 A * 5/1994 Shyr ..... A45C 5/14 190/111

(Continued)

FOREIGN PATENT DOCUMENTS

CA 2936342 A1 1/2018
CN 207075686 U 3/2018

(Continued)

*Primary Examiner* — John Fristoe, Jr.
*Assistant Examiner* — Justin Caudill
(74) *Attorney, Agent, or Firm* — Elliott Law PLLC; Douglas H. Elliott; Nathan Q. Huynh

(57) ABSTRACT

The disclosure herein includes an expandable luggage assembly, which expandable luggage assembly may include: an upper shell having a plurality of sidewalls; a lower shell having a plurality of sidewalls removably coupled to one more of the plurality of sidewalls of the upper shell; a shelf coupled to the upper shell; a plurality of wheels coupled to the lower shell; and two handles, each handle of the two handles comprising: a crossbar disposed above the upper shell; a first tube coupled to the crossbar and slidably coupled to the upper shell; a second tube slidably coupled to the first tube and capable of being abutted against the upper shell; a third tube slidably coupled to the second tube and coupled to the lower shell.

20 Claims, 71 Drawing Sheets

(56) References Cited

U.S. PATENT DOCUMENTS

| | | | | |
|---|---|---|---|---|
| 7,232,018 | B1 * | 6/2007 | Salander | A45C 5/14 280/37 |
| D725,399 | S * | 3/2015 | Wang | D6/514 |
| 9,084,464 | B2 * | 7/2015 | Libuda | A45C 13/02 |
| 9,877,436 | B1 * | 1/2018 | Taylor | A01G 9/023 |
| 2002/0008125 | A1 * | 1/2002 | Caputi | A45C 13/30 224/264 |
| 2002/0125669 | A1 * | 9/2002 | Chang | A45C 5/14 190/18 A |
| 2006/0000681 | A1 * | 1/2006 | Barker | A45C 9/00 220/8 |
| 2006/0096821 | A1 | 5/2006 | McKaba | |
| 2008/0142322 | A1 | 6/2008 | Barker | |
| 2008/0308371 | A1 * | 12/2008 | Yang | A45C 13/02 190/110 |
| 2010/0117499 | A1 * | 5/2010 | Fortier | A45C 7/0031 312/306 |
| 2013/0068579 | A1 * | 3/2013 | Mathieu | A45C 13/262 190/115 |
| 2014/0216875 | A1 | 8/2014 | Cavalheiro | |
| 2016/0045009 | A1 * | 2/2016 | Hansborough | A45C 13/28 190/11 |
| 2016/0213111 | A1 | 7/2016 | Aiello | |

FOREIGN PATENT DOCUMENTS

| | | | |
|---|---|---|---|
| KR | 1020020034926 | | 5/2002 |
| KR | 101031819 | B1 | 4/2011 |
| KR | 20130011439 | A | 1/2013 |
| KR | 20130069276 | A | 6/2013 |
| KR | 2020140005457 | U | 10/2014 |

* cited by examiner

FIG. 63D
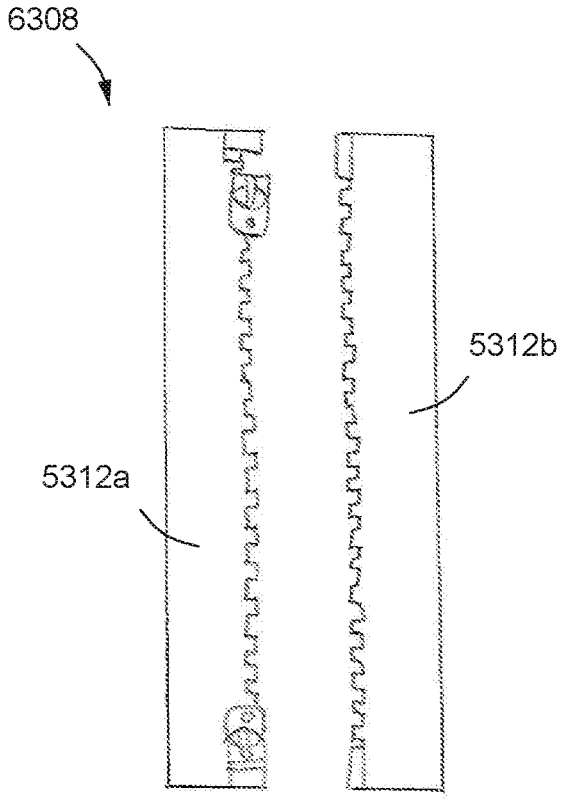
FIG. 63E
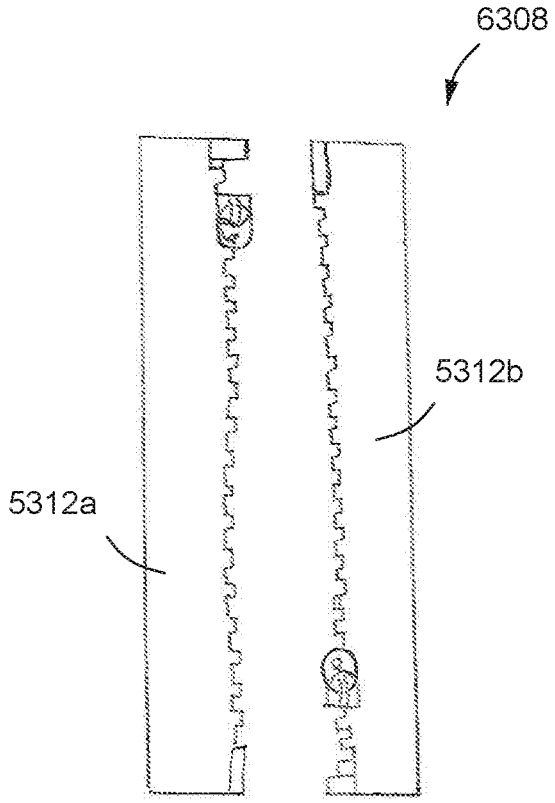
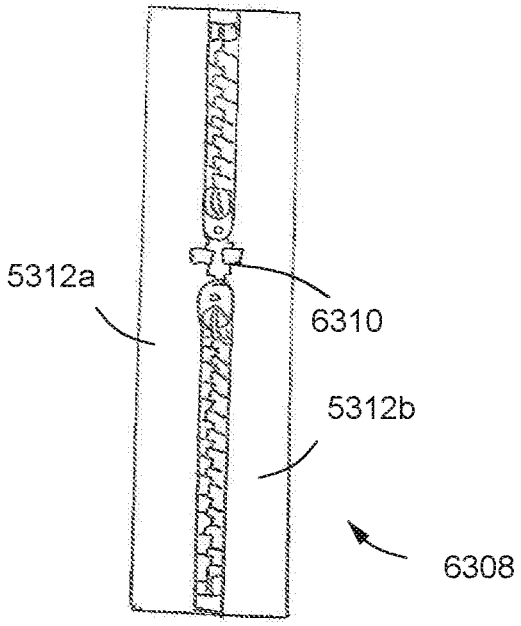
FIG. 63F

EXPANDABLE LUGGAGE ASSEMBLIES

BACKGROUND

Field of Inventions

The field of this application and any resulting patent is luggage assemblies.

Description of Related Art

Various expandable luggage assemblies and methods for storing travel-ware have been proposed and utilized, including some of the methods and structures disclosed in the references appearing on the face of this patent. However, those methods and structures lack the combination of steps and/or features of the methods and/or structures covered by the patent claims below. Furthermore, it is contemplated that the methods and/or structures covered by at least some of the claims of this issued patent solve many of the problems that prior art methods and structures have failed to solve. Also, the methods and/or structures covered by at least some of the claims of this patent have benefits that would be surprising and unexpected to a hypothetical person of ordinary skill with knowledge of the prior art existing as of the filing date of this application.

SUMMARY

The disclosure herein includes an expandable luggage assembly, which expandable luggage assembly may include: an upper shell having a plurality of sidewalls; a lower shell having a plurality of sidewalls removably coupled to one more of the plurality of sidewalls of the upper shell; a shelf coupled to the upper shell; a plurality of wheels coupled to the lower shell; and two handles, each handle of the two handles comprising: a crossbar disposed above the upper shell; a first tube coupled to the crossbar and slidably coupled to the upper shell; a second tube slidably coupled to the first tube and capable of being abutted against the upper shell; a third tube slidably coupled to the second tube and coupled to the lower shell.

The disclosure herein includes an expandable luggage assembly, which expandable luggage assembly may include: an upper portion having one or more brackets; and a lower portion; a shelf coupled to the upper portion; a lower shell; a plurality of wheels coupled to a base of the lower shell; and two handles, each handle of the two handles comprising: a crossbar removably coupled to at least one bracket of the one or more brackets; and a telescopic shaft having a first portion coupled to the crossbar and a second portion coupled to a base of the lower shell.

The disclosure herein includes an expandable luggage assembly, which expandable luggage assembly may include: an upper shell; a middle shell removably coupled to the upper shell; a lower shell removably coupled to the middle shell; a plurality of wheels coupled to a base of the lower shell; and two handles, wherein each handle of the two handles comprises: a telescopic shaft coupled to an inner surface of the lower shell and having a portion extending through the upper shell; and a crossbar coupled to the telescopic shaft, wherein an upper portion of the upper shell is capable of being coupled to the crossbar.

The disclosure herein includes an expandable luggage assembly, which expandable luggage assembly may include: an upper shell having a plurality of sidewalls; a lower shell comprising: a base; and a plurality of sidewalls extending from the base and removably coupled to the plurality of sidewalls of the upper shell; a shelf coupled to the upper shell; a plurality of wheels coupled to the lower shell; and two handles, each of the two handles comprising: a telescopic shaft having a portion capable of supporting the upper shell; and a crossbar coupled to the telescopic shaft, wherein a portion of the upper shell is capable of being coupled to the crossbar.

BRIEF DESCRIPTION OF THE DRAWINGS

FIGS. 63D-F illustrate profile views of various zipper tape assemblies.

DETAILED DESCRIPTION

1. Introduction

Figure 1:
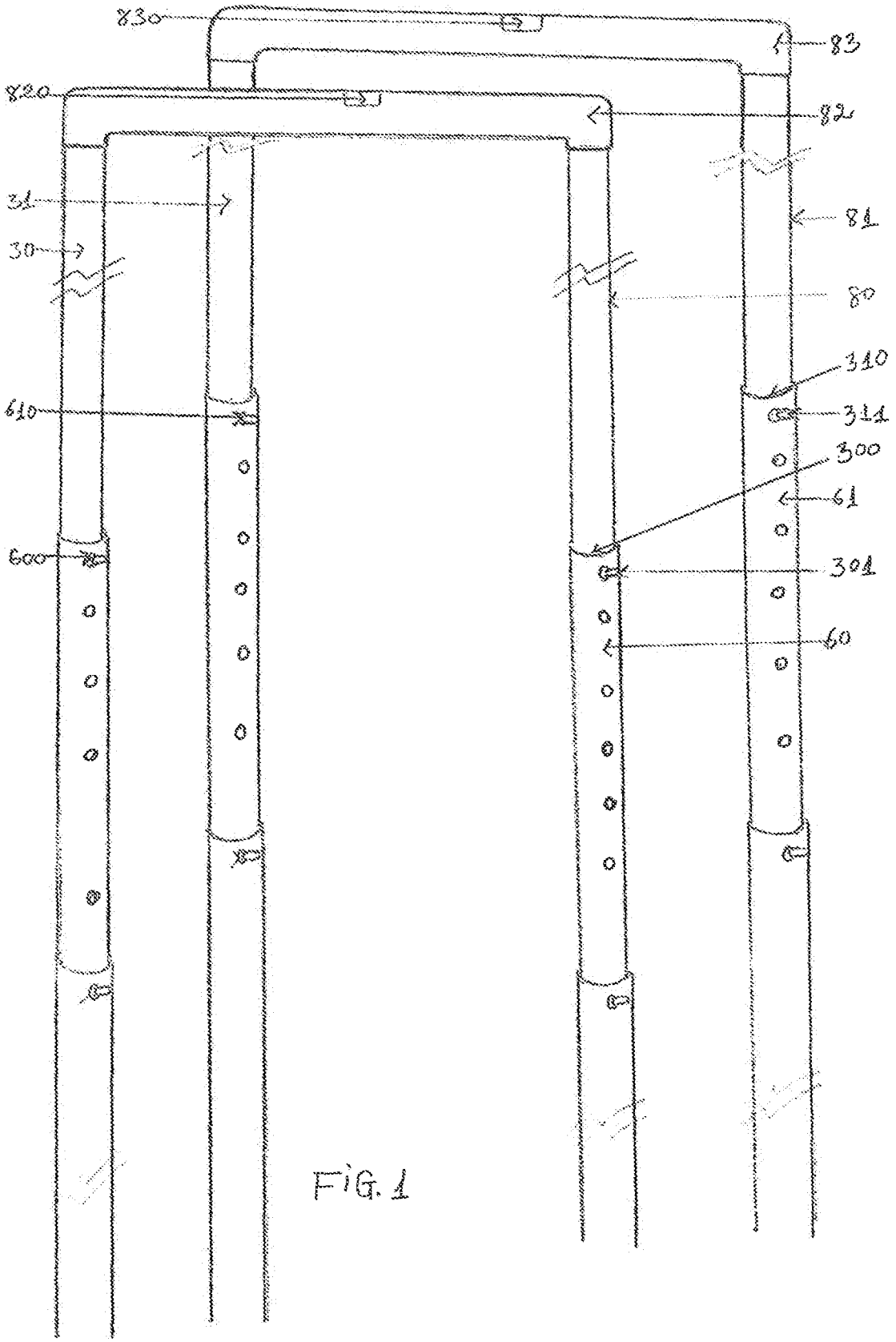
FIGS. 1-52 illustrate views of various versions of luggage assemblies and components for construction and use of the luggage assemblies.
Figure 2:
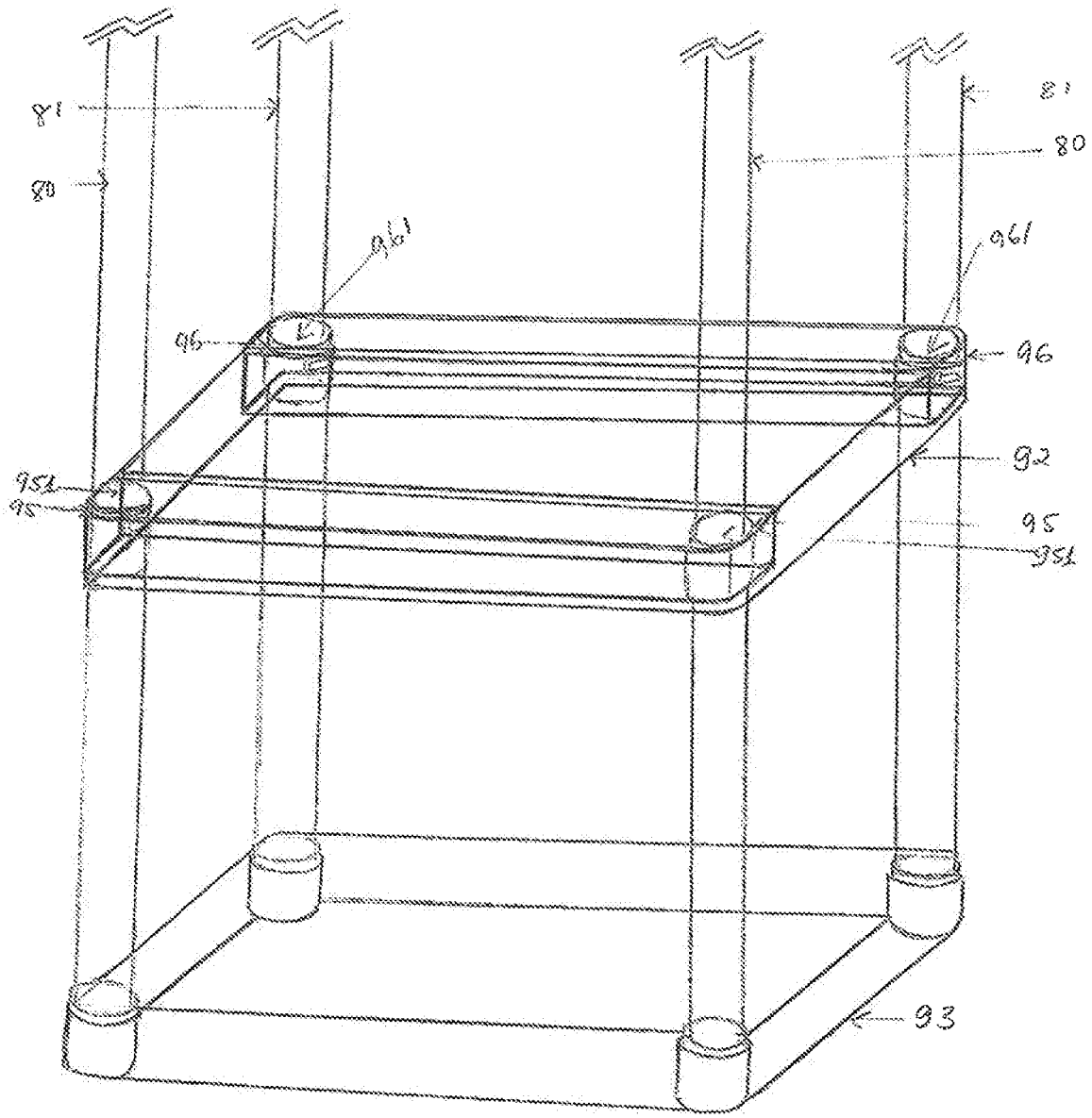
Figure 3:
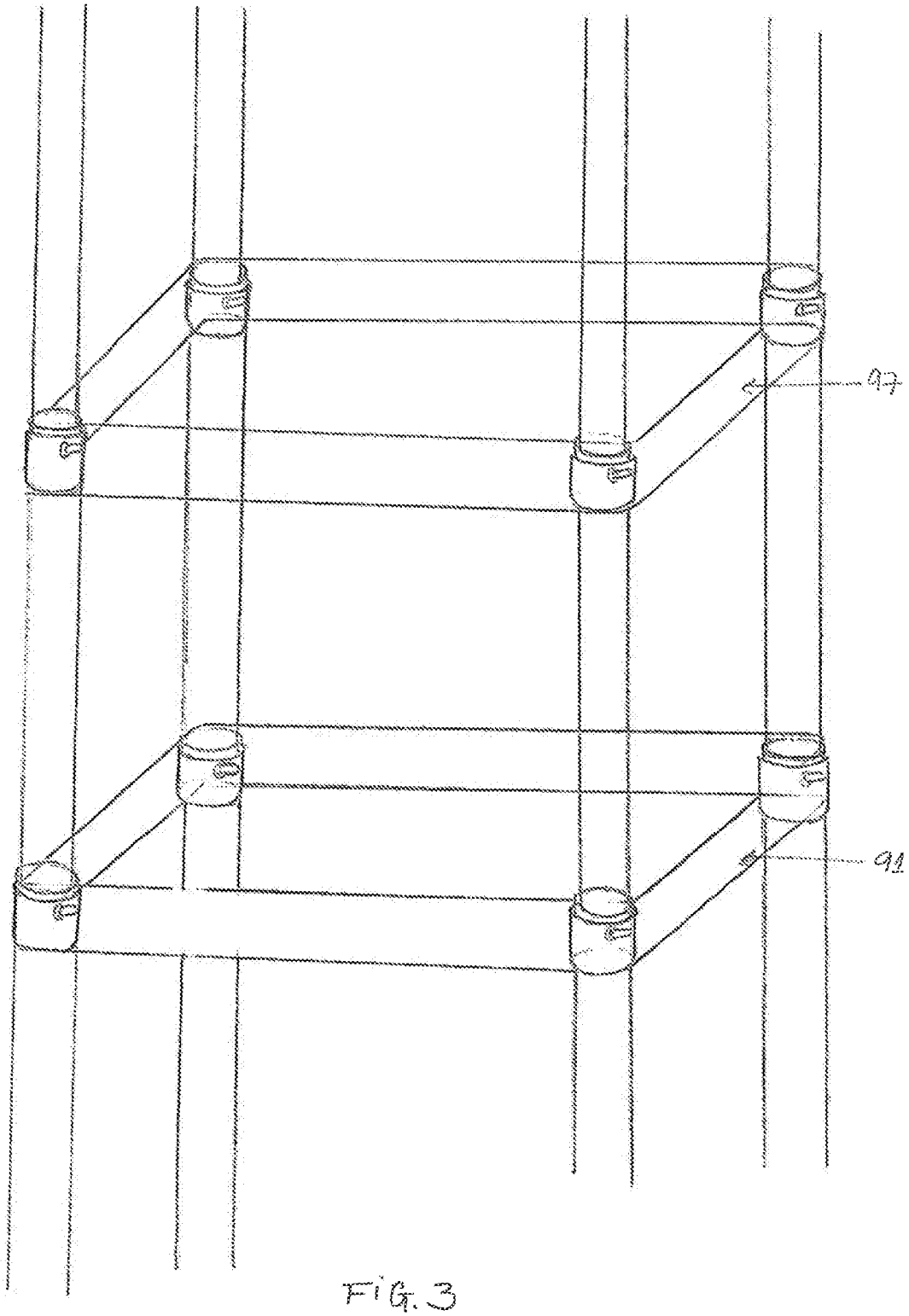
Figure 4:
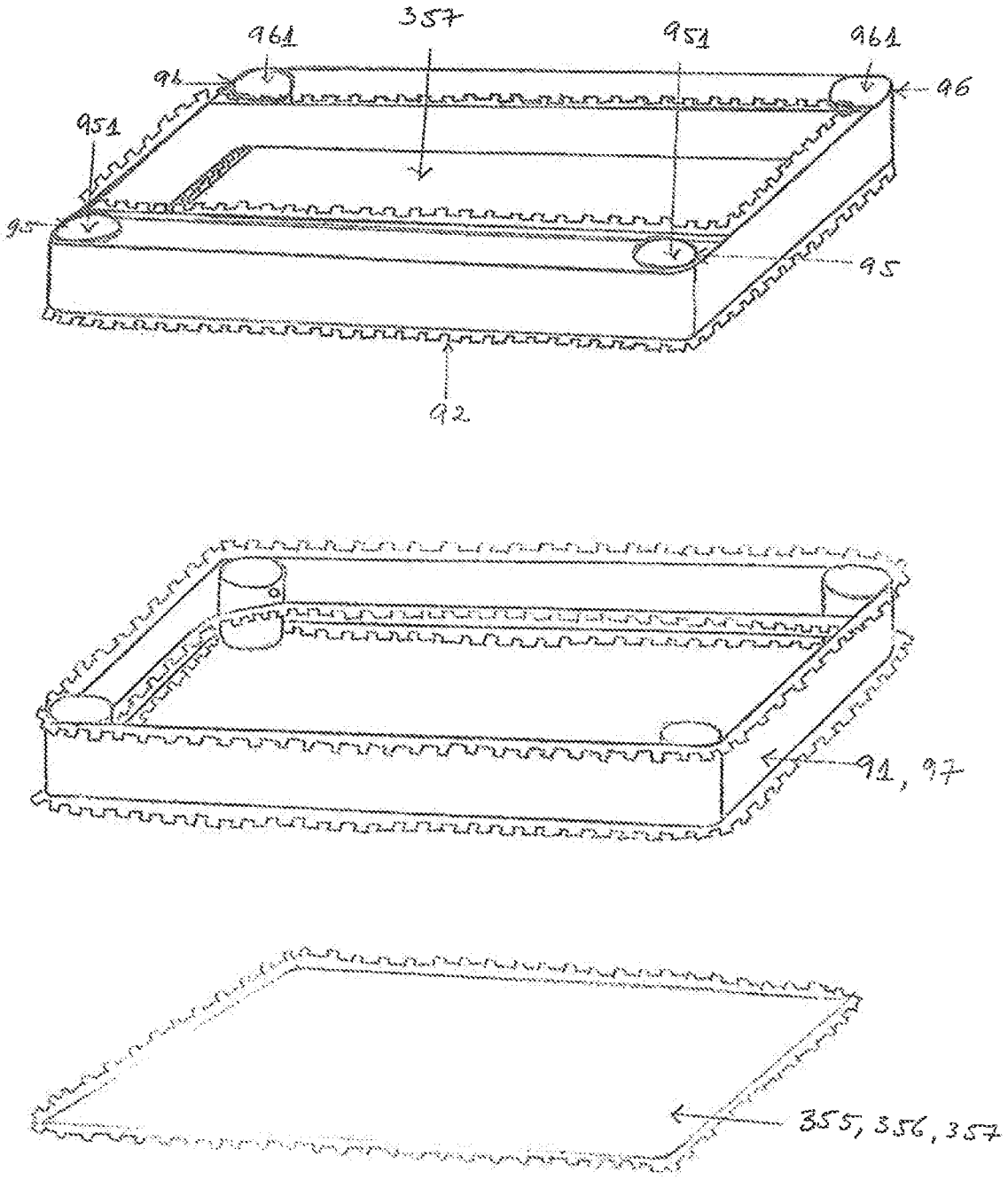
Figure 5:
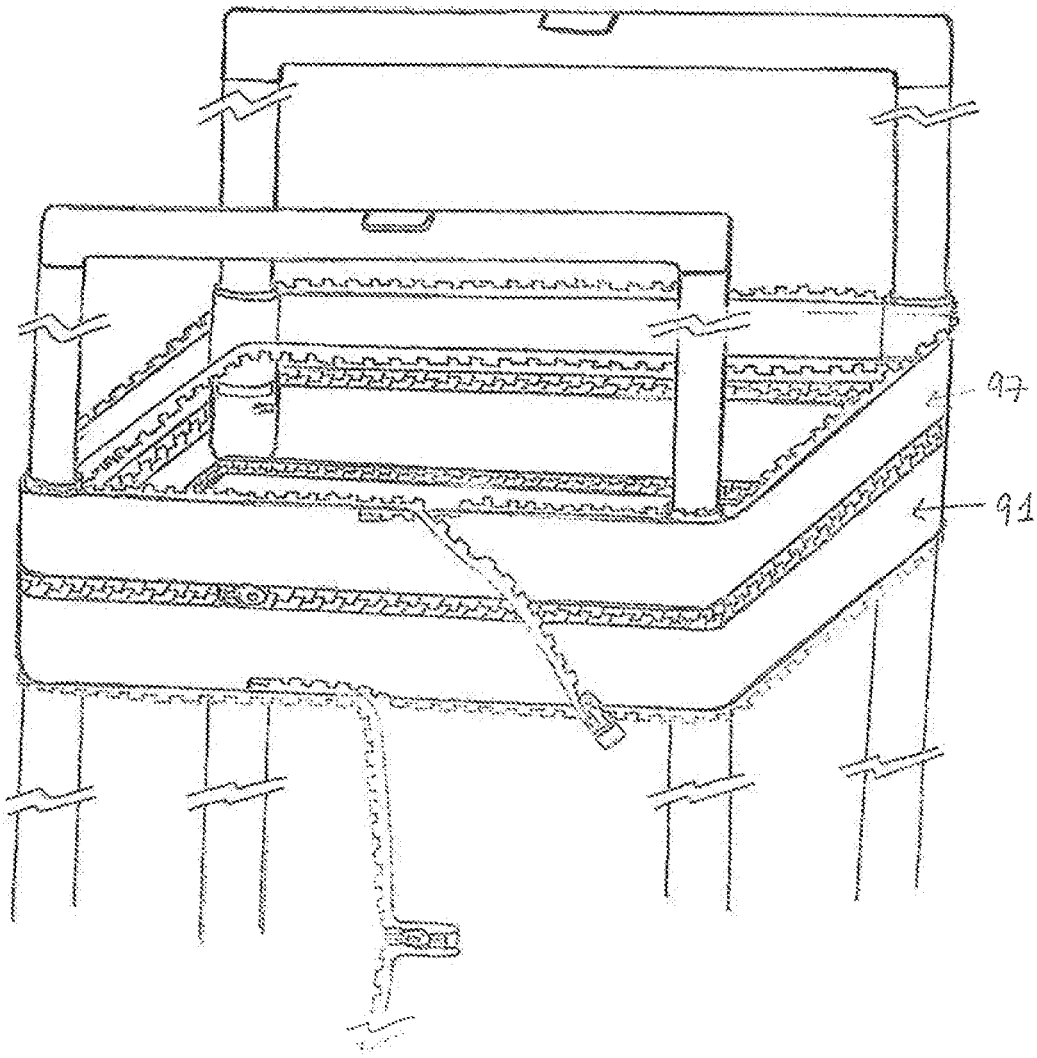
Figure 6:
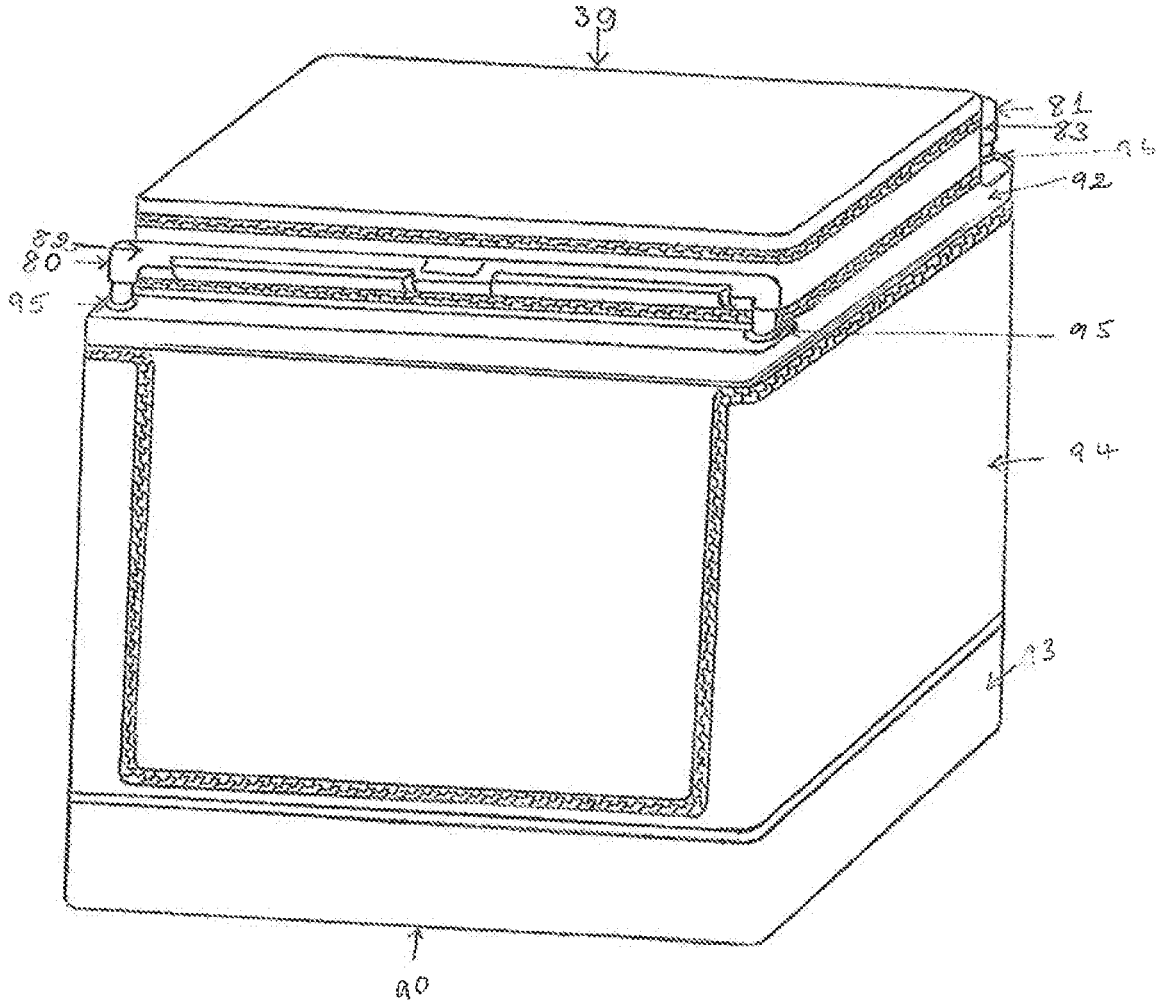
Figure 7:
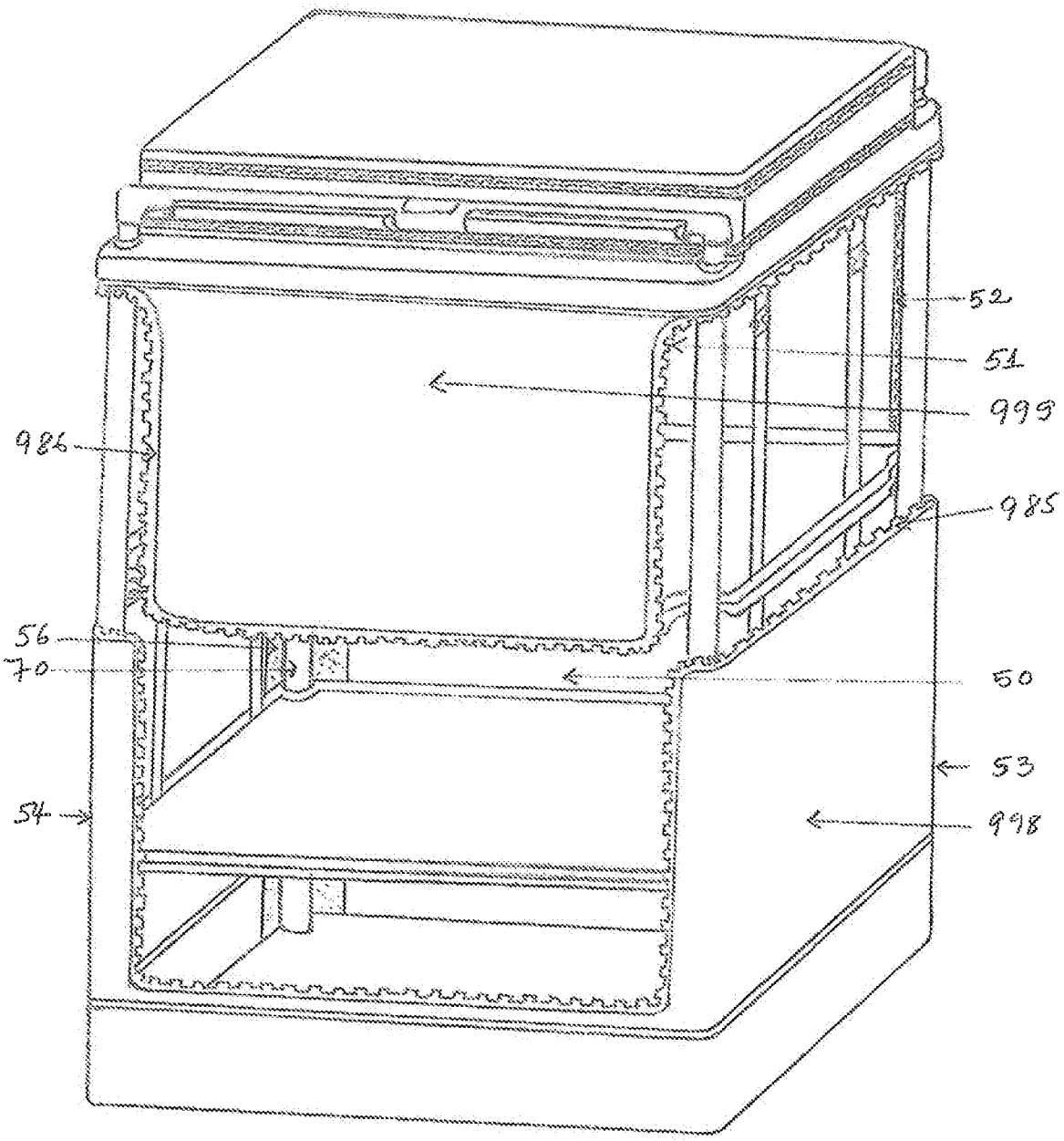
Figure 8:
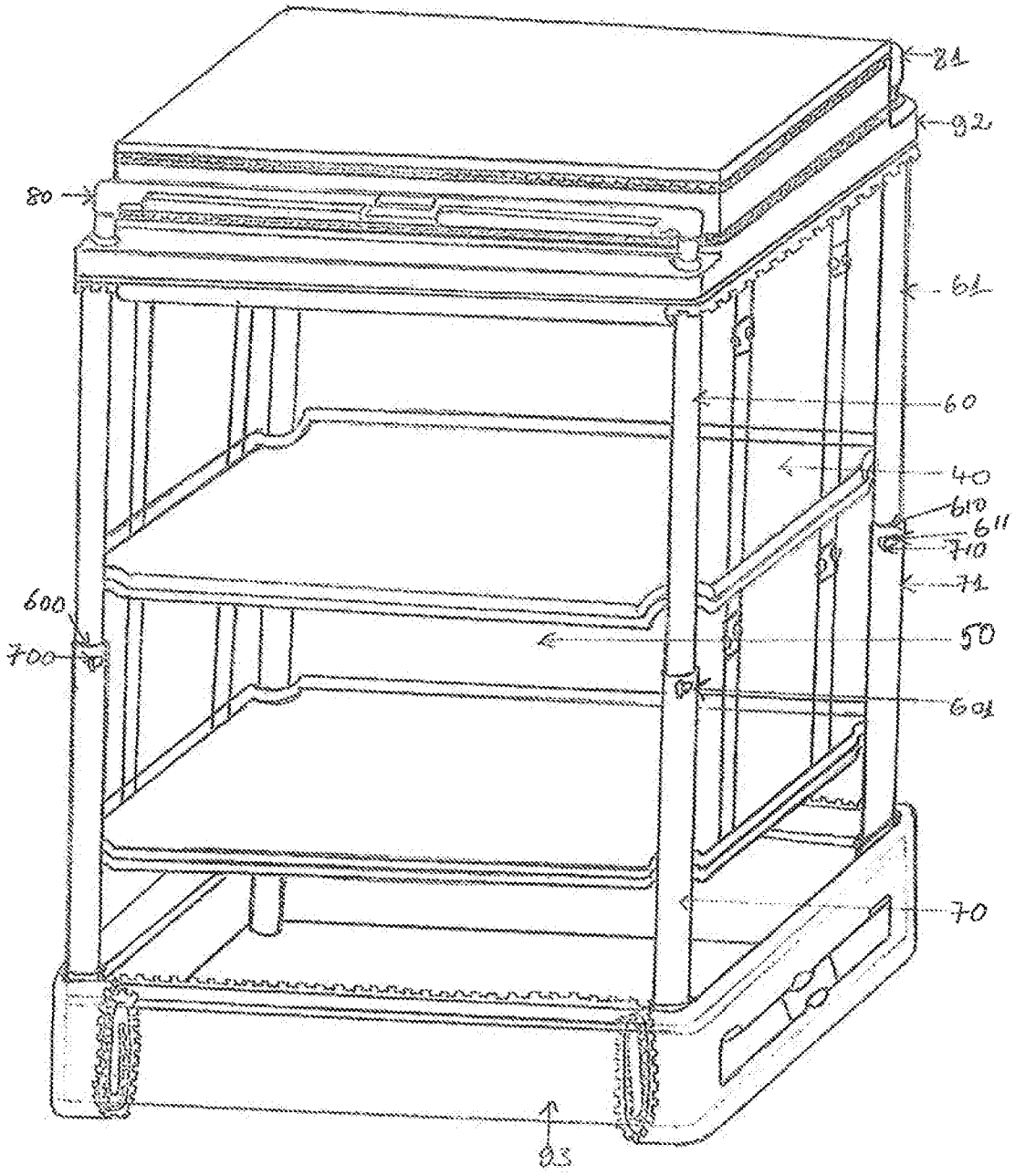
Figure 9:
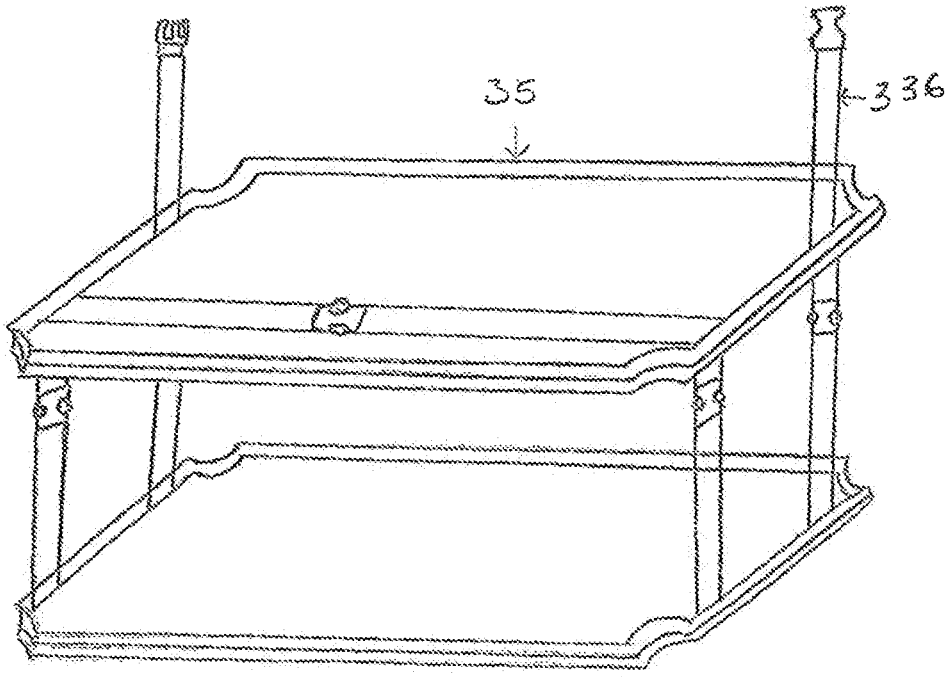
Figure 10:
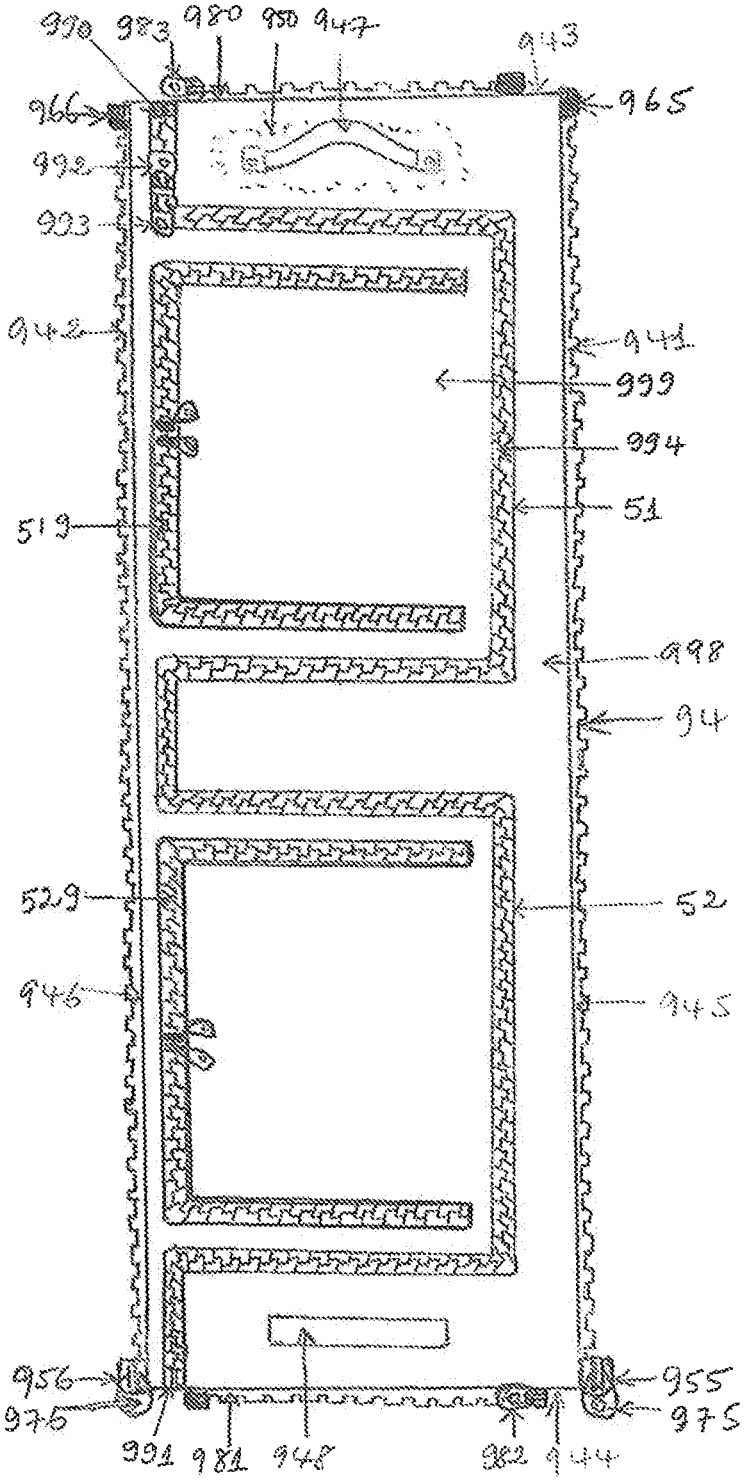
Figure 11:
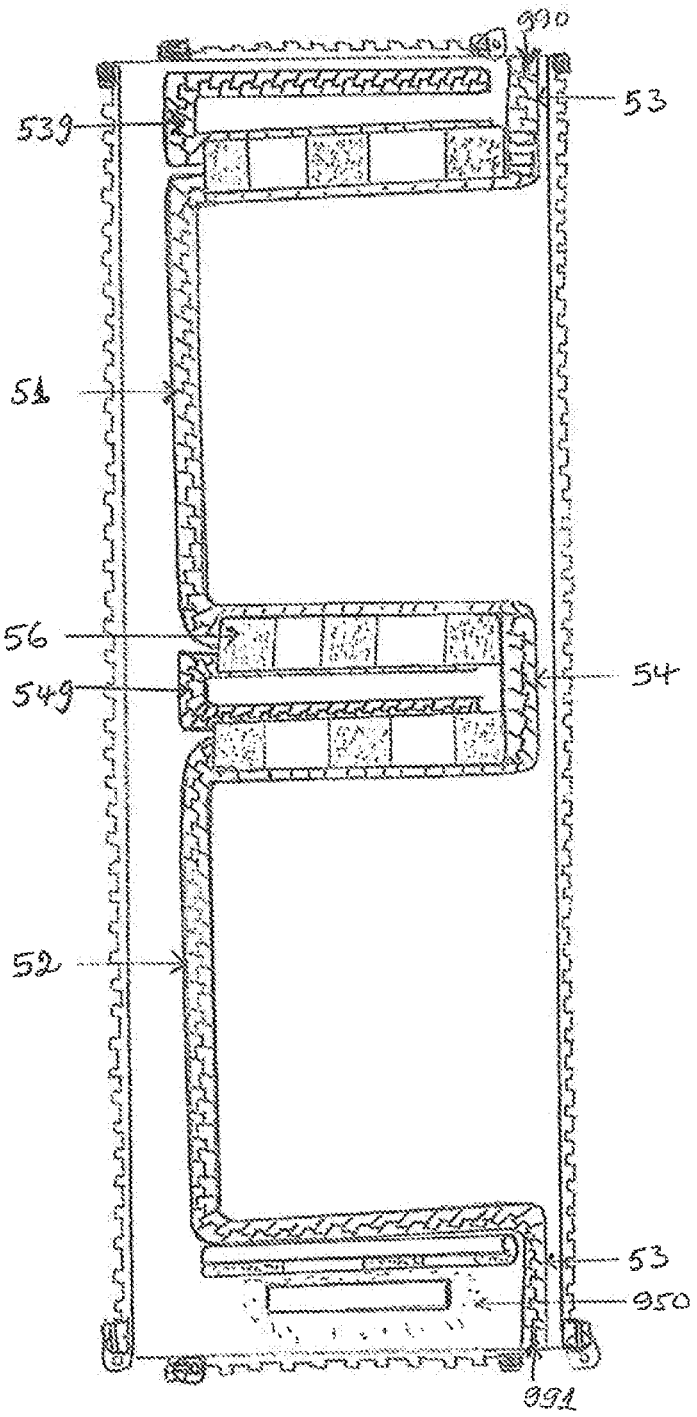
Figure 12:
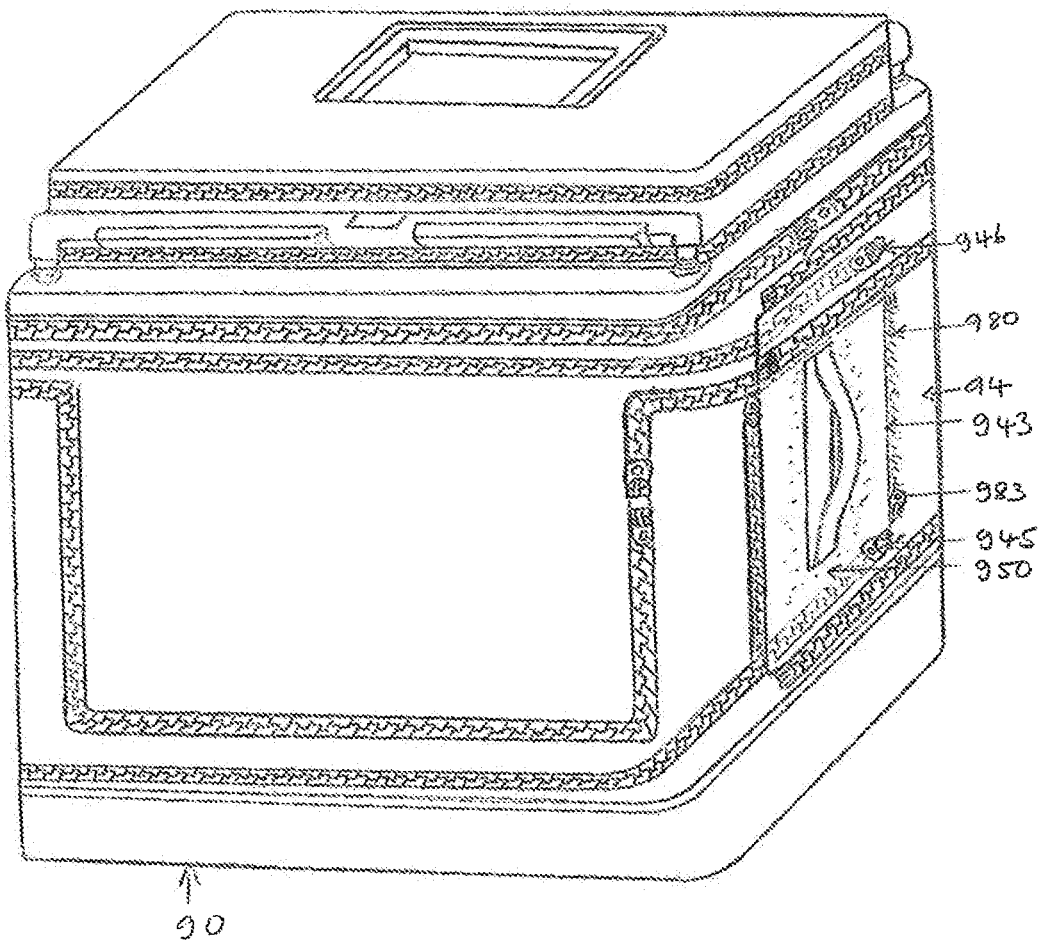
Figure 13:
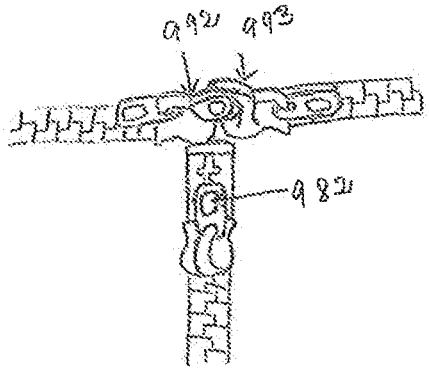
Figure 13:
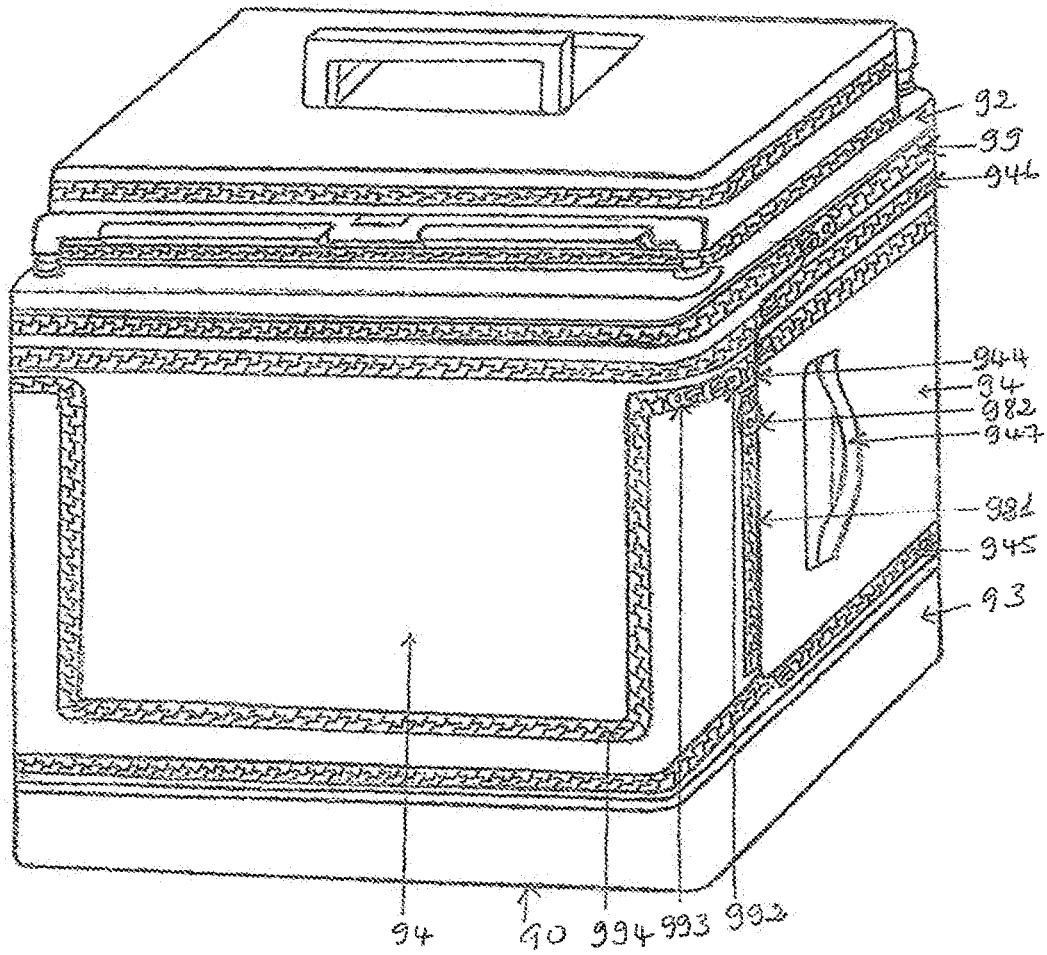
Figure 14:
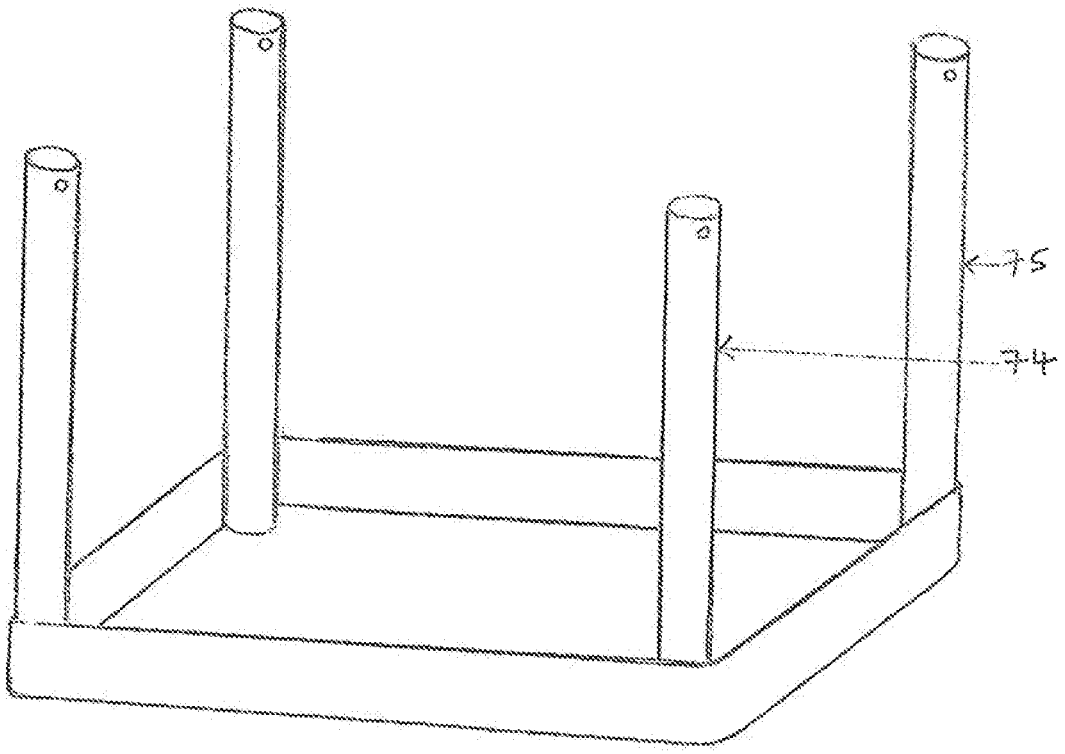
Figure 15:
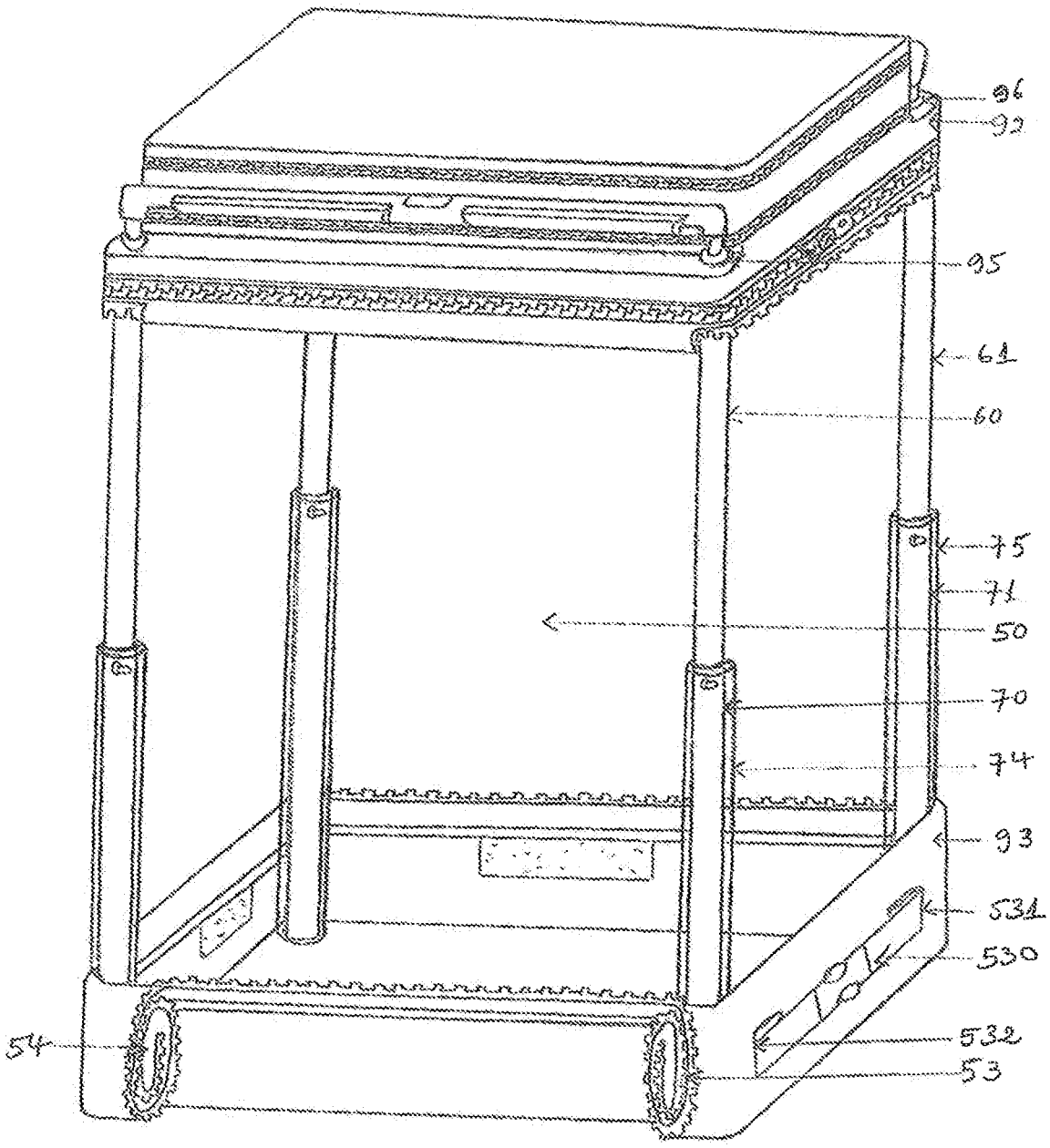
Figure 16:
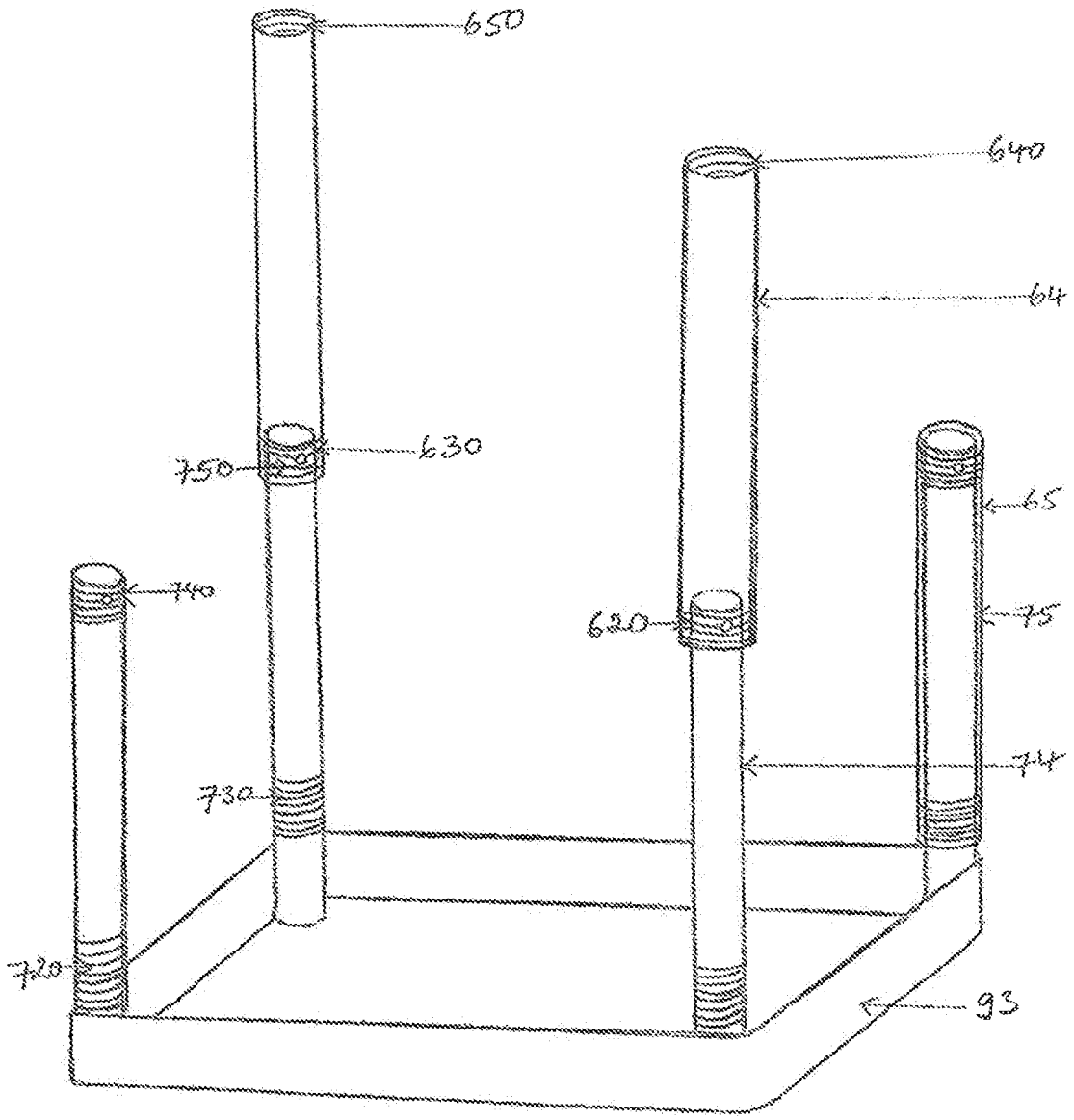
Figure 17:
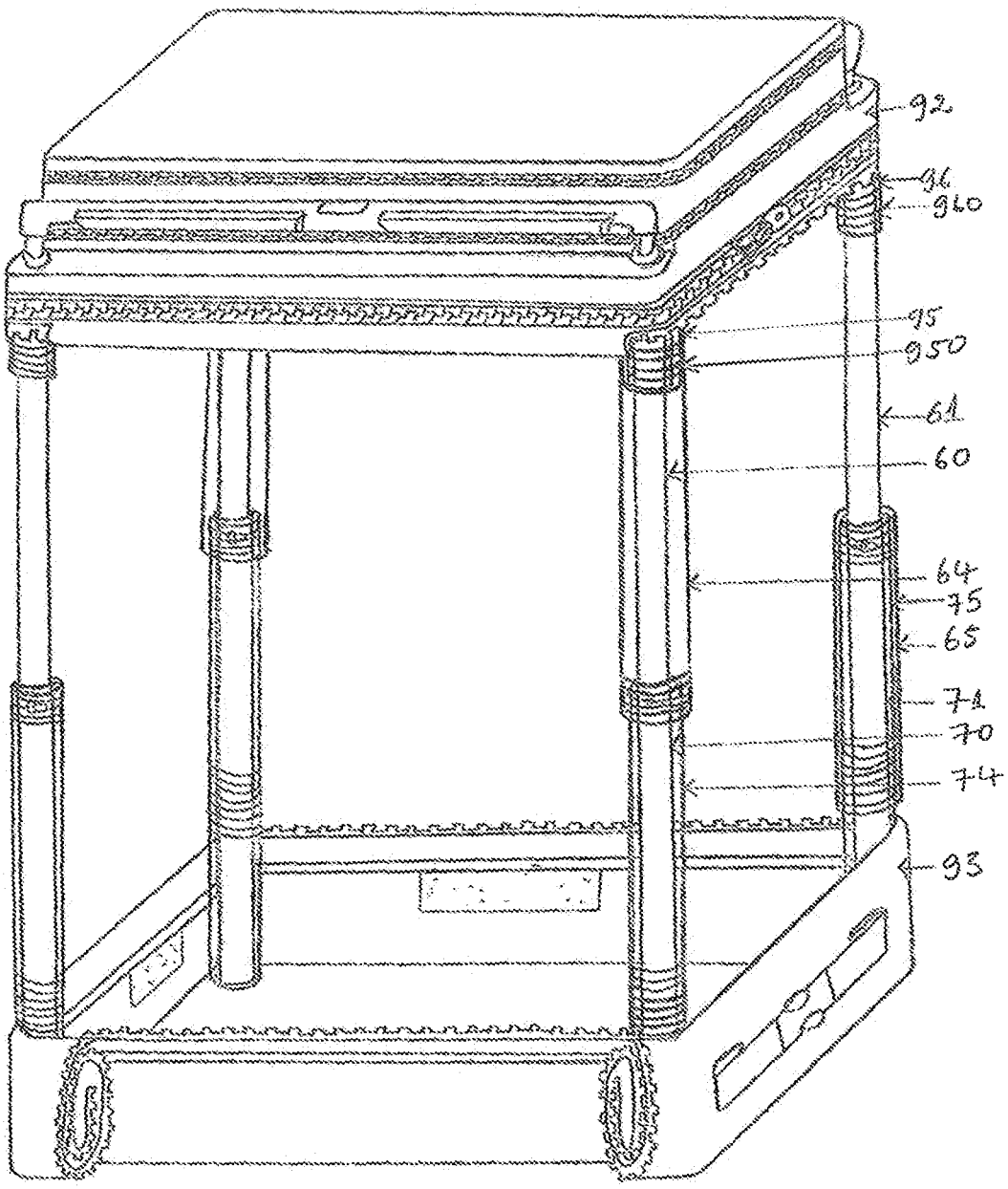
Figure 18:
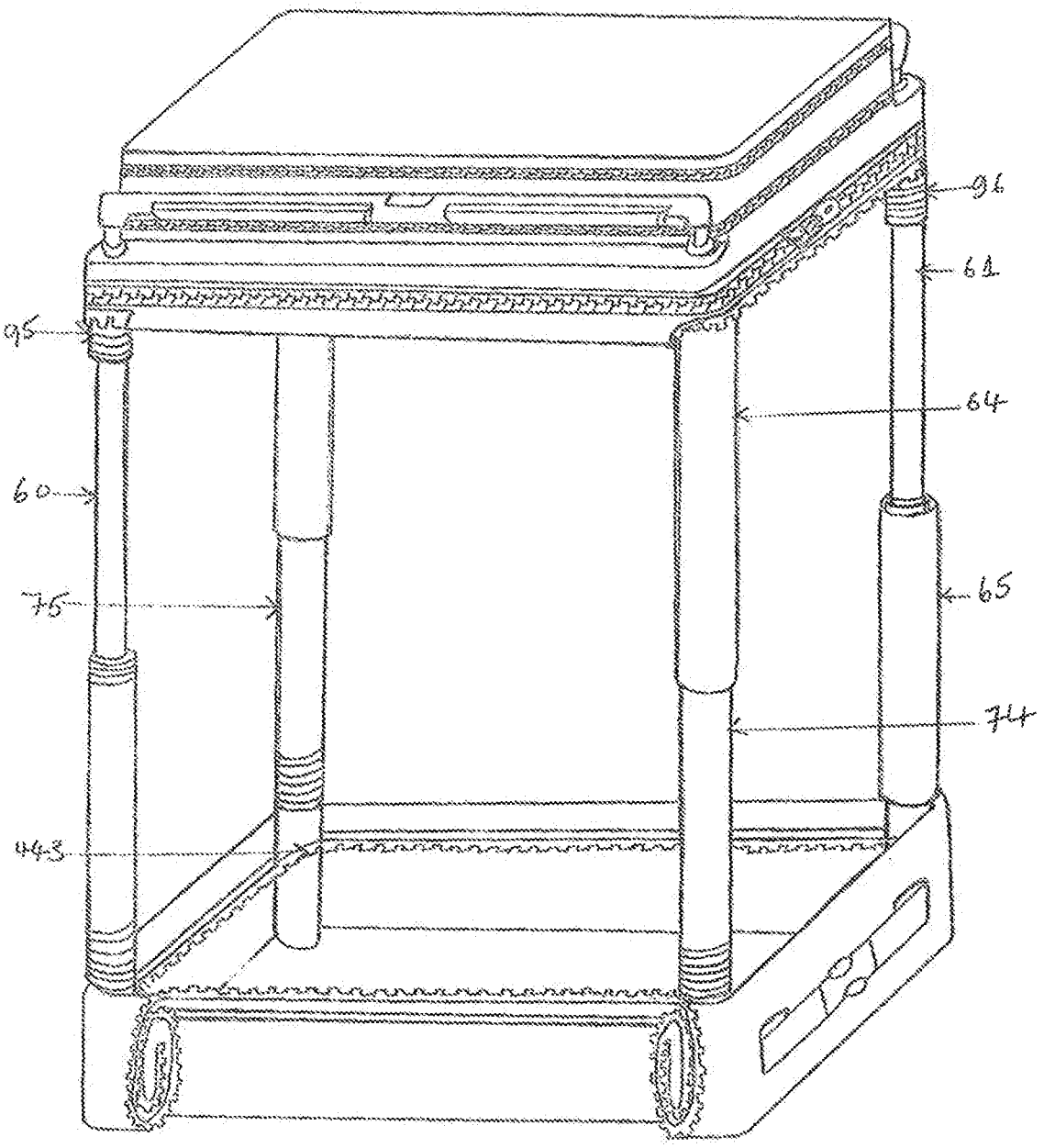
Figure 19:
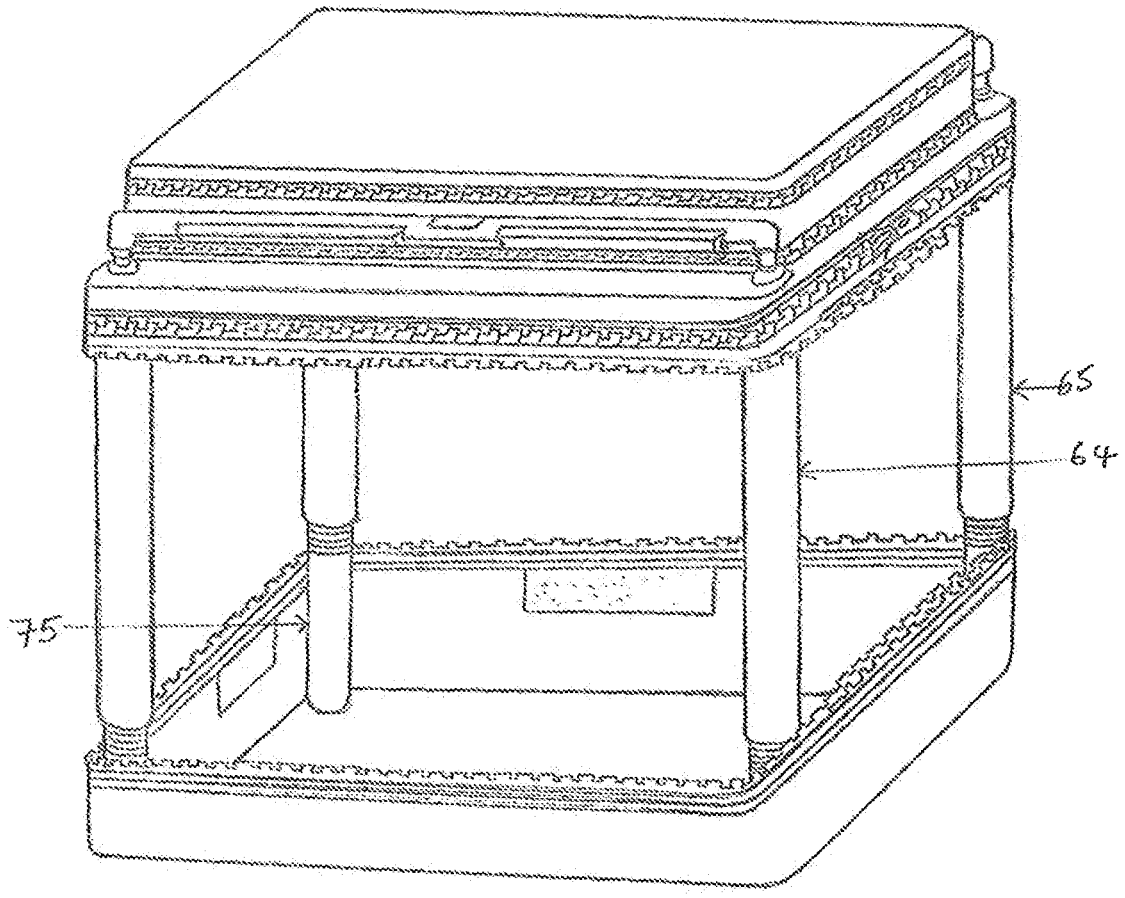
Figure 20:
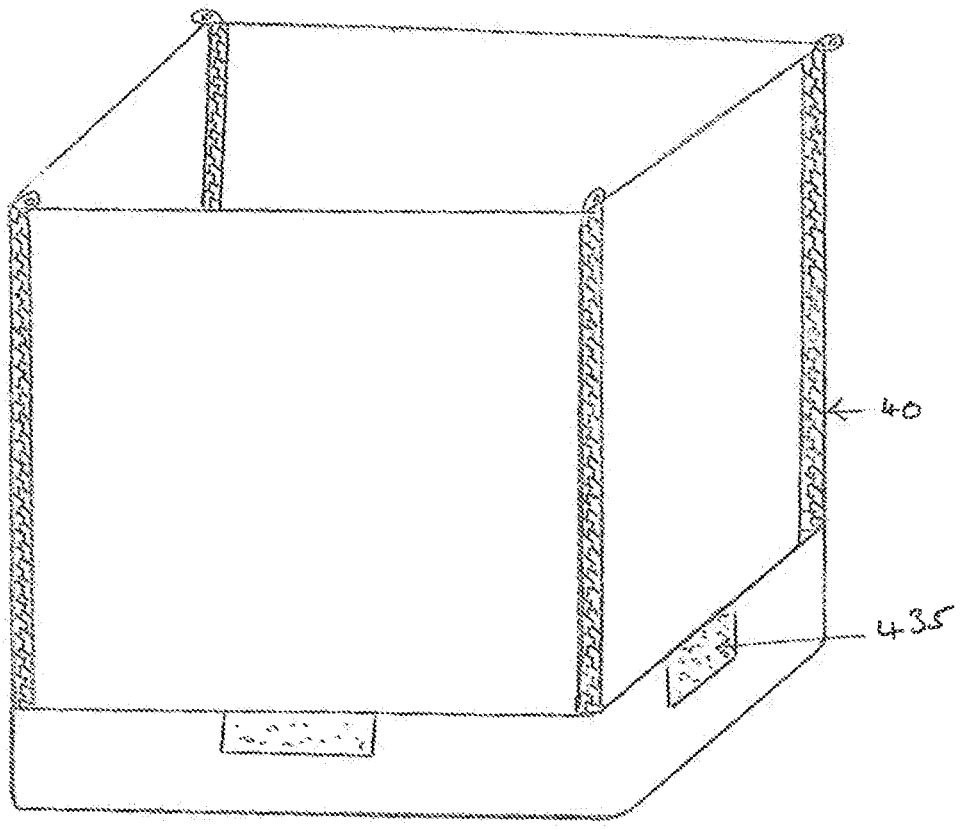
Figure 21:
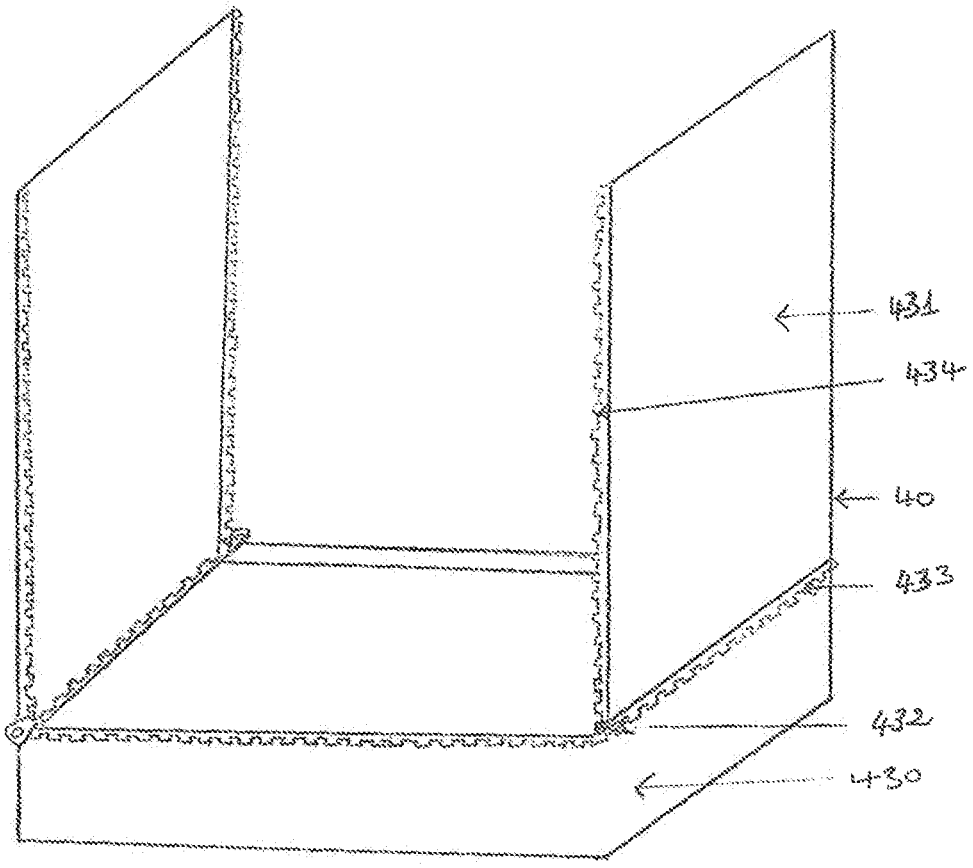
Figure 22:
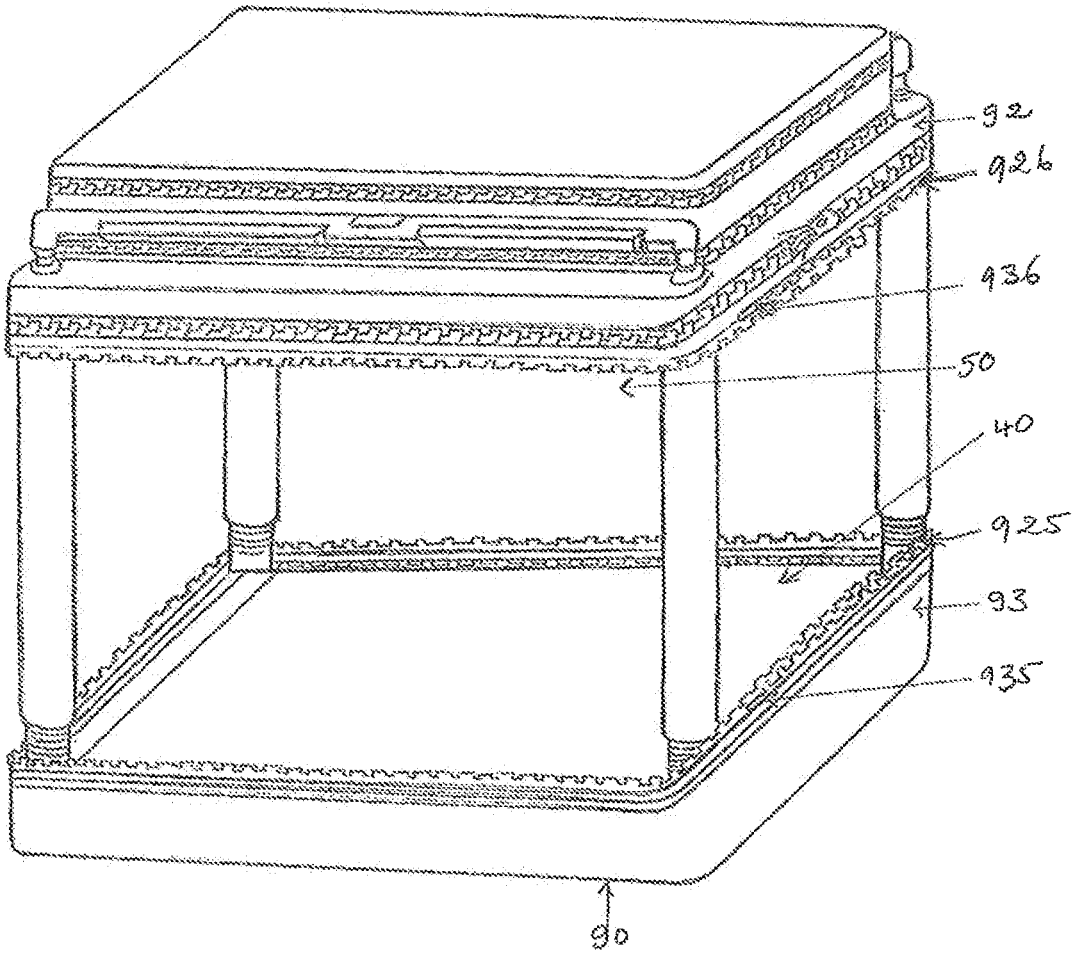
Figure 23:
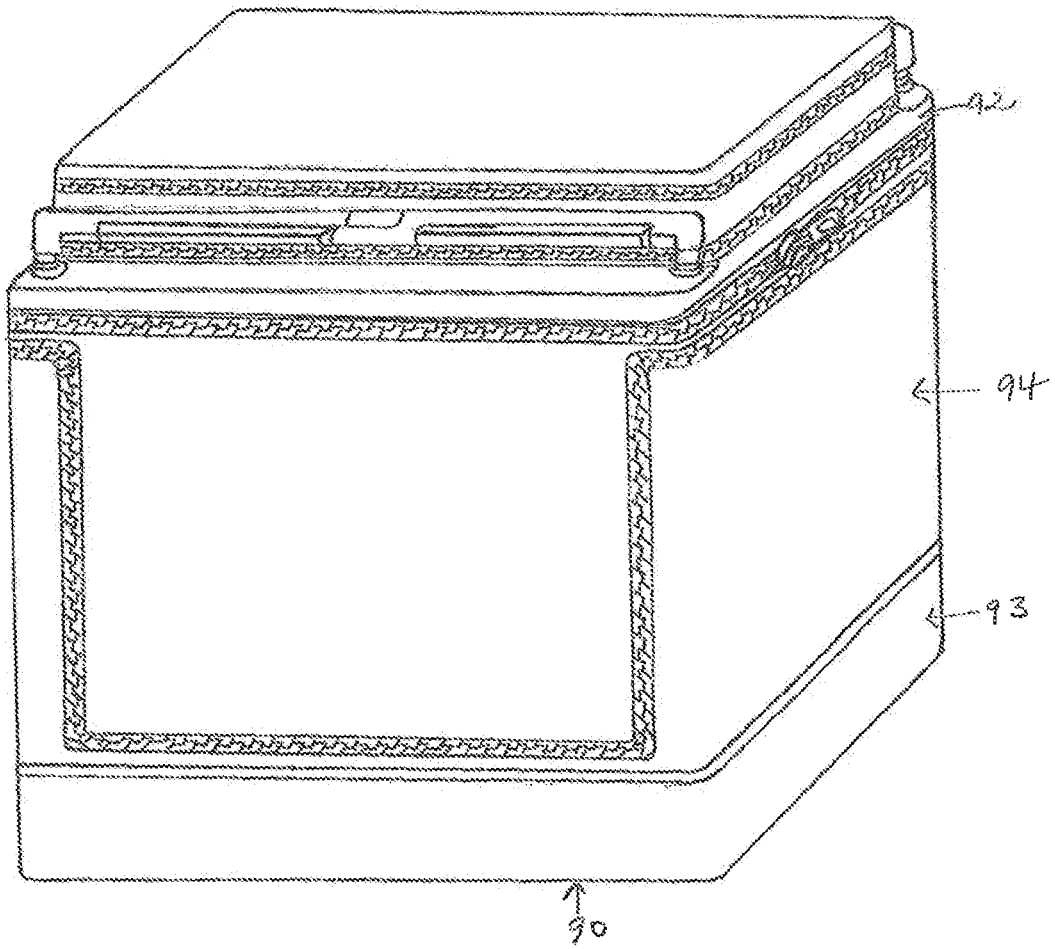
Figure 24:
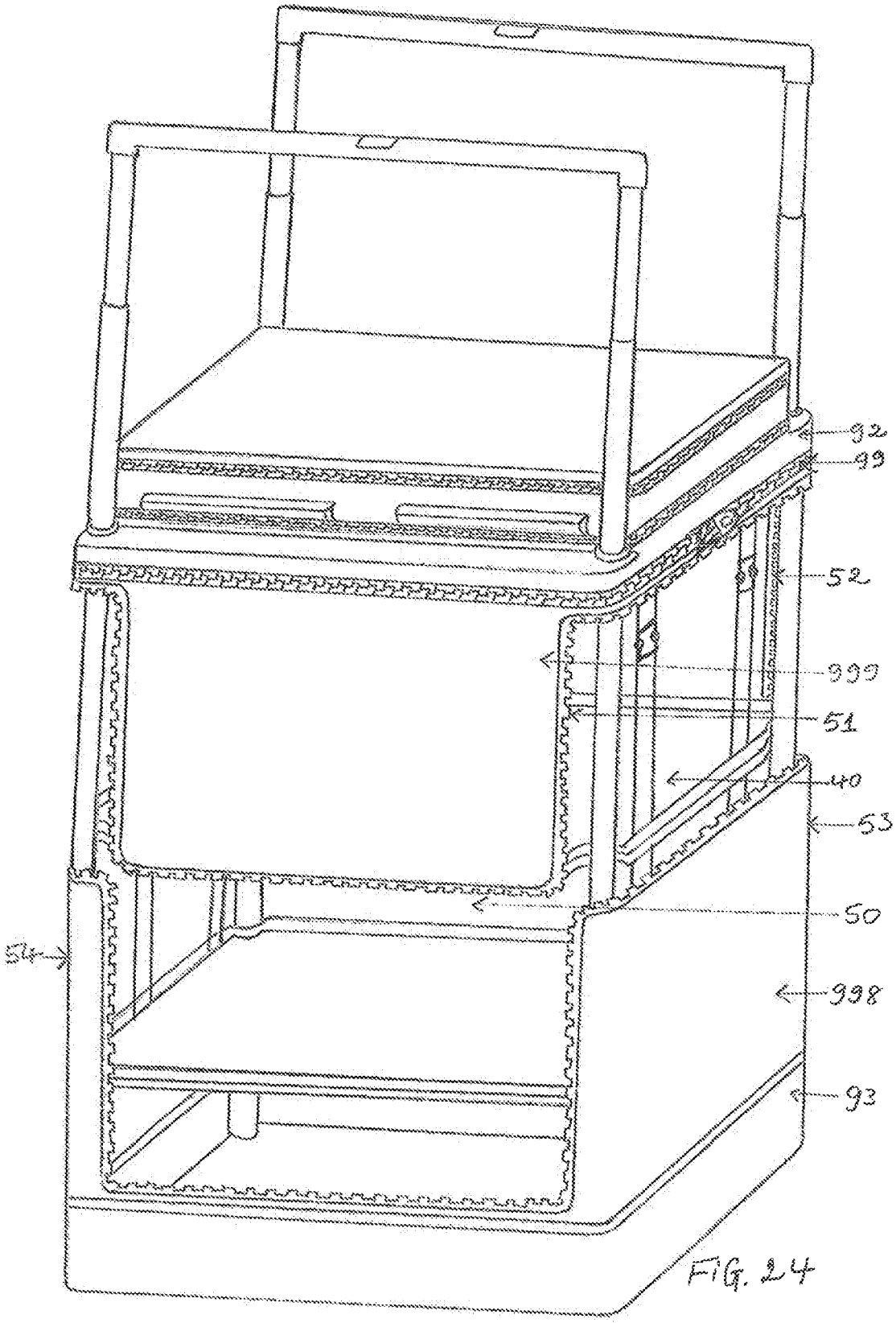
Figure 25:
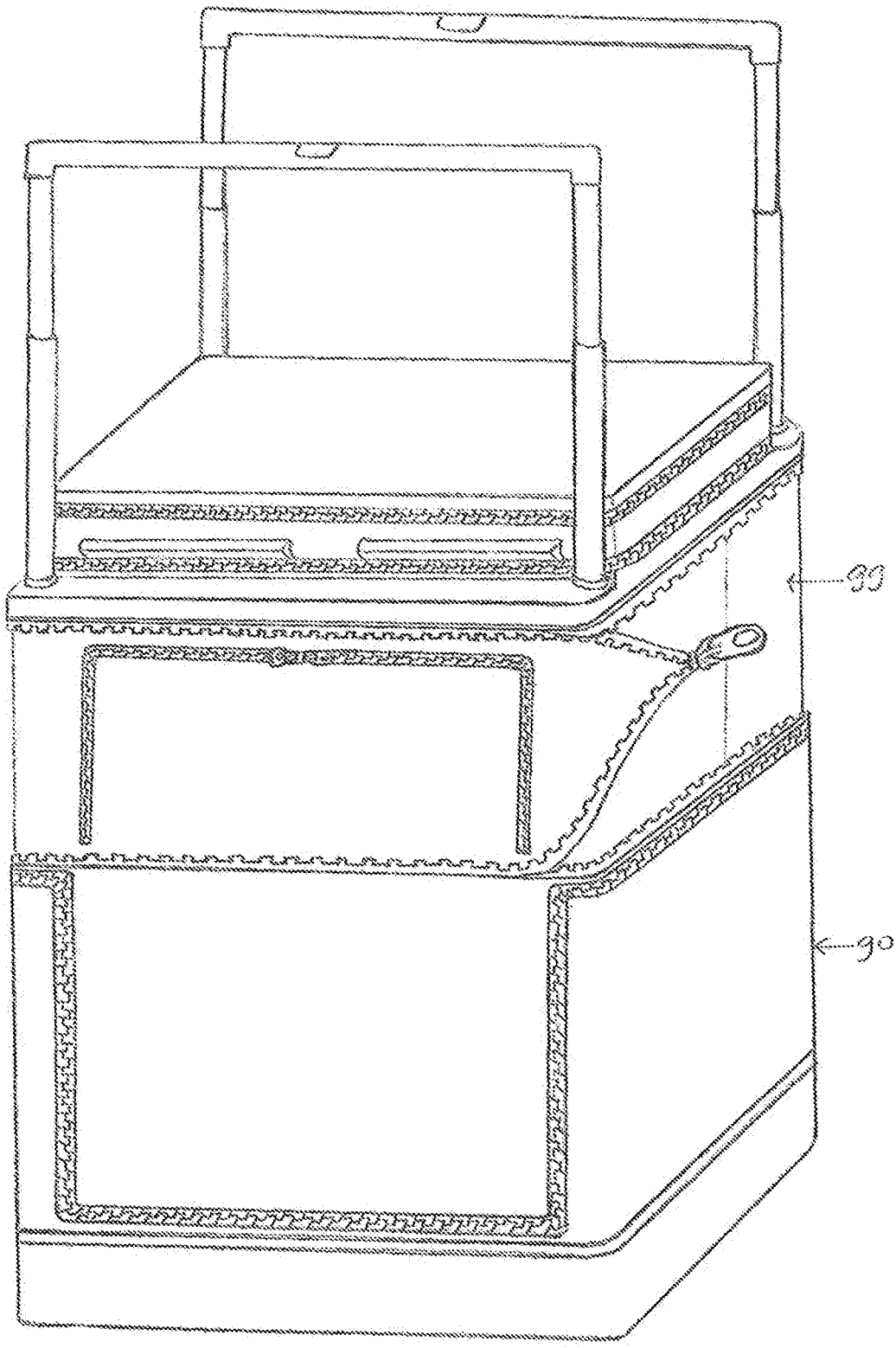
Figure 26:
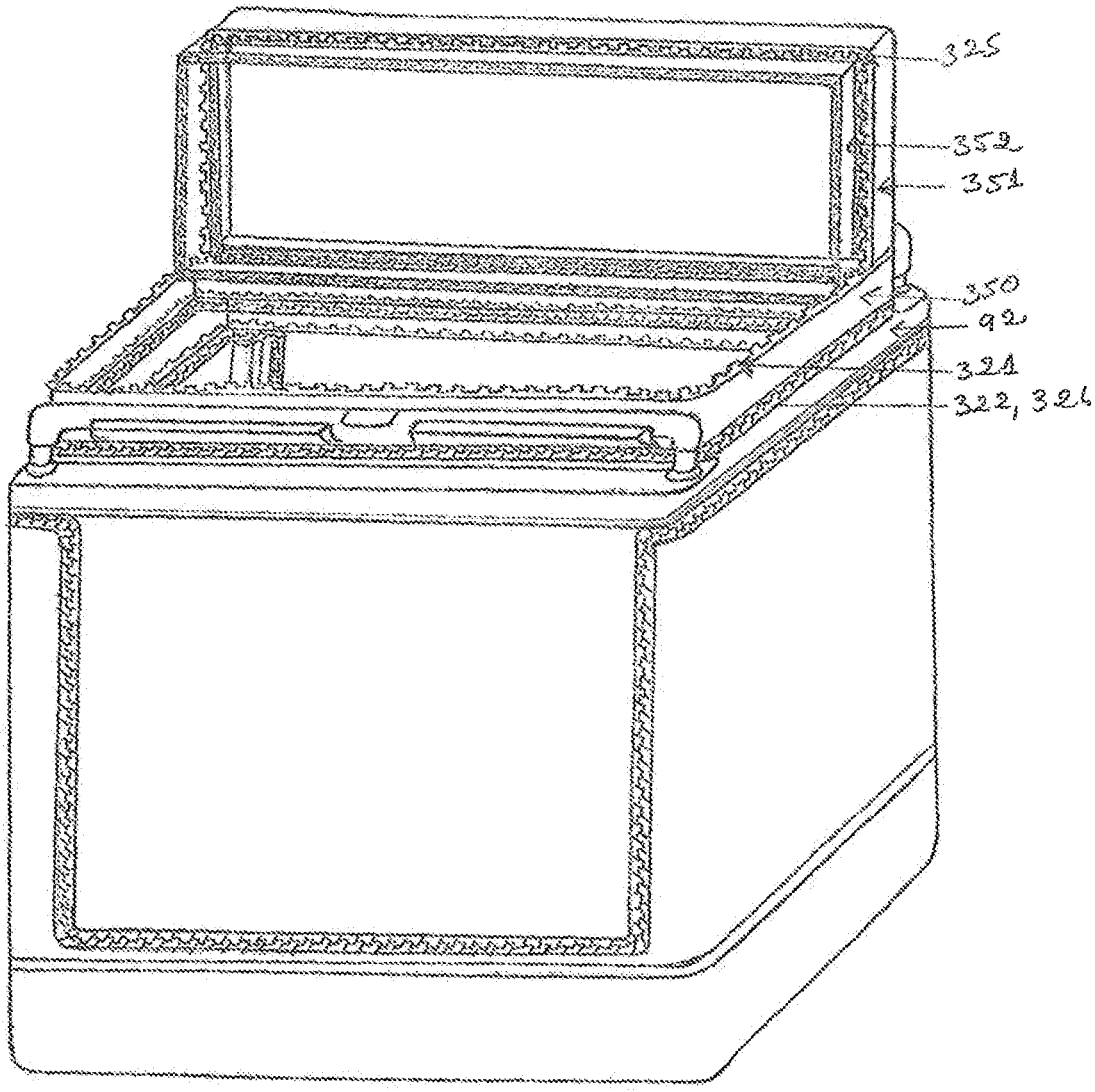
Figure 27:
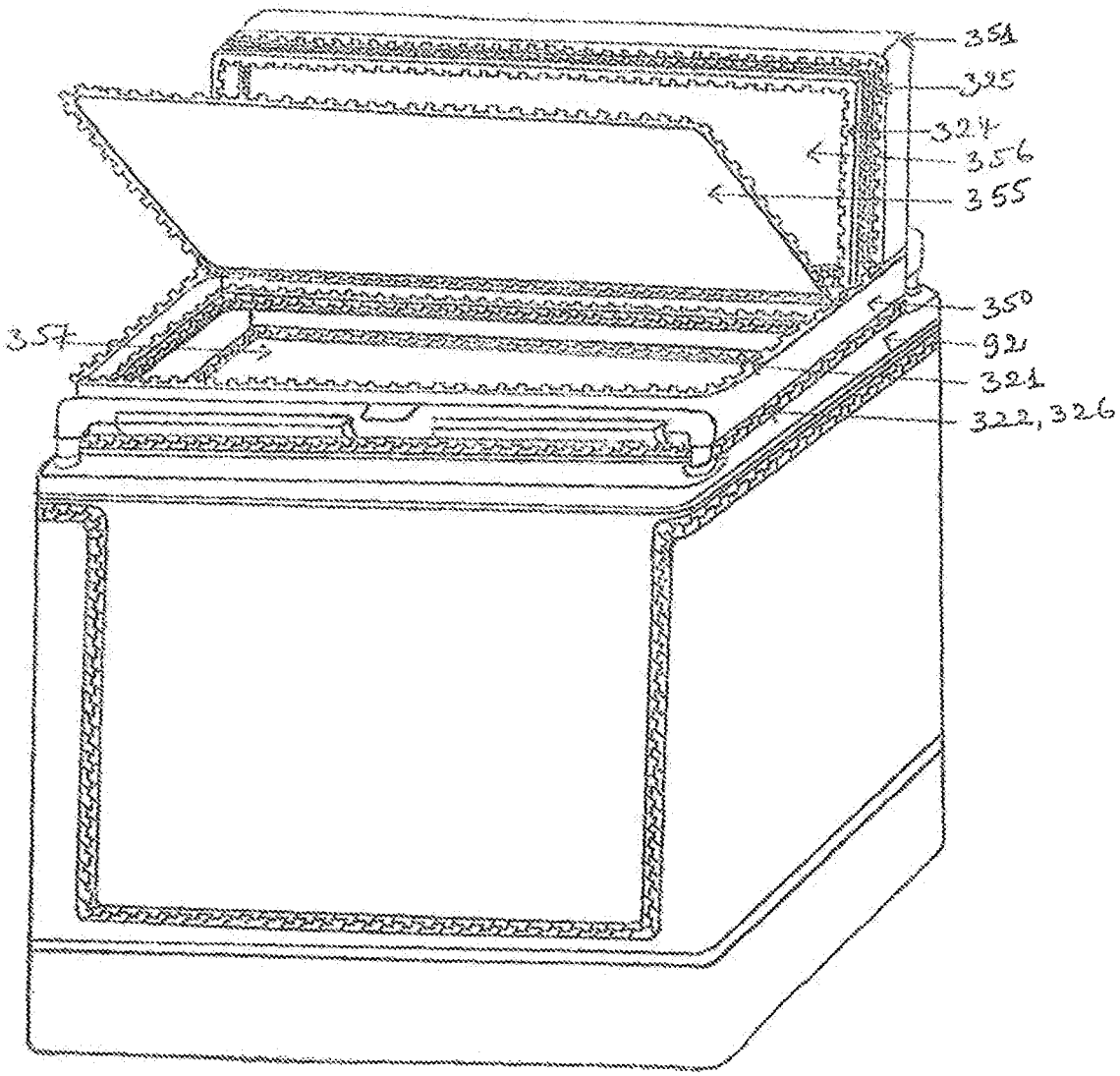
Figure 28:
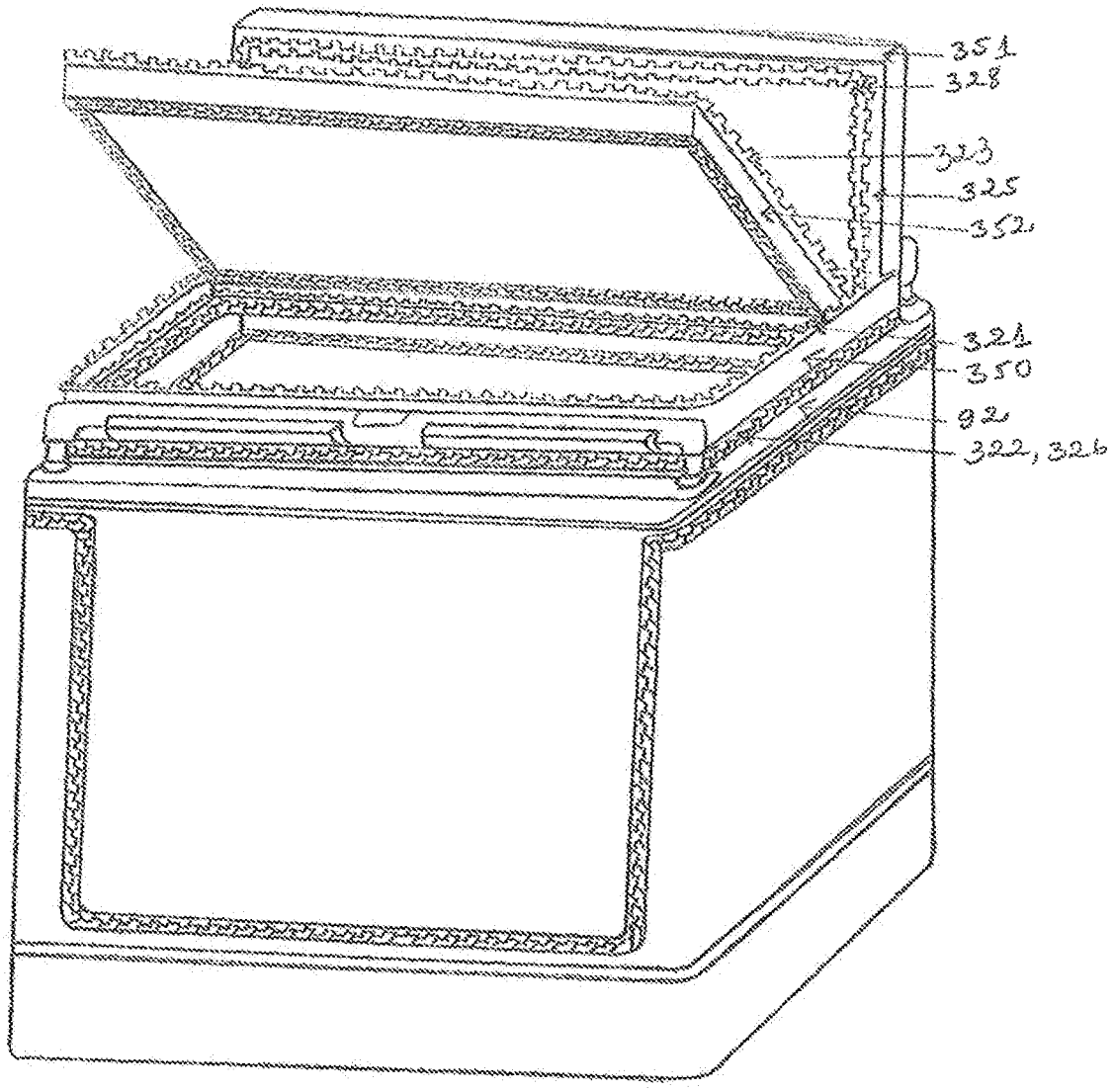
Figure 29:
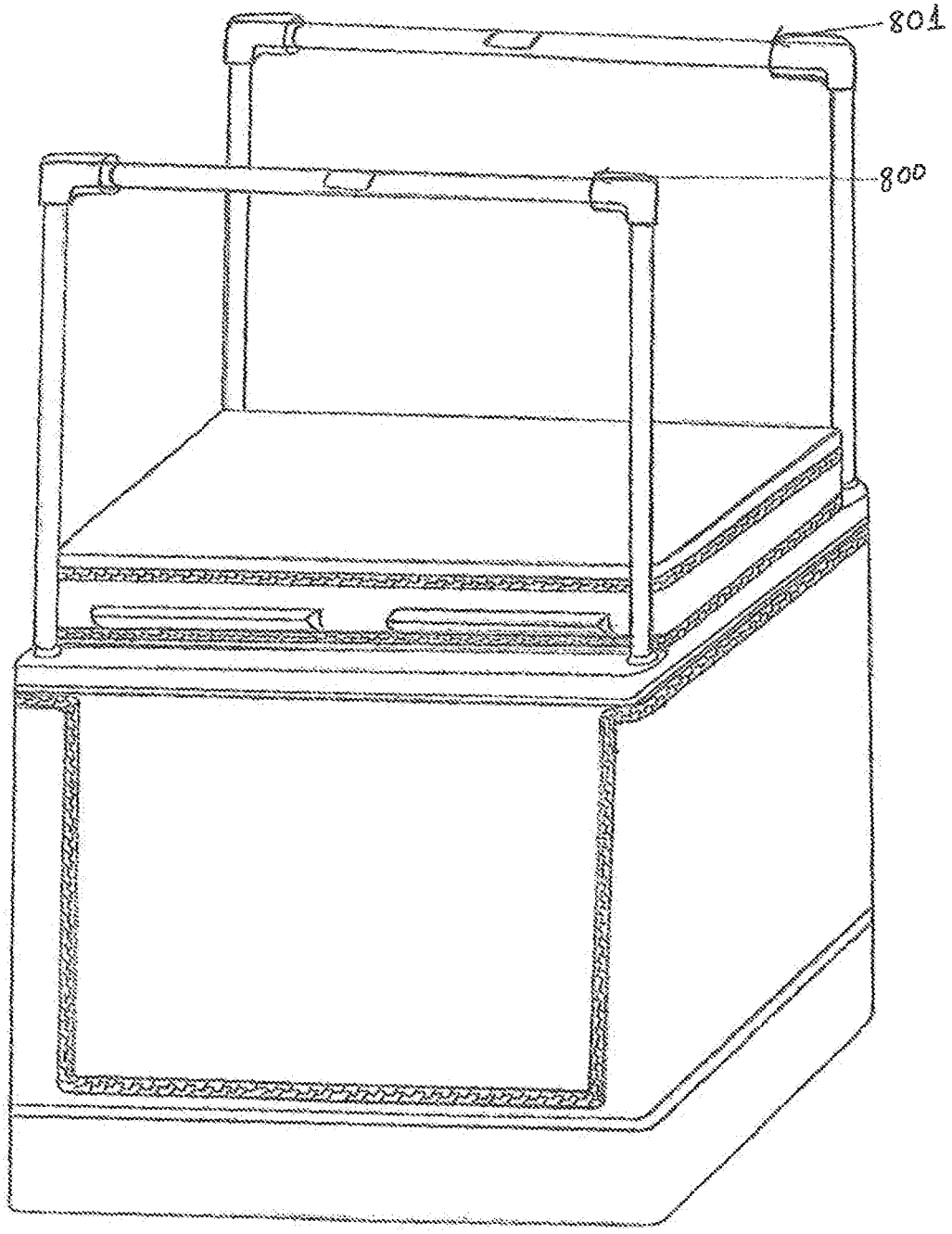
Figure 30:
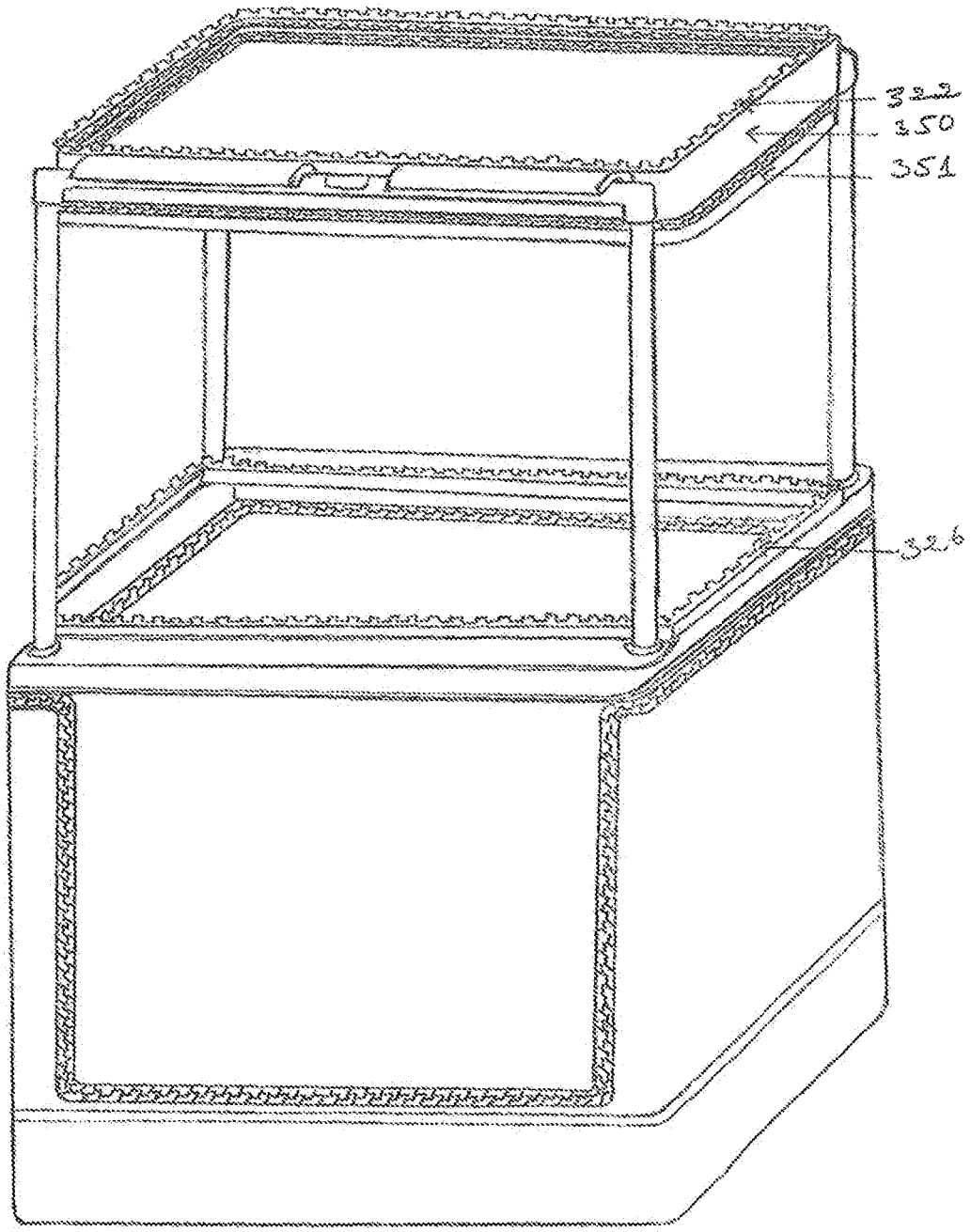
Figure 31:
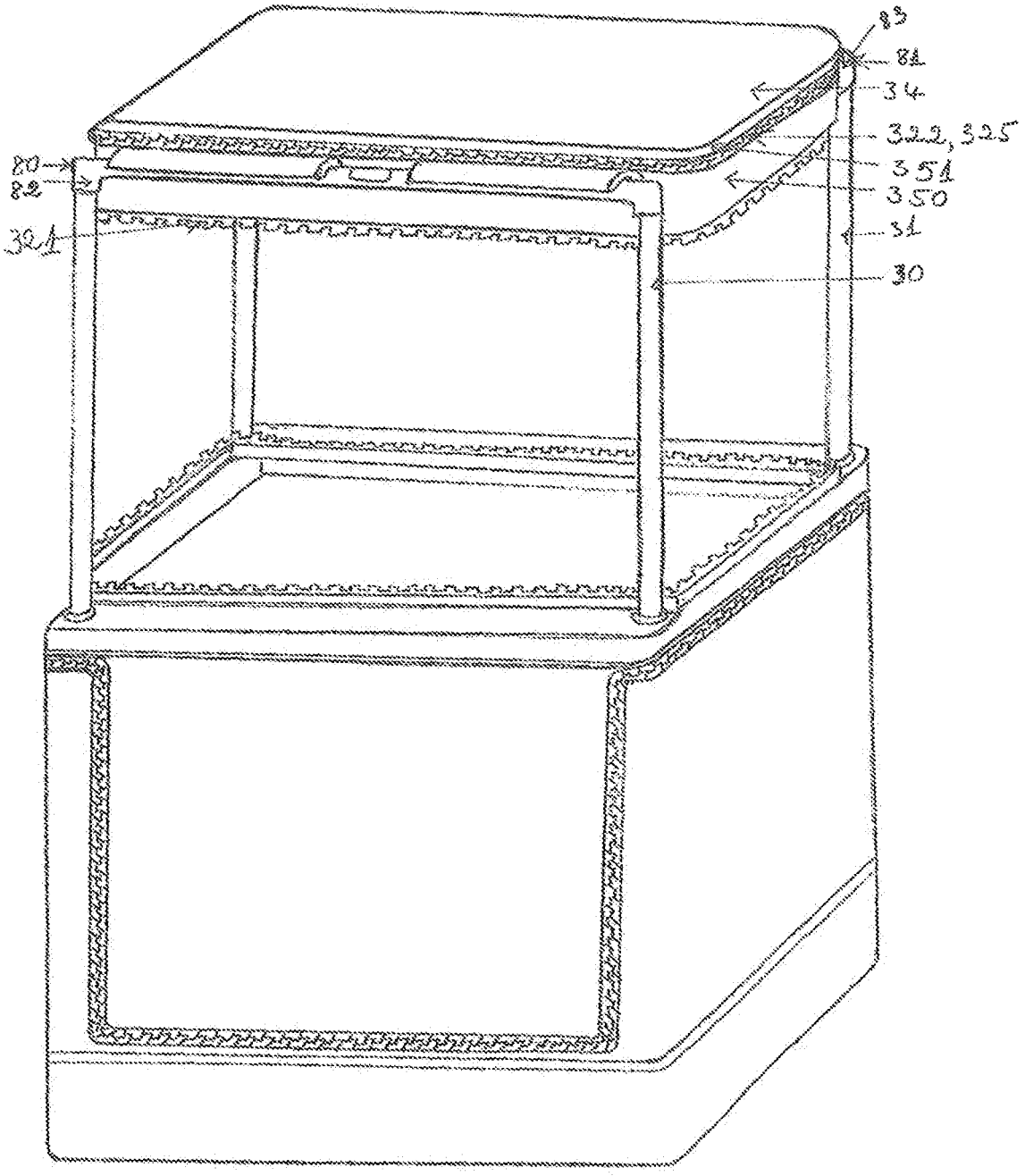
Figure 32:
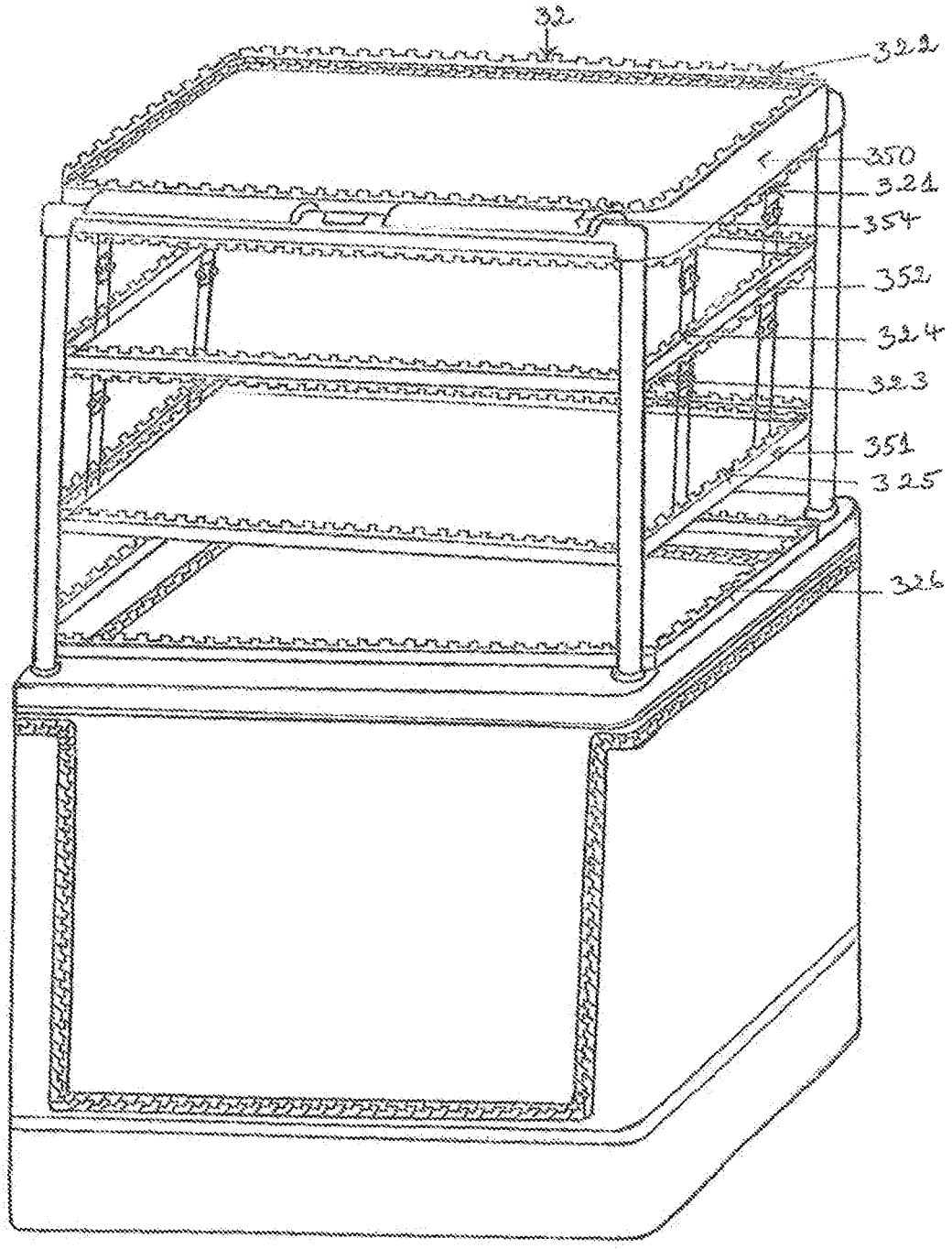
Figure 33A:
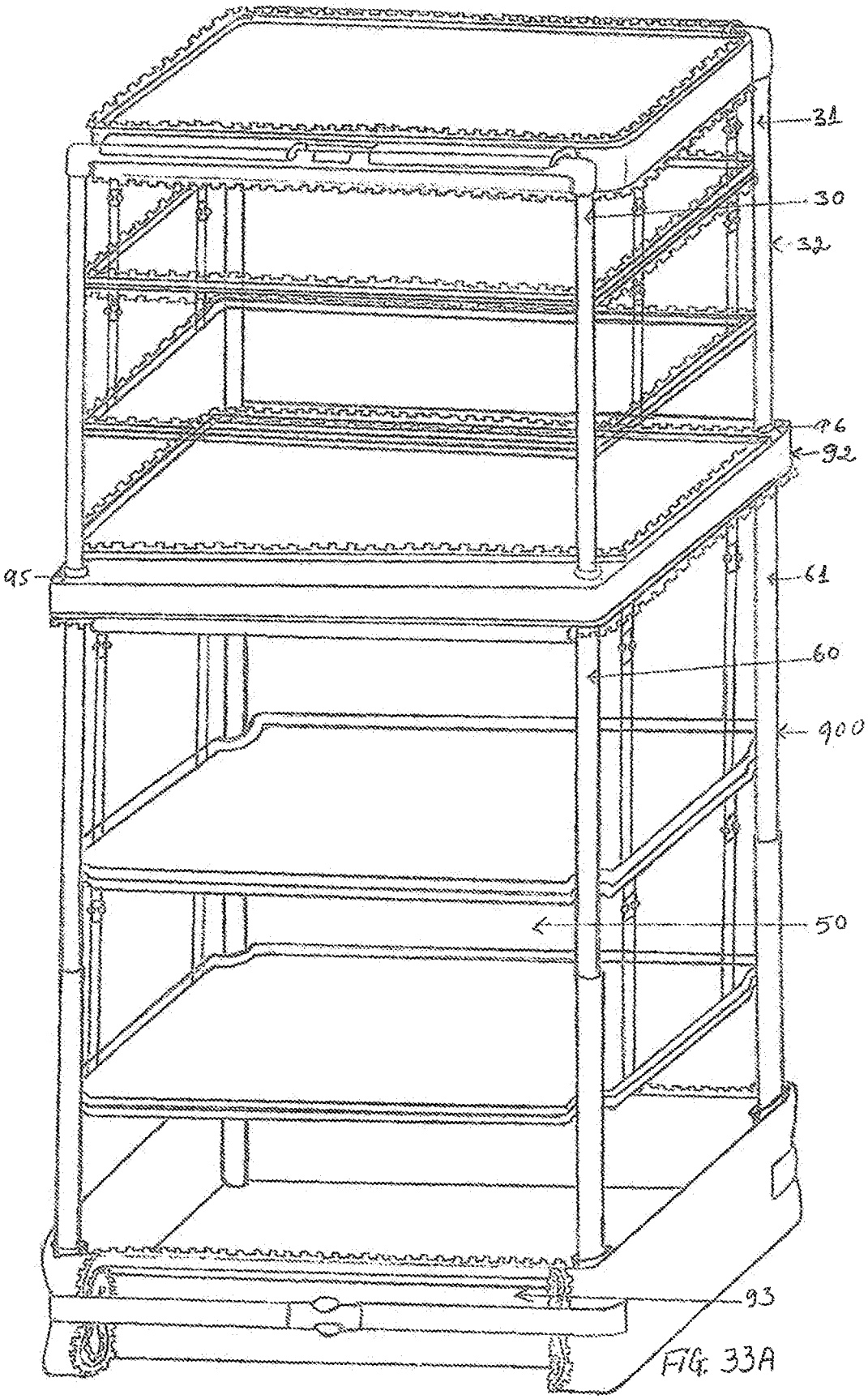
Figure 33B:
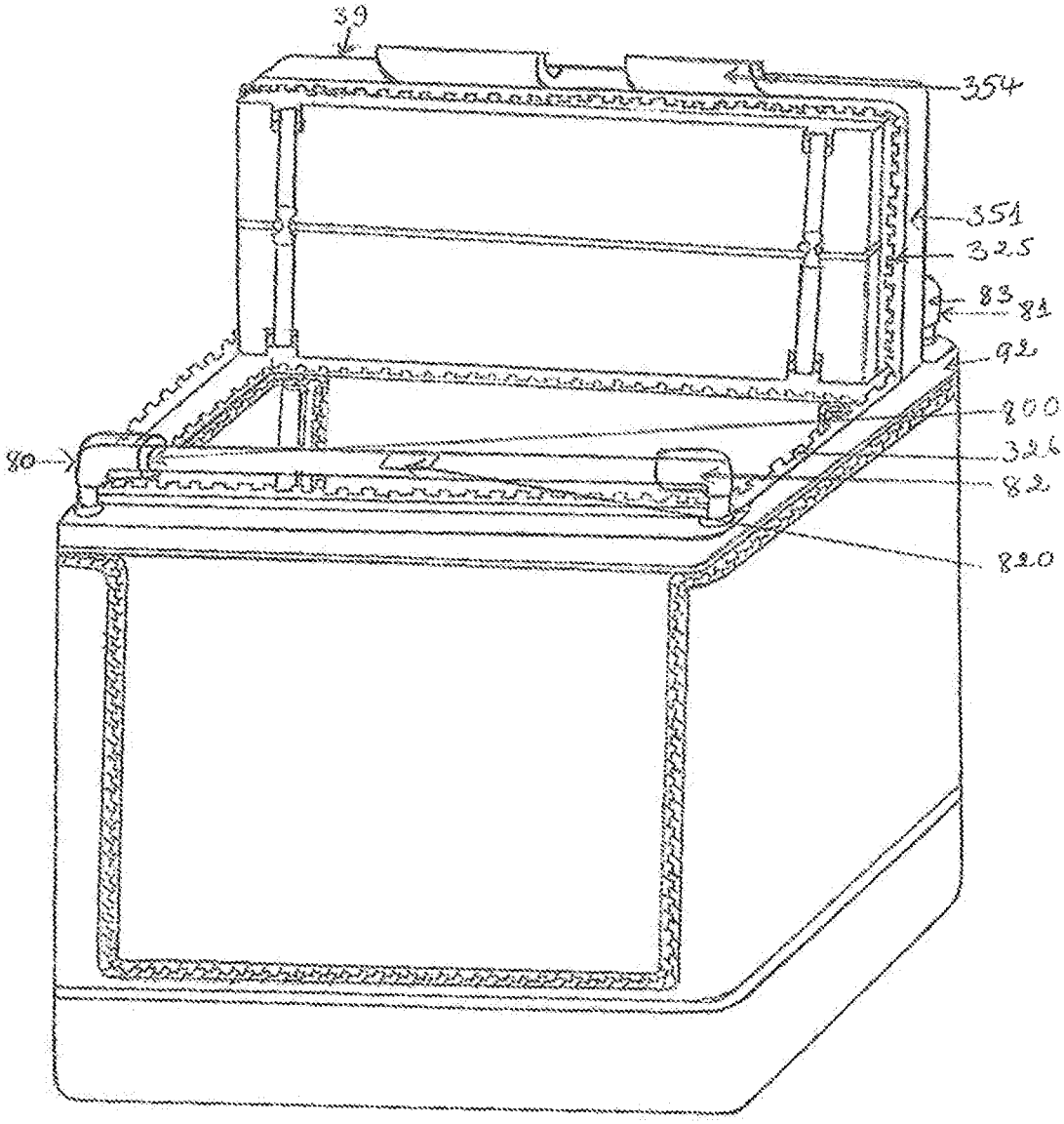
Figure 34:
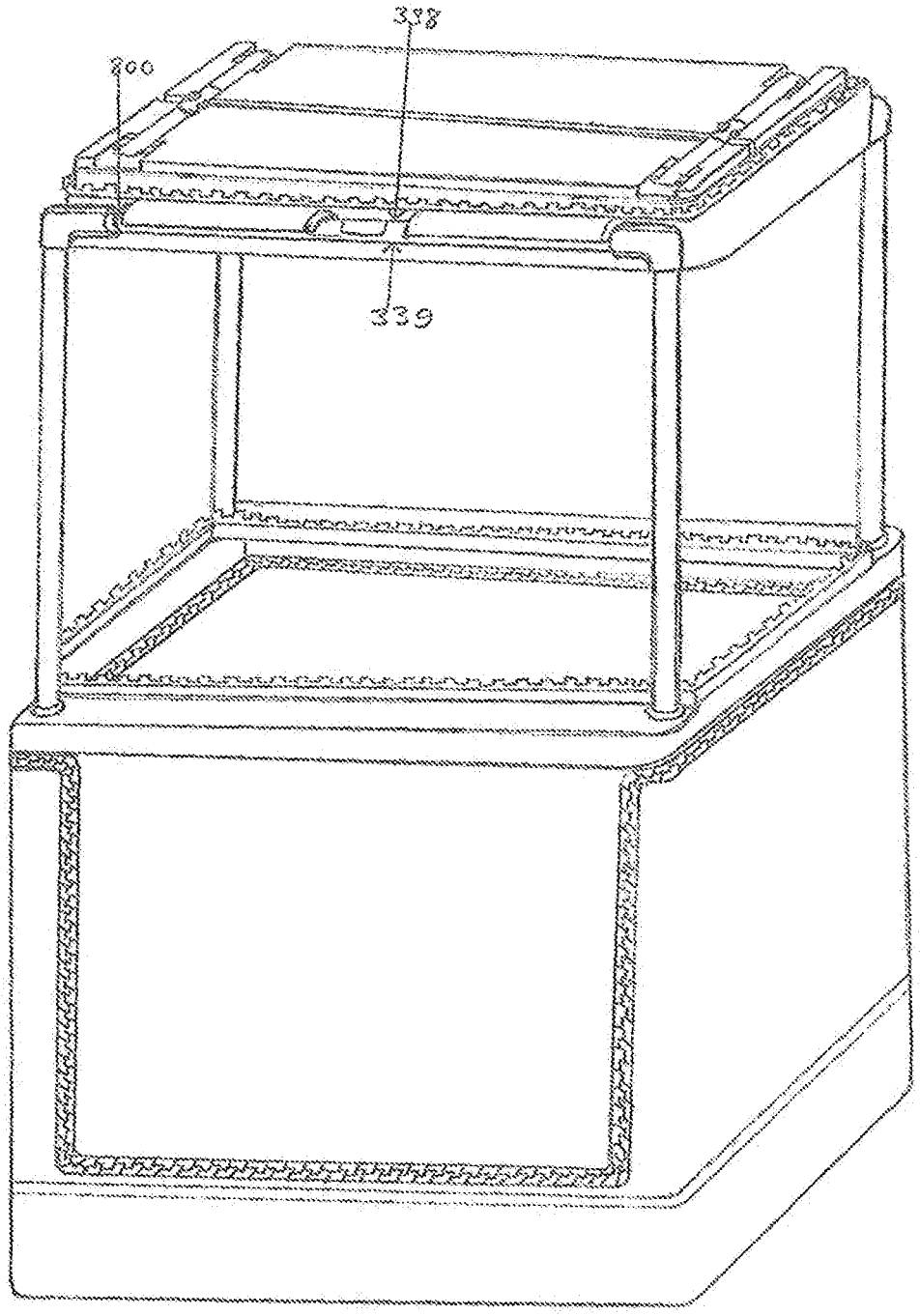
Figure 35:
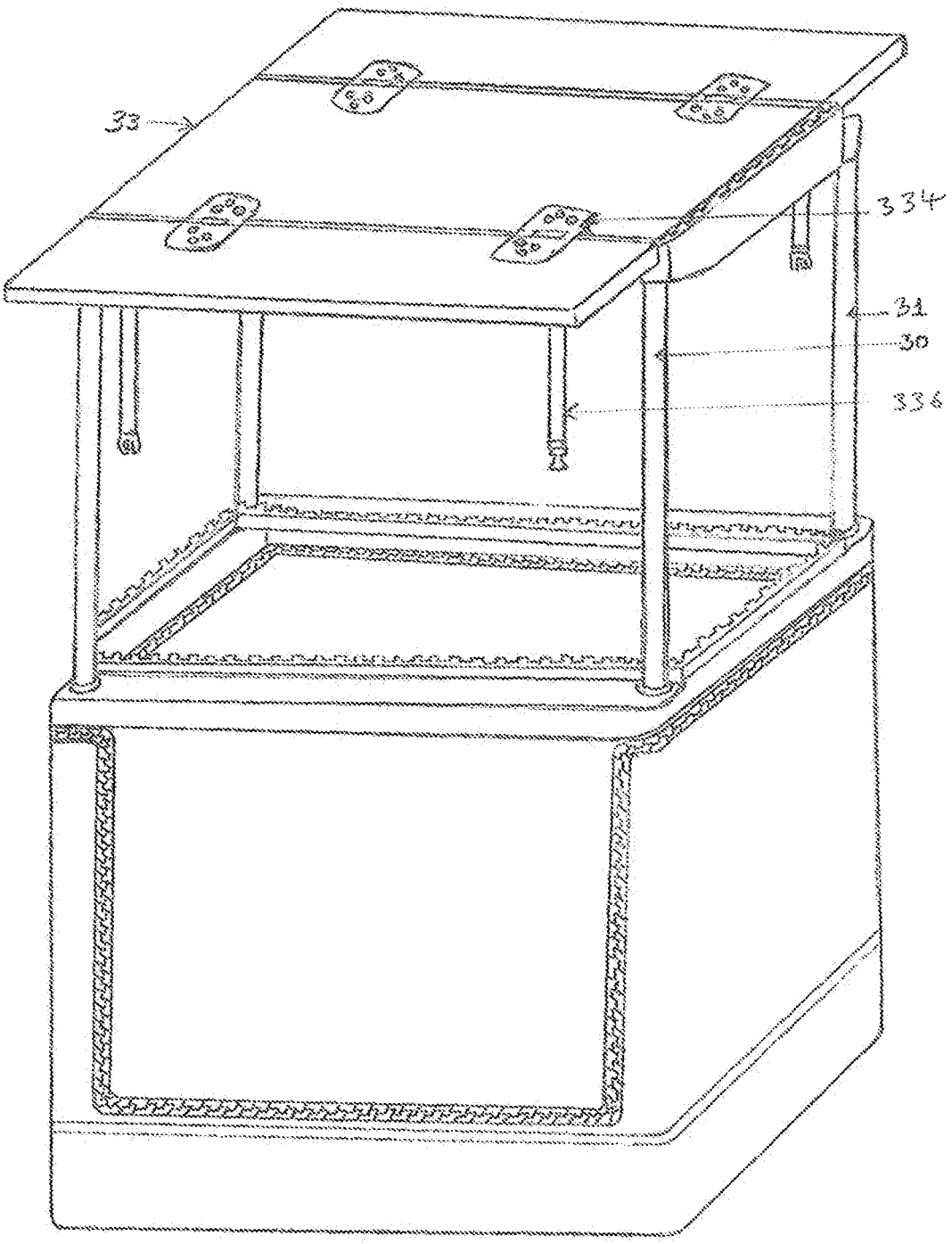
Figure 36:
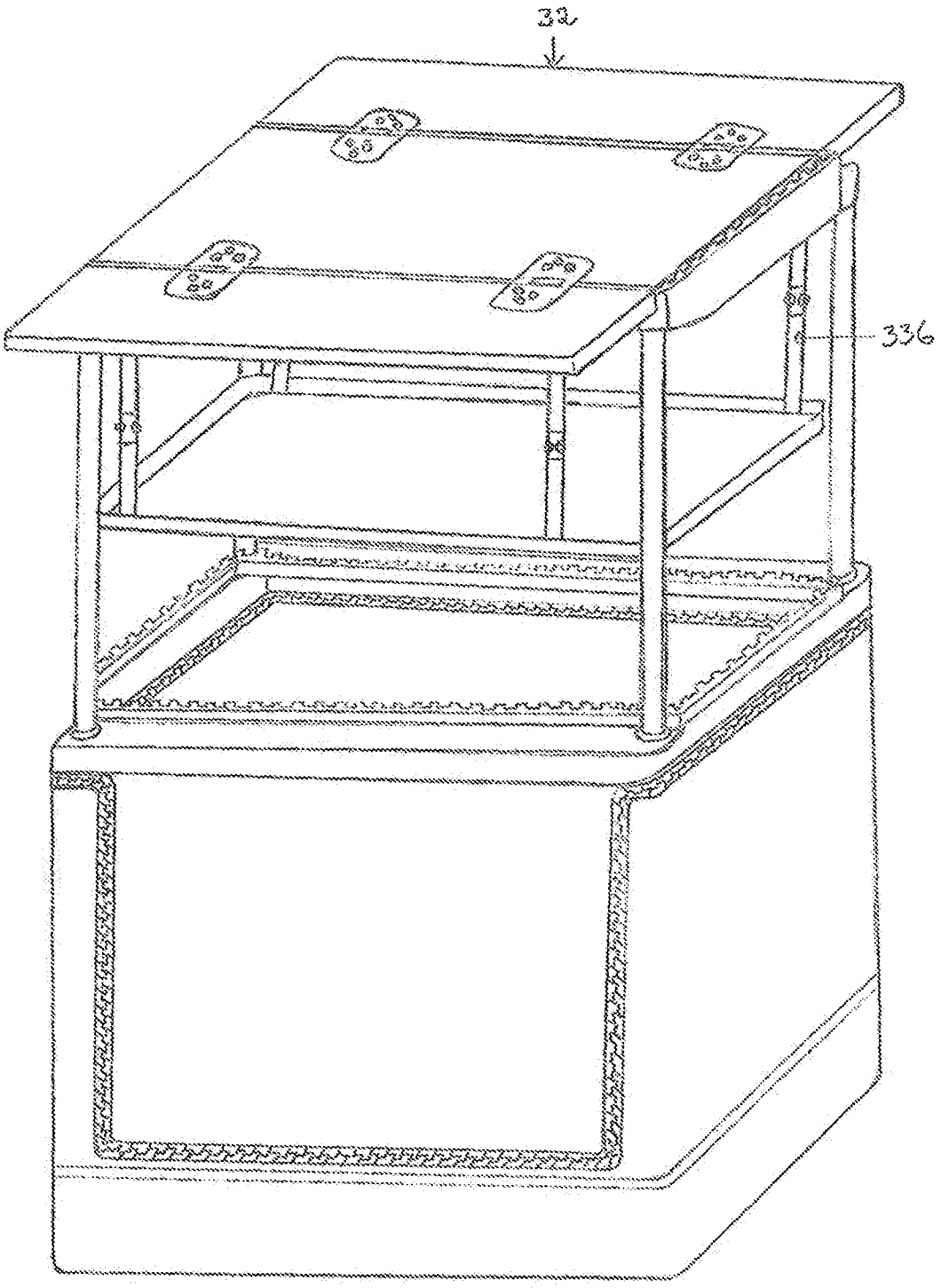
Figure 37:
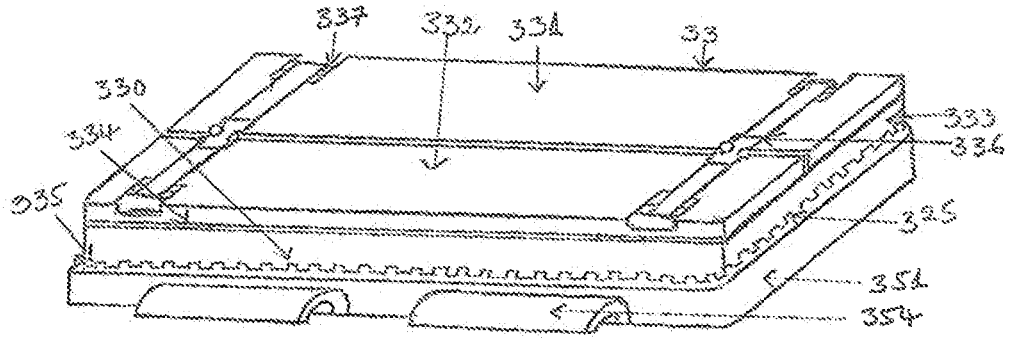
Figure 38:
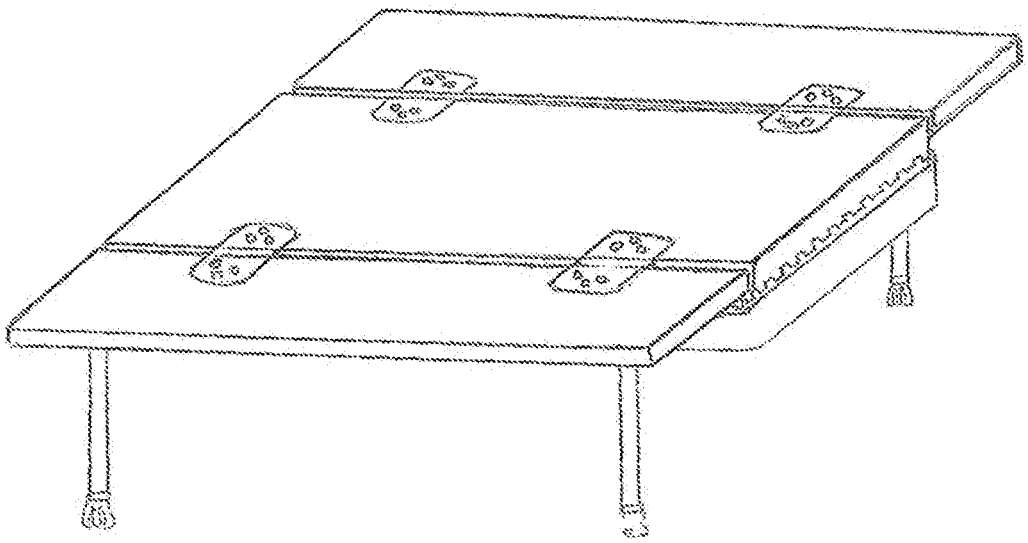
Figure 39:
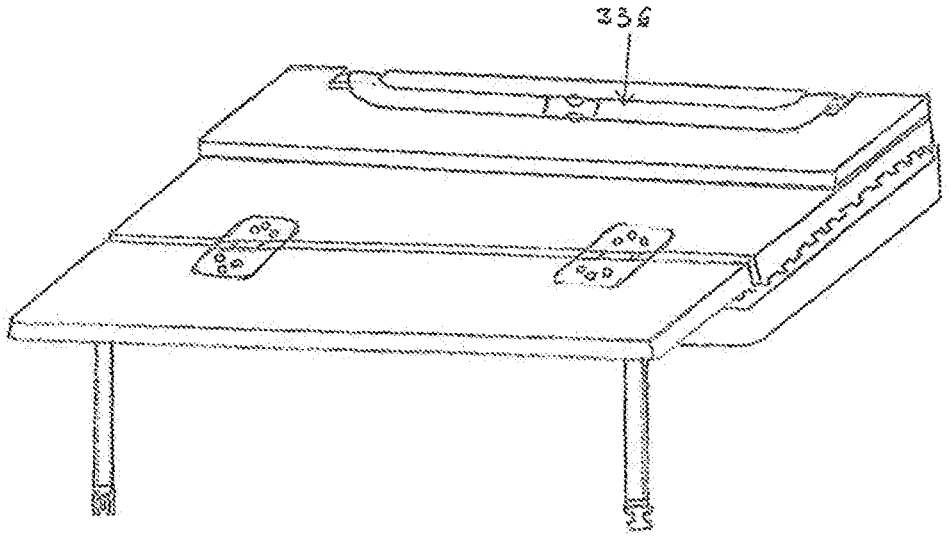
Figure 40:
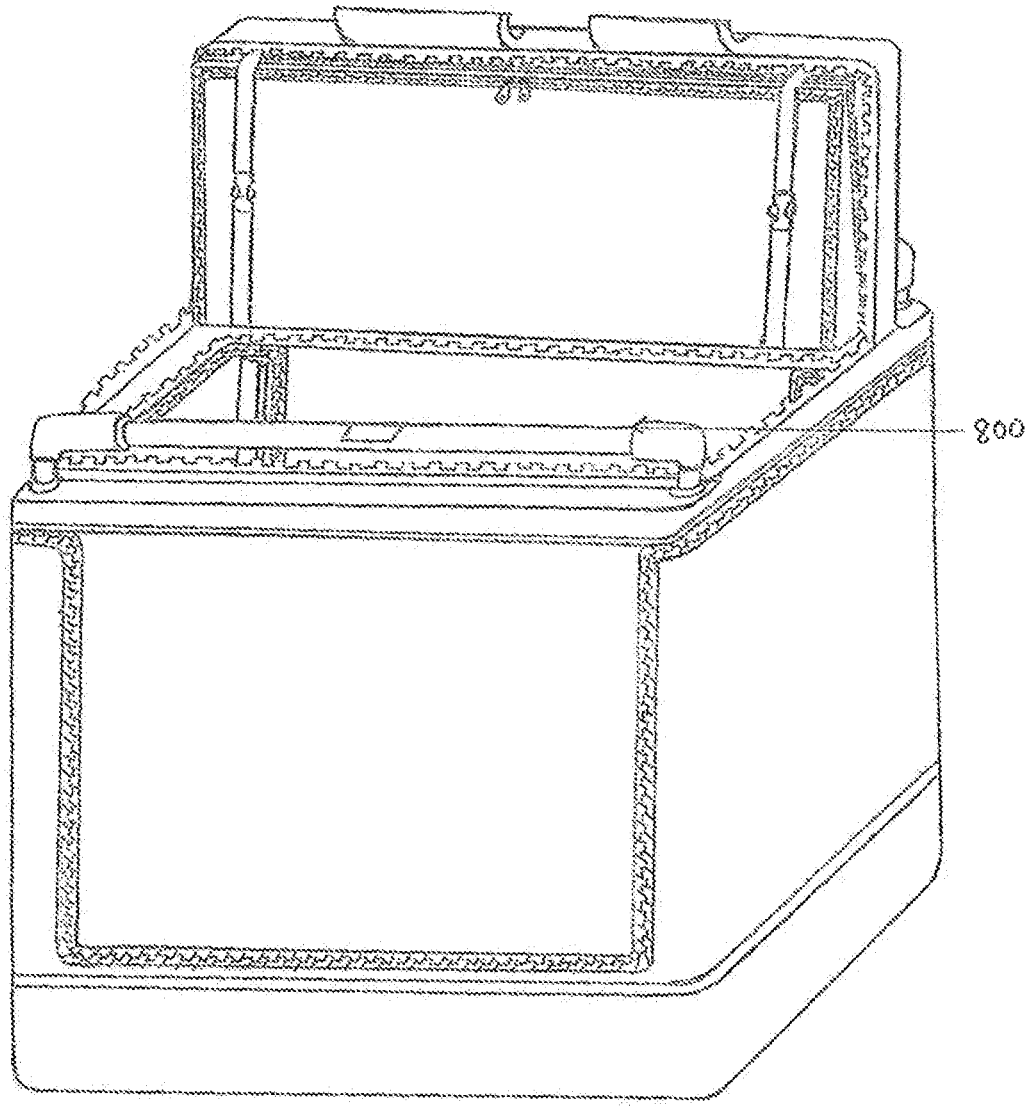

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or FIG.in which the elements appear. The figures are intended to assist the description and to provide a visual representation of certain aspects of the subject matter described herein. The figures are not all necessarily drawn to scale, nor do they show all the structural details, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "abut against" as used herein as a verb is defined as position adjacent and either physically touch or press against, directly or indirectly. After any abutting takes place with one object relative to another object, the objects may be fully or partially "abutted." A first object may be abutted against a second object such that the second object is limited from moving in a direction of the first object. For example, a tube of a telescope shaft may have a radial face abutted against an upper shell. Also, a crossbar of a handle may be abutted against a bracket extending from an upper shell.

The term "align" as used herein is a verb that means manufacture, form, adjust, or arrange one or more physical objects into a particular position. After any aligning takes place, the objects may be fully or partially "aligned." Aligning preferably involves arranging a structure or surface of a structure in linear relation to another structure or surface; for example, such that their borders or perimeters may share a set of parallel tangential lines. In certain instances, the aligned borders or perimeters may share a similar profile. Additionally, apertures may be aligned, such that a structure or portion of a structure may be extended into and/or through the apertures.

The term "aperture" as used herein is defined as any opening in a solid object or structure, e.g., upper shell assembly or a tube. For example, an aperture may be an opening that begins on one side of a solid object, e.g., upper shell assembly or tube, and ends on the other side of the object. An aperture may alternatively be an opening that does not pass entirely through an object, but only partially passes through, e.g., as a groove. An aperture can be an opening in an object, e.g., upper shell assembly or a tube, that is completely circumscribed, defined, or delimited by the object itself. Alternatively, an aperture can be an opening in the object when the object is combined with one or more other objects or structures. For example, a shell may have four sidewalls coupled to form an opening. An aperture may receive another object, e.g., upper shell assembly or a tube, and permit ingress and/or egress of the object through the aperture. Thus, a tube may be received in an aperture of another tube. An aperture may have a shoulder extending from the surface of the aperture.

The term "assembly" as used herein is defined as any set of components that have been fully or partially assembled together. A group of assemblies may be coupled form an assembly or a solid body having an inner surface and an outer surface.

The term "clip" as used herein is defined as a device that can be removably coupled to another object. A clip may be referred to as a Delrin clip or a snap clip. A clip may be coupled to a strap.

The term "bracket" as used herein is defined as a structure extending from a portion of a shell configured for coupling to a crossbar of a handle. A bracket may be curved. A bracket may have an arch. Preferably, a bracket may extend from an upper portion, e.g., table top, of an upper shell. A bracket and an upper portion of an upper shell may be unitary. A bracket may be formed from various materials including plastic, carbon fiber, metal, ceramic, or wood.

The term "coupled" as used herein is defined as directly or indirectly connected, attached, or unitary, e.g., part of. A first object may be coupled to a second object such that the first object is positioned at a specific location and orientation with respect to the second object. For example, two shorter shaft assemblies may be coupled to form a longer shaft assembly. A first object may be permanently, removably, slidably, or threadably coupled to a second object. Two objects may be permanently coupled to each other via sutures, adhesive, and/or press-fit. For example, a zipper tape may be sewn with sutures to a shell so that the zipper tape, in some cases, may not be uncoupled from the shell. Two objects may be removably coupled to each other via zipper tapes, latches, hooks, fasteners, locks, male and female connectors, clips, and/or clamps. For instance, an upper shell and a lower shell may be removably coupled with each other such that the upper shell may then be uncoupled and removed from the lower shell. Also, two objects may be capable of being slidably coupled together, e.g., where an inner diameter of one object is capable of receiving another object. Thus, a first tube having an inner diameter may be slidably coupled to a second tube having a smaller outer diameter. Furthermore, a first concentric support tube may be slidably coupled to a second concentric support tube. Additionally, two objects may be capable of being threadably coupled together, e.g., where a threaded outer surface of one object is capable of engaging with or to a threaded inner surface of another object. For example, a threaded assembly may be threadably coupled to a threaded portion of a support tube where a threaded inner surface of the threaded assembly engages with or to a threaded outer surface of the support tube. Also, a first concentric support tube and a second concentric support tube may be threadably coupled, in which the first concentric support tube has a threaded inner surface engaging with or to a threaded outer surface of the second concentric support tube.

The term "crumpled" as used herein as an adjective is defined as collapsed, folded, creased, squashed, wrinkled, and/or scrunched.

The term "cylindrical" as used herein is defined as shaped like a cylinder, e.g., having straight parallel sides and a circular or oval or elliptical cross-section. A cylindrical body or structure, e.g., shaft, tube, or support tube, may be completely or partially shaped like a cylinder. A cylindrical body, e.g., shaft assembly, that has an outer diameter that changes abruptly may have a radial face, e.g., lip, rim, or flange (see, e.g., 5516, FIG. 55) extending toward the central axis of a cylindrical body. A cylindrical body may have an aperture that extends through the entire length of the body to form a hollow cylinder that is capable of permitting another body, e.g., concentric tube or pin, to pass through.

The term "edge" as used herein is defined as any line or border at which any surface terminates, or any line at which two surfaces of a solid object meet. For example, a shell may each have an inner surface and an outer surface forming an edge where the inner surface and the outer surface meet.

The terms "first" and "second" as used herein merely differentiate two or more things or actions, and do not signify anything else, including order of importance, sequence, etc.

The term "flap" as used herein as a noun is defined a pliable portion of a structure extending therefrom. A flap may be referred to as an overhang, a lappet, or a tab. A flap may be configured to cover, partially or fully, an opening of a shell of a luggage assembly. A flap may have a zipper tape coupled to one or more edges of the flap. A flap may be removably coupled to a lower shell. A flap may have a first zipper tape coupled to one or more edges of the flap and removably coupled to a second zipper tape coupled to an edge of a lower shell. A flap may be removably coupled to a middle shell. A flap may have a first zipper tape coupled to an edge of the flap and removably coupled to a second zipper tape coupled to an edge of a middle shell. A flap may also have various regular shapes including rectangle, square, half-circle, or trapezoid. A flap may have an irregular shape.

The term "groove" as used herein is defined an indentation in a surface. A groove may extend in a straight line from one end to another. A groove may extend in a meander path from end to another. A groove may have a surface forming the shape of a block-letter capital V. A groove may have a surface forming the shape of a rectangle. A groove may have an arcuate surface.

The term "handle" as used as a noun herein is defined as a structure configured to be gripped by a human hand. A handle may have a crossbar coupled to a telescopic shaft. A handle may have a telescopic shaft coupled to the cross bar to form the shape of a block-letter "T." A handle may have a crossbar coupled to the two telescopic shafts. A handle may have a cross bar coupled to two telescopic shafts to form the shape of a block-letter "U." A handle may have a telescopic shaft coupled to a lower shell. A handle may have a telescopic shaft capable of extending away from and/or collapsing towards a lower shell. A handle may have a telescopic shaft extending through an upper shell. A handle may have two tubes disposed between an upper shell and a lower shell. A handle may have two tubes disposed between sidewalls of an upper shell and a lower shell.

The terms "he," "she," "they," and any other personal pronouns as used herein refer to any gender interchangeably. For example, all uses of "he" encompasses "she" as well.

The term "lock" as used herein is defined as structure for inhibiting movement of an object. A lock may be a ball, a pin, a bolt, a bar, cylinder, a rod, or any elongated structure. A lock may be extended through two aligned apertures disposed in two concentric tubes, respectively.

The term "locked position" as used herein is defined as inhibited from or inhibiting movement, e.g., of an object. For instance, a pin would be in a locked position when it inhibits movement of two or more concentric tubes relative to each other. Additionally, a pin would be in a locked position if the pin is extended through two tubes. Thus, the pin may inhibit movement of the tubes relative to each other. Conversely, the term "unlocked position" as used herein is defined as a position of an object in which the object, some cases, does not inhibit movement of one object relative to another object. For instance, a pin would be in an unlocked position if it, in some cases, does not inhibit the movement of two or more concentric tubes relative to each other.

The term "pliable" as used herein is defined as bendable, foldable, and/or flexible.

The term "provide" as used herein is defined as make available, furnish, supply, equip, or cause to be placed in position.

The term "perpendicular" as used herein is defined as at an angle ranging from 85° or 88 to 92° or 95°. Two structures that are perpendicular to each other may be orthogonal and/or tangential to each other.

The term "release assembly" as used herein is defined as a structure capable of actuating a lock, e.g., to a locked position or an unlock position. A release assembly may include a button, one or more springs, and a connection having a portion coupled to the button and one or more portions coupled to the one or more springs. A button may be disposed in a handle of a handle assembly. A spring may be referred to as a biasing member. A spring may be actuated to a biased position to be abutted against one or more locks. Also, a spring may be actuated to an unbiased position to no longer be abutted against one or more locks. A button may be resiliently depressed to cause movement of the connection to actuate the one or more springs. A depressed button may cause actuation of one or more springs to a biased position. An undepressed, e.g., released, button may cause actuation of one or more springs to a biased position.

The term "shell" as used herein means an outer cover, e.g., configured for protection or concealment of an object. A shell may have a base and four sidewalls extending from the base. The base and four sidewalls may be unitary. Furthermore, the base and four sidewalls may be formed, e.g., mold, woven, or carved, from a single piece, e.g. of plastic, carbon fiber, Kevlar, metal, or wood. A shell may be removably coupled to another shell via latches, buckles, clamps, hooks, straps, cords, rope, string, and/or hinges. A shell may have an upper portion and a lower portion removably coupled to the upper portion. A shell may be rigid. A shell may have a first rigid portion and a second pliable portion, e.g., flap or sidewall.

The term "sidewall" as used herein is defined as any structure having a planar surface. A sidewall may have flat planar sides that may or, in some cases, may not be parallel to one another. For example, a planar sidewall may be a flat sidewall, as exemplified by some of the shells and shelves disclosed herein. A sidewall may have curved planar sides that may or, in some cases, may not be parallel to one another. For example, a cylindrical sidewall may be a curved sidewall whose cross section resembles a letter "O," as exemplified by some of the shells and shelves disclosed herein. A sidewall may be rigid. A sidewall may be pliable.

The term "strap" as used herein is defined as a flexible structure that has a long side and at least one short side and may be rectangular in overall shape as viewed from the top or bottom. A strap may be rectangular in cross-section. A strap may be continuous. A strap may be constructed from any one of various materials, e.g., leather, Kevlar, cotton, and/or hemp. A strap may be folded into two or more adjacent portions or segments. Certain straps disclosed herein have segments folded into plies that are sutured together. A strap may have a portion coupled to a shell, tabletop, a shelf, and/or a portion of a clip.

The term "surface" as used herein means any face of a structure. A surface may also refer to that flat or substantially flat area of a structure, for example, a shell, a flap, an expansion curtain, a table top, or a shelf. A surface may also refer to that flat or substantially flat area that extend radially around a cylinder which may, for example, be part of a telescopic shaft, a tube, a shaft, a crossbar, a bracket, or a sleeve. A surface may have irregular contours. A surface may be formed from components, e.g. shell, flap, expansion portion, table top, bracket, and/or shelf, coupled together. Coupled components may form irregular surfaces.

The term "table top" as used herein is defined as a structure having a planar surface on which objects may be disposed. Those objects may include a laptop, tablet, monitor, board game, or electronic device. A tabletop may include one or more table leaves. A tabletop may have two table leaves. A tabletop may have leaves coupled to a base, e.g., via hinges. A tabletop may have leaves capable of being folded towards each other. A tabletop may have leaves capable of being folded away from each other. A tabletop may have leaves having upper surfaces coplanar with an upper surface of a base. Each table leaf of a tabletop may have a width approximately one-half of the width of the base. Accordingly, each leaf of a tabletop may be folded towards a base of the tabletop. Thus, an upper surface of a leaf and an upper surface of a base of a tabletop may be adjacent, parallel, and/or abutted against each other. An upper surface and a lower surface of a leaf of a tabletop may be tapered.

The term "tapered" as used herein is defined as extending from a first point to a second point while become progressively smaller, e.g., in radius, and/or thinner from the first point to the second point. Structures that are tapered may have a profile that is beveled, frustoconical, and/or conical. Structures that are tapered may be cylindrical.

The term "telescopic" as used herein is an adjective defined as extendable, e.g., on a line or a central axis. A telescopic object or structure may be retractable or extendable. Telescopic tubes may be slid relative one another. Telescopic tubes may be slid into one another. Telescopic tubes may be slid away from one another. Slidably coupled, concentric tubes may form a telescopic shaft.

The term "telescopic shaft" as used herein refers to a cylindrical structure capable of being extended or shortened. A telescopic shaft may be a two or more tubes. A telescopic shaft may be a two or more concentric tubes. A telescopic shaft may be coupled to a crossbar. A telescopic shaft may be coupled to an upper shell and a lower shell. A telescopic shaft may have a portion extending through an upper shell.

The term "threaded" as used herein is defined as having threads. Threads may include one or more helical protrusions or grooves on a surface of a cylindrical object. Each full rotation of a protrusion or groove around a threaded surface of the object is referred to herein as a single "thread." A threaded assembly may include a "threaded portion" wherein a section of the threaded assembly includes threads. A threaded portion may have a diameter sized to extend through an aperture of a module coupler body. In certain cases, a threaded portion of a structure may be removably coupled to a threaded assembly.

The term "tube" as used herein is defined any structure having an inner surface and an outer surface. A tube may have an aperture disposed therethrough. Preferably, a tube is cylindrical. However, any or all tubes of an assembly, e.g., shaft, telescopic shaft, crossbar, or sleeve, may have polygonal cross-sections, e.g., triangular, rectangular, pentagonal, hexagonal, or octagonal.

The term "unitary" as used herein defined as having the nature, properties, or characteristics of a single unit. For example, a base and sidewalls that are individual parts of a shell are unitary in the sense they are not separate but rather are formed, e.g., mold or carved, from a single piece of material, e.g. of fabric, plastic, carbon fiber, metal, or wood.

The terms "upper," "lower," "top," "bottom" as used herein are relative terms describing the position of one object, thing, or point positioned in its intended useful position, relative to some other object, thing, or point also positioned in its intended useful position, when the objects, things, or points are compared to distance from the center of the earth. The terms "upper" and "top" identify any object or part of a particular object that is farther away from the center of the earth than some other object or part of that particular object, when the objects are positioned in their intended useful positions. The terms "lower" and "bottom" identify any object or part of a particular object that is closer to the center of the earth than some other object or part of that particular object, when the objects are positioned in their intended useful positions. For example, a luggage assembly may have an upper and lower end. Further, a luggage assembly may have an upper shell assembly and a lower shell assembly. The upper shell may have a top portion and a bottom portion. Additionally, a telescopic shaft may have an upper portion and a lower portion having an upper tube and a lower tube.

The term "zipper tape" as used herein defined as a structure having teeth capable of meshing with teeth of another zipper tape. A zipper tape may be coupled to one or more edges of an upper shell. A zipper tape may be coupled to one or more edges of the middle shell. A first zipper tape may include teeth, a slider, and a box. A second zipper tape may include teeth and a pin. A first zipper tape and a second zipper tape configured for removably coupling may be parts of a zipper assembly.

3. Certain Specific Embodiments

The disclosure herein includes an expandable luggage assembly, which expandable luggage assembly may include: an upper shell having a plurality of sidewalls; a lower shell having a plurality of sidewalls removably coupled to one more of the plurality of sidewalls of the upper shell; a shelf coupled to the upper shell; a plurality of wheels coupled to the lower shell; and two handles, each handle of the two handles comprising: a crossbar disposed above the upper shell; a first tube coupled to the crossbar and slidably coupled to the upper shell; a second tube slidably coupled to the first tube and capable of being abutted against the upper shell; a third tube slidably coupled to the second tube and coupled to the lower shell.

The disclosure herein includes an expandable luggage assembly, which expandable luggage assembly may include: an upper portion having one or more brackets; and a lower portion; a shelf coupled to the upper portion; a lower shell; a plurality of wheels coupled to a base of the lower shell; and two handles, each handle of the two handles comprising: a crossbar removably coupled to at least one bracket of the one or more brackets; and a telescopic shaft having a first portion coupled to the crossbar and a second portion coupled to a base of the lower shell.

The disclosure herein includes an expandable luggage assembly, which expandable luggage assembly may include:

an upper shell; a middle shell removably coupled to the upper shell; a lower shell removably coupled to the middle shell; a plurality of wheels coupled to a base of the lower shell; and two handles, wherein each handle of the two handles comprises: a telescopic shaft coupled to an inner surface of the lower shell and having a portion extending through the upper shell; and a crossbar coupled to the telescopic shaft, wherein an upper portion of the upper shell is capable of being coupled to the crossbar.

The disclosure herein includes an expandable luggage assembly, which expandable luggage assembly may include: an upper shell having a plurality of sidewalls; a lower shell comprising: a base; and a plurality of sidewalls extending from the base and removably coupled to the plurality of sidewalls of the upper shell; a shelf coupled to the upper shell; a plurality of wheels coupled to the lower shell; and two handles, each of the two handles comprising: a telescopic shaft having a portion capable of supporting the upper shell; and a crossbar coupled to the telescopic shaft, wherein a portion of the upper shell is capable of being coupled to the crossbar.

In any one of the structures and methods disclosed herein, the first tube may extend through the upper shell.

In any one of the structures and methods disclosed herein, the second tube may have a portion abutted against an inner surface of the upper shell.

In any one of the structures and methods disclosed herein, the second tube and the third tube may be disposed between the upper shell and the lower shell.

In any one of the structures and methods disclosed herein, the upper shell may include: an upper portion; a lower portion removably coupled to the upper portion; and an expansion curtain coupled to the lower portion, wherein the expansion curtain may be crumpled.

In any one of the structures and methods disclosed herein, the upper shell may have a flap that is pliable.

In any one of the structures and methods disclosed herein, the shelf may be coupled to an inner surface of the upper portion of the upper shell.

Any one of the structures and methods disclosed herein may further include a shelf coupled to an inner surface of the lower portion of the upper shell.

Any one of the structures and methods disclosed herein may further include: a shelf; and a plurality of straps, wherein each strap of the plurality of straps may include: a first portion coupled to the upper portion of the upper shell; a second portion coupled to the shelf; and a clip buckle coupled to the first portion and the second portion.

In any one of the structures and methods disclosed herein, the length of the first portion and the second portion of the strap may be adjusted.

Any one of the structures and methods disclosed herein may further include a slider coupled to the first portion and the second portion.

Any one of the structures and methods disclosed herein may further include: a first shelf coupled to the lower portion of the upper shell; and a second shelf removably coupled to the first shelf.

In any one of the structures and methods disclosed herein, the telescopic shaft of each handle may have a portion extending through the upper shell.

Any one of the structures and methods disclosed herein may further include a sleeve disposed around a portion of each telescopic shaft of each handle of the two handles.

In any one of the structures and methods disclosed herein, the upper shell may further include a lift handle.

Any one of the structures and methods disclosed herein may further include: a first zipper tape coupled to the upper shell; a second zipper tape coupled to an upper edge of the middle shell and removably coupled to the first zipper tape; a third zipper tape coupled to a lower edge of the middle shell; a fourth zipper tape coupled to the lower shell and removably coupled to third zipper tape.

In any one of the structures and methods disclosed herein, the tabletop may further include a hinge coupled to the base and the extension.

In any one of the structures and methods disclosed herein, a surface of the base and a surface of the extension may be coplanar.

Any one of the structures and methods disclosed herein may further include a shelf coupled to an inner surface of the tabletop.

In any one of the structures and methods disclosed herein, the middle shell that may include two end portions, a grip at one end portion, and an aperture at other end portion; and a first zipper tape coupled to the upper shell; a second zipper tape coupled to an upper edge of the middle shell and removably coupled to the first zipper tape; a third zipper tape coupled to a lower edge of the middle shell; a fourth zipper tape coupled to the lower shell and removably coupled to third zipper tape; wherein the two end portions of the middle shell may overlap and the grip may be extended through the aperture.

In any one of the structures and methods disclosed herein, the upper shell may have a flap.

In any one of the structures and methods disclosed herein, the upper shell may have a flap having a first zipper tape coupled to a second zipper tape coupled to the lower shell.

In any one of the structures and methods disclosed herein, the upper shell may have an expansion curtain.

In any one of the structures and methods disclosed herein, the upper shell may have an expansion curtain that is pliable.

In any one of the structures and methods disclosed herein, the expansion curtain may have a flap.

In any one of the structures and methods disclosed herein, the upper shell may have brackets.

In any one of the structures and methods disclosed herein, the upper shell may have brackets having a C-shape.

In any one of the structures and methods disclosed herein, the upper shell may have a bracket abutted against a crossbar of a handle of the two handles.

In any one of the structures and methods disclosed herein, the upper shell may include: a first bracket abutted against a first crossbar of a first handle of the two handles; and a second bracket abutted against a second crossbar of a second handle of the two handles.

In any one of the structures and methods disclosed herein, the upper shell may include: a first portion; and a second portion removably coupled to the first portion.

In any one of the structures and methods disclosed herein, the upper shell may include: a first portion capable of being coupled to the two handles; and a second portion removably coupled to the first portion.

In any one of the structures and methods disclosed herein, the upper shell may include: a first portion having a first zipper tape and a second zipper tape; and a second portion having a third zipper tape, wherein the third zipper tape may be capable of being removably coupled to the first zipper tape or the second zipper tape, or both.

In any one of the structures and methods disclosed herein, the upper shell may further include a lift handle.

Any one of the structures and methods disclosed herein may further include four wheels coupled to a base of the lower shell.

Any one of the structures and methods disclosed herein may further include four wheels coupled to a base of the lower shell.

In any one of the structures and methods disclosed herein, the upper shell may have no wheels coupled thereto.

Any one of the structures and methods disclosed herein may further include a shelf coupled to the upper shell.

Any one of the structures and methods disclosed herein may further include a shelf disposed between the upper shell and the lower shell.

In any one of the structures and methods disclosed herein, the telescopic shaft of each handle may have a portion extending through the upper shell.

Any one of the structures and methods disclosed herein may further include a sleeve disposed around a portion of each telescopic shaft of each of the two handles.

Any one of the structures and methods disclosed herein may further include a sleeve disposed between the upper shell and the lower shell and around a portion of each telescopic shaft of each of the two handles.

Any one of the structures and methods disclosed herein may further include: a shelf; and a plurality of straps, each strap coupled to the shelf and the inner surface of the upper portion of the upper shell.

Any one of the structures and methods disclosed herein may further include: a shelf; and a plurality of straps, each strap may include: a first portion coupled to an inner surface of the upper portion of the upper shell; a second portion coupled to the shelf; and a release buckle coupled to the first portion and the second portion.

Any one of the structures and methods disclosed herein may further include: a first shelf coupled to the upper portion of the upper shell; and a second shelf removably coupled to the first shelf.

Any one of the structures and methods disclosed herein may further include: a first shelf coupled to the lower portion of the upper shell; and a second shelf removably coupled to the first shelf.

In any one of the structures and methods disclosed herein, the tabletop may further include a hinge coupled to the base and the extension.

In any one of the structures and methods disclosed herein, a surface of the base and a surface of the extension may be coplanar.

In any one of the structures and methods disclosed herein, a surface of the base and a surface of the extension may be parallel.

In any one of the structures and methods disclosed herein, a surface of the base and a surface of the extension may be adjacent.

In any one of the structures and methods disclosed herein, a surface of the base and a surface of the extension may be parallel.

In any one of the structures and methods disclosed herein, a planar surface of the extension may be abutted against a planar surface of the base.

Any one of the structures and methods disclosed herein may further include a shelf coupled to an inner surface of the tabletop.

In any one of the structures and methods disclosed herein, the lower shell may further include a base coupled to an end of the third tube.

In any one of the structures and methods disclosed herein, the middle shell may include: a first side; a second side having an aperture; and a grip coupled to the first side and having a portion extended through the aperture.

4. Specific Embodiments in the Drawings

The drawings presented herein are for illustrative purposes only and do not limit the scope of the claims. Rather, the drawings are intended to help enable one having ordinary skill in the art to make and use the claimed inventions.

This section addresses specific versions of expandable luggage assemblies shown in the drawings, which relate to assemblies, elements and parts that can be part of an expandable luggage assembly, and methods for storing travel-ware. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability.

Although the methods, structures, elements, and parts described herein have been described in detail, it should be understood that various changes, substitutions, and alterations can be made without departing from the spirit and scope of the inventions as defined by the following claims. Those skilled in the art may be able to study the preferred embodiments and identify other ways to practice the inventions that are not exactly as described herein. It is the intent of the inventor that variations and equivalents of the inventions are within the scope of the claims, while the description, abstract and drawings are not to be used to limit the scope of the inventions. The inventions is specifically intended to be as broad as the claims below and their equivalents.

Figure 53A:
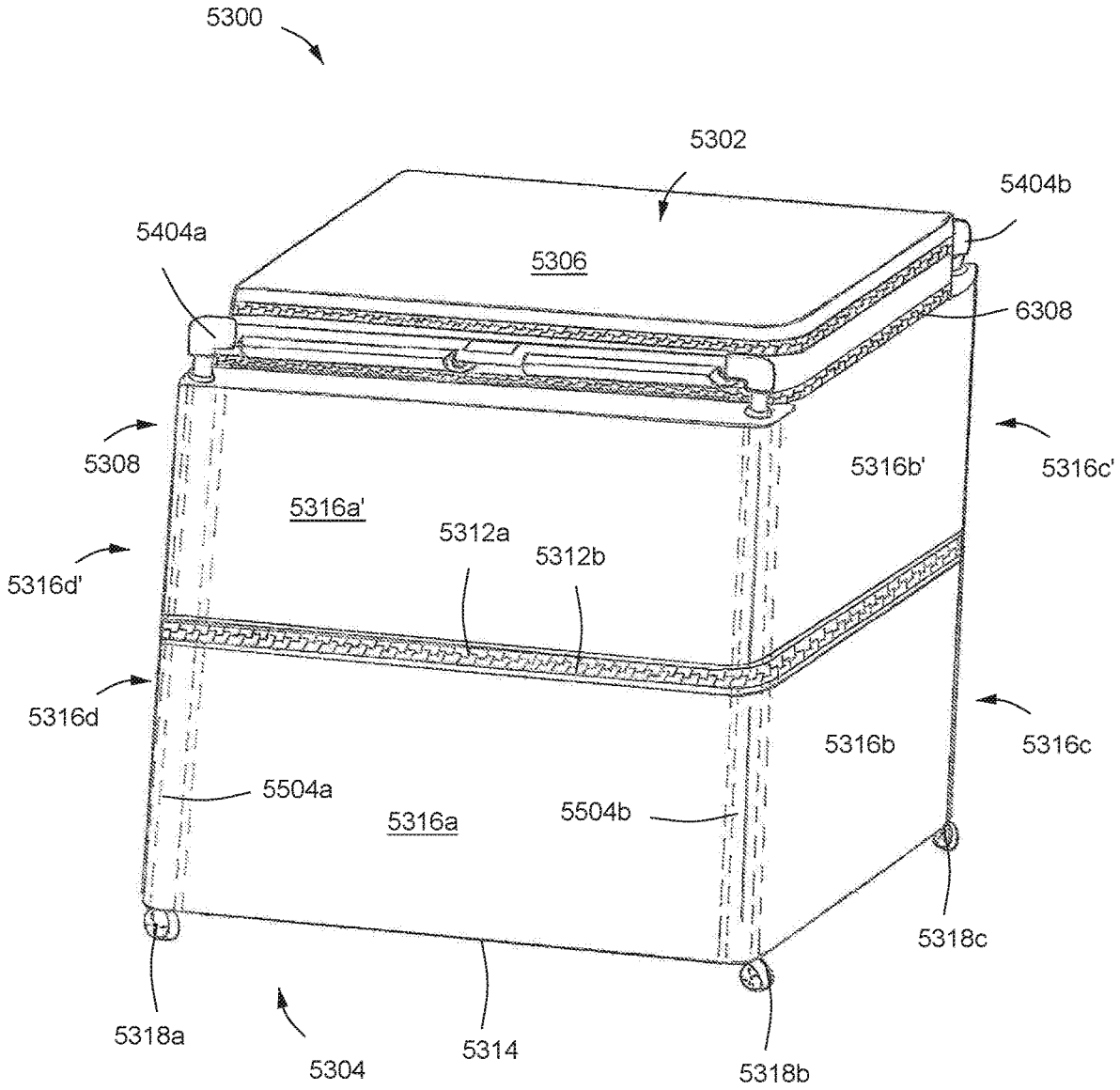
FIG. 53A illustrates a perspective view of a luggage assembly in a travel configuration.

FIG. 53A illustrates a perspective view of a luggage assembly 5300 in a travel configuration. The luggage assembly 5300 may include an upper shell 5302, a lower shell 5304, handles 5404*a*, 5404*b*, and shelves (not shown). The upper shell 5302 and lower shell 5304 may be removably coupled to form an enclosure. Shelves and travel-ware, e.g., clothing, make-up, and personal accessories, may be stored in the enclosure.

The upper shell 5302 may include an upper portion 5306 and a lower portion 5308. The upper portion 5306 may be removably coupled to the lower portion 5308, e.g., via a zipper assembly 6308.

The lower portion 5308 may have four sidewalls 5316*a*'-*d*'. The four sidewalls 5316*a*'-*d*' may be unitary. Preferably, each sidewall 5316 is perpendicular, e.g., orthogonal or tangential, to a plane of the upper portion 5306. Thus, upper portion 5306 and the sidewalls 5316*a*'-*d*' may form a cube or a rectangular prism.

A first zipper tape 5312*a* may be coupled to the lower portion 5308 of the upper shell 5302. The first zipper tape 5312*a* may be coupled to edges of the sidewalls 5316*a*'-*d*' of the lower portion 5308.

The first zipper tape 5312*a* may be coupled to a second zipper tape 5312*b*. The zipper tape 5312*b* may be coupled to the lower shell 5304. In addition, the second zipper tape 5312*b* may be coupled to edges of sidewalls 5316*a*-*d* of the lower shell 5304.

The lower shell 5304 may include a base 5314 and four sidewalls 5316*a*-*d*. The base 5314 and the four sidewalls 5316*a*-*d* may be unitary. The sidewalls 5316*a*-*d* may extend from the base 5314. Preferably, each sidewall 5316 is perpendicular, e.g., orthogonal or tangential, to a plane of the base 5314. Thus, the base 5314 and the sidewalls 5316*a*-*d* may form a cube or a rectangular prism. Furthermore, the base 5314 and the sidewalls 5316*a-d* may each have an inner surface and an outer surface.

Additionally, each handle 5404 may include telescopic shafts 5504*a*, 5504*b* having one or more portions disposed between the sidewalls 5316*a-d* (shown with dash lines). Each telescopic shaft 5504 may have an end coupled to a base 5314 of the lower shell 5304. Moreover, each telescopic shaft 5504 may have an end coupled to an inner surface of the base 5314.

The luggage assembly 5300 may also include four wheels 5318*a-d*. The wheel 5318*a-d* may be coupled to an outer surface of the base 5314 of the lower shell 5304. Preferably, each wheel 5318 may be coupled to a corner of the base 5314.

Figure 53B:
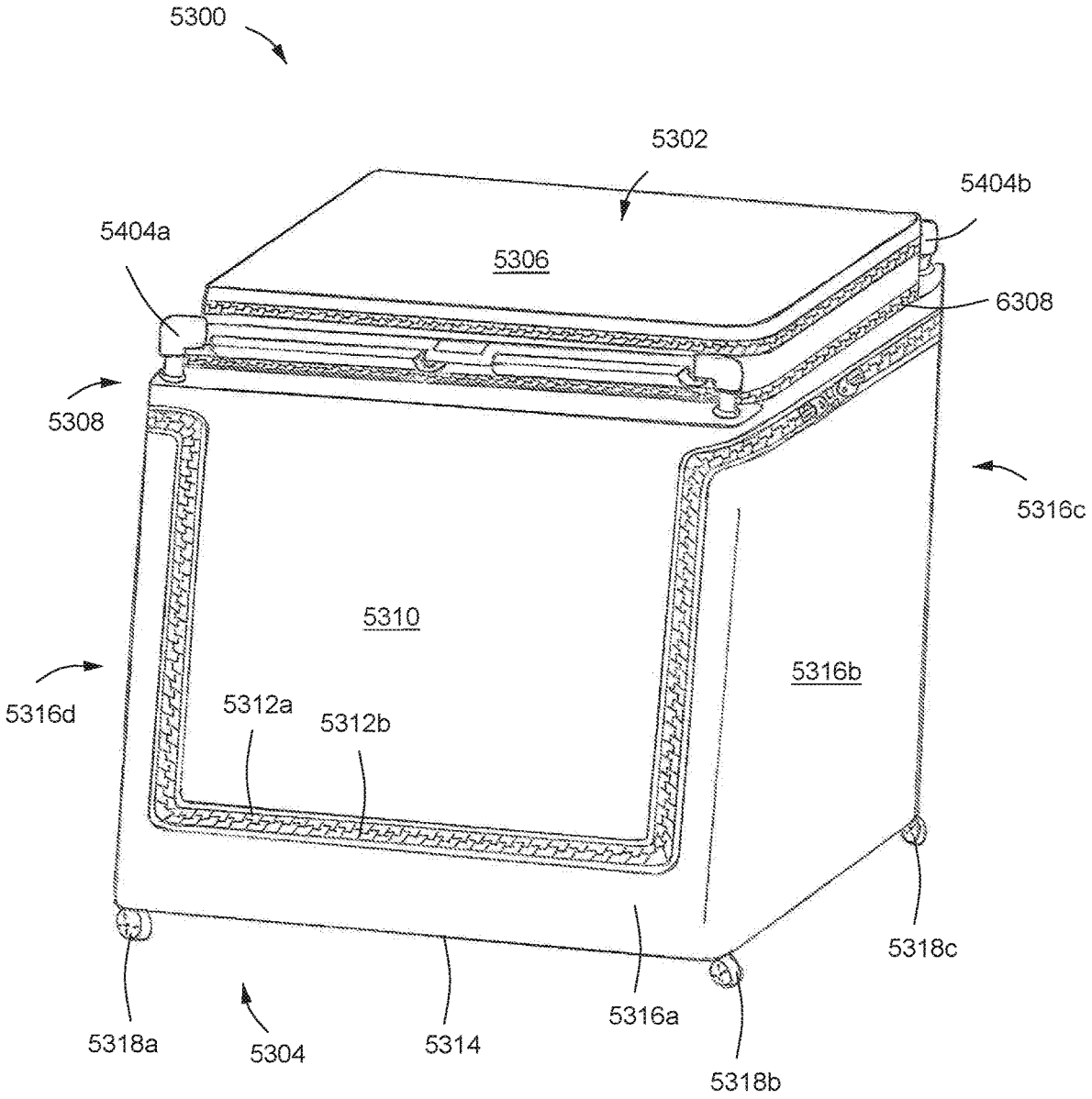
FIG. 53B illustrates a perspective view of a luggage assembly having a flap in a travel configuration.

FIG. 53B illustrates a perspective view of a luggage assembly 5300 having a flap 5310 in a travel configuration. The luggage assembly 5300 may include an upper shell 5302, a lower shell 5304, handles 5404*a*, 5404*b*, and shelves (not shown). The upper portion 5306 may be removably coupled to the lower portion 5308, e.g., via a zipper assembly 6308.

The upper shell 5302 may include an upper portion 5306, a lower portion 5308, and a flap 5310. The flap 5310 may extend from the lower portion 5308. The lower portion 5308, including the flap 5310, may be removably coupled to the lower shell 5304 via a zipper assembly 6308. The zipper assembly 6308 may include a first zipper tape 5312*a* coupled to the lower portion 5308 and the flap 5310. Moreover, the first zipper tape 5312*a* may be coupled to edges of the lower portion 5308 and the flap 5310. The first zipper tape 5312*a* may be coupled to a second zipper tape 5312*b*. The zipper tape 5312*b* may be coupled to the lower shell 5304. In addition, the second zipper tape 5312*b* may be coupled to edges of the lower shell 5304. Thus, the zipper assembly 6308 may have the shape of a block-letter "U."

The lower shell 5304 may include a base 5314 and four sidewalls 5316*a-d*. The base 5314 and the four sidewalls 5316*a-d* may be unitary. Each sidewall 5316 may extend from the base 5314. Preferably, each sidewall 5316 is perpendicular, e.g., orthogonal or tangential, to a plane of the base 5314. Thus, the base 5314 and the sidewalls 5316*a-d* may form a cube or a rectangular prism. Furthermore, the base 5314 and the sidewalls 5316*a-d* may each have an inner surface and an outer surface.

The sidewall 5316*a* may have an opening to receive the flap 5310. The zipper tape 5312*a* (coupled to edges of the flap 5310) may be removably coupled to the zipper tape 5312*b* (coupled to edges of the sidewall 5316*a*). When coupled to the sidewall 5316*a*, the flap 5310 would form a larger planar surface.

The luggage assembly 5300 may also include four wheels 5318*a-d*. The wheel 5318*a-d* may be coupled to an outer surface of the base 5314 of the lower shell 5304. Preferably, each wheel 5318 may be coupled to a corner of the base 5314. In some versions, wheels 5318 may be coupled to the outer surface of the base 5314 in varying configurations, e.g., centered on each side of the base 5314, circular, pentagonal, hexagonal, octagonal.

Figure 54:
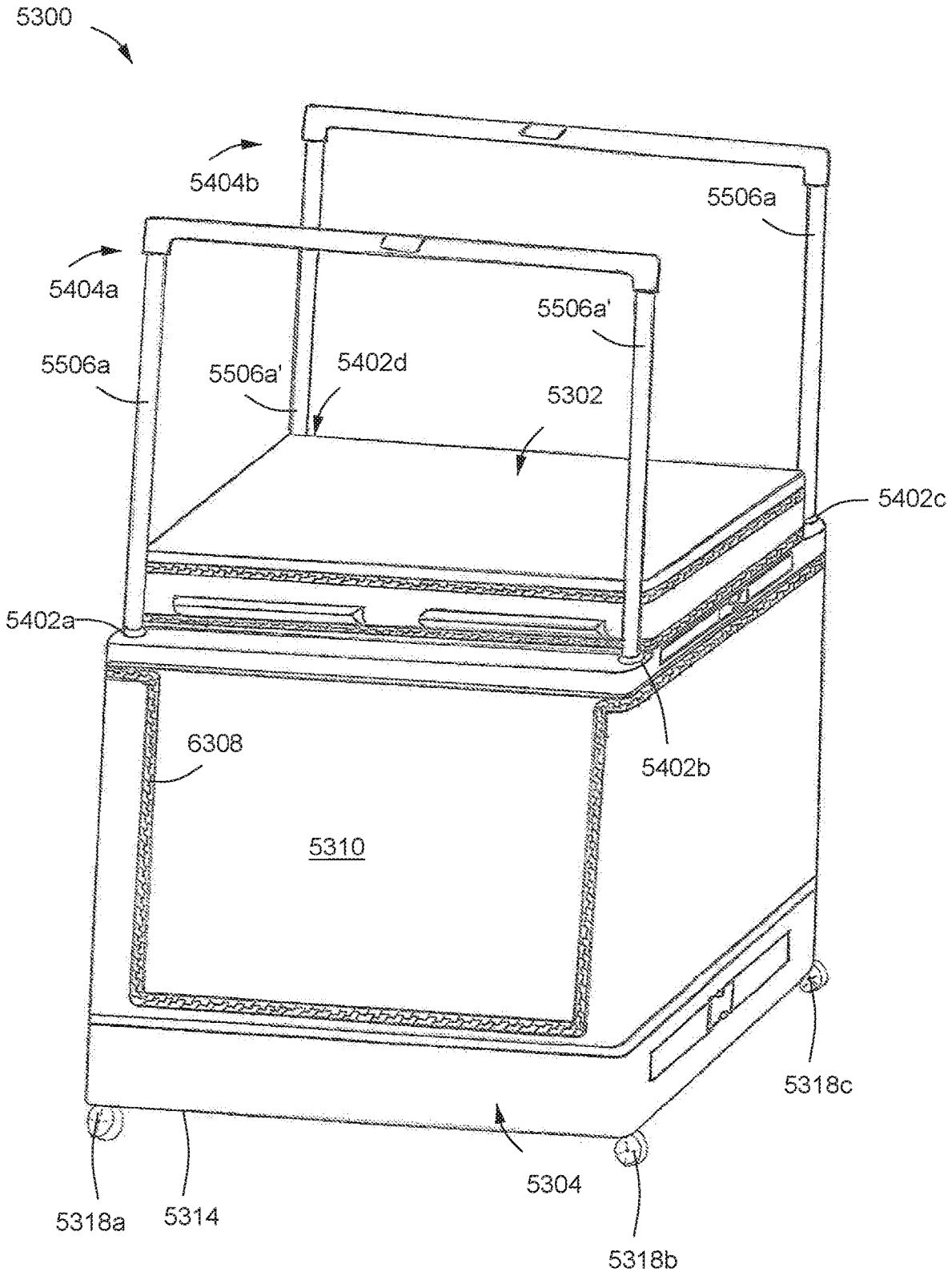
FIG. 54 illustrates a perspective view of a luggage assembly having handles in extended positions.

FIG. 54 illustrates a perspective view of a luggage assembly 5300 having handles 5404*a*, 5404*b* in extended positions. The luggage assembly 5300 may include an upper shell 5302 and a lower shell 5304. The upper shell 5302 may be removably coupled to the lower shell 5304, e.g., via a zipper assembly 6308.

The upper shell 5302 may have four apertures 5402*a-d* disposed therethrough. Each aperture 5402 may receive a tube 5506 of a handle 5404. For example, the apertures 5402*a*, 5402*b* may respectively receive a tube 5506*a*, 5506*a*' of a handle 5404*a*. The apertures 5402*c*, 5402*d* may respectively receive a tubes 5506*a*, 5506*a*' of a handle 5404*b*.

Accordingly, the tubes 5506*a*, 5506*a*' of each of the handles 5404*a*, 5404*b* may be slid through a lower portion 5308 of the upper shell 5302. In addition, each tube 5506 may extend through the lower portion 5308.

Figure 55:
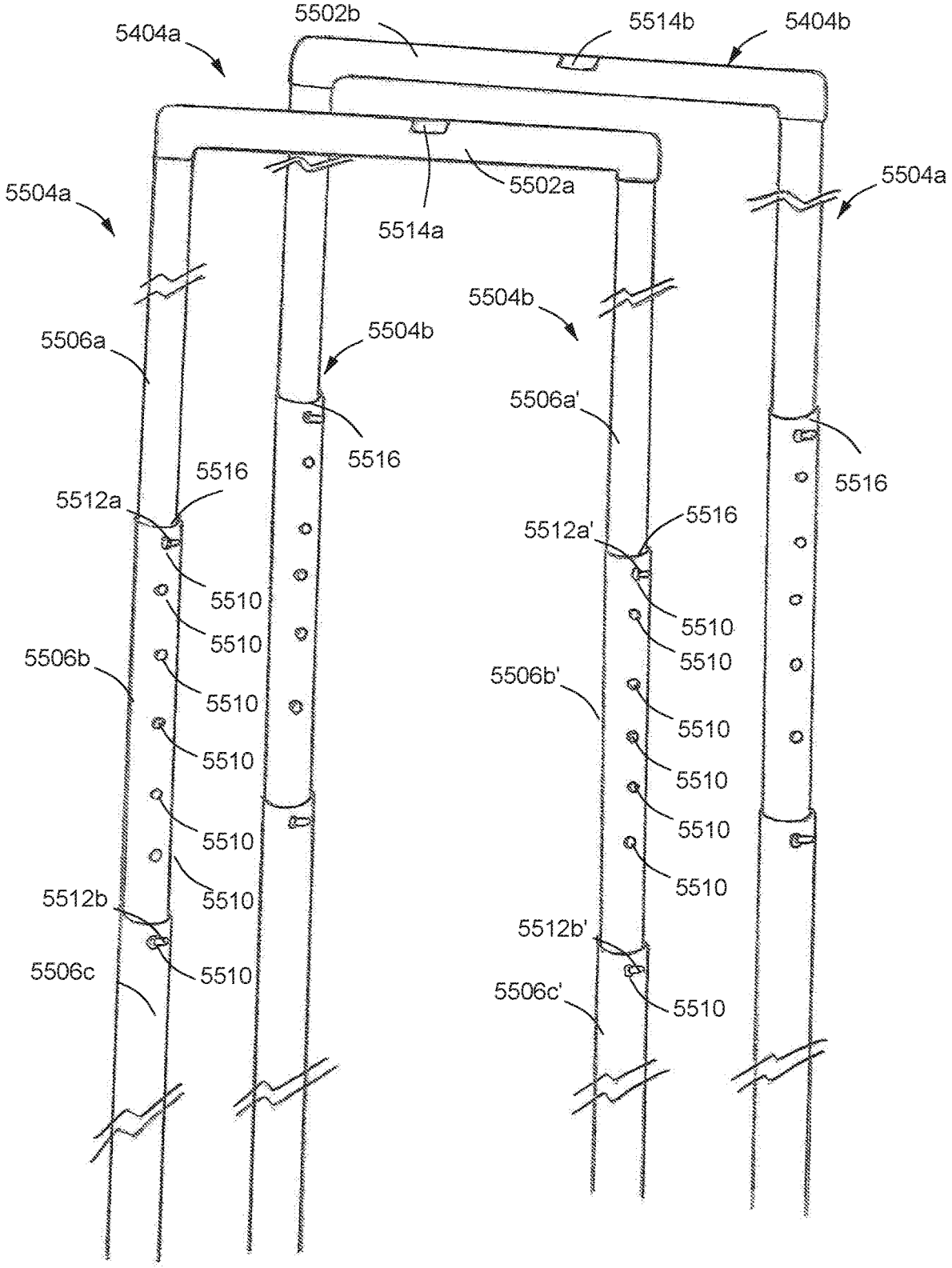
FIG. 55 illustrates a perspective view of two luggage handles in extended positions.

FIG. 55 illustrates a perspective view of two luggage handles 5404*a*, 5404*b* in extended positions. Each handle 5404 may include a crossbar 5502, a first telescopic shaft 5504*a*, and second telescopic shaft 5504*b*. The telescopic shafts 5504*a*, 5504*b* may each be coupled to an end of the crossbar 5502. When coupled, the telescopic shafts 5504*a*, 5504*b* and the crossbar 5502 would form a block-letter "U."

Each telescopic shaft 5504 may include a set of concentric tubes 5506. The telescopic shaft 5504*a* may have tubes 5506*a-c*. The tubes 5506*a-c* may be slidably coupled to one another. Also, the telescopic shaft 5504*b* may have tubes 5506*a*'-*c*'. The tubes 5506*a*'-*c*' may also be slidably coupled to one another.

Regarding each telescopic shaft 5504, an upper tube 5506 may have a smaller diameter than that of a lower tube 5506. For example, the tubes 5506*a*, 5506*a*' may have diameters smaller than those of the tubes 5506*b-c*, 5506*b*'-*c*', respectively. In addition, the tubes 5506*b*, 5506*b*' may have diameters smaller than those of the tubes 5506*c*, 5506*c*', respectively.

Accordingly, the smaller tubes 5506*a*, 5506*a*' may have a portion disposed within the larger corresponding tubes 5506*b*, 5506*b*'. Also, the tubes 5506*b*, 5506*b*' may have a portion disposed within the corresponding tubes 5506*c*, 5506*c*', respectively.

For each pair of adjacent tubes, an upper tube 5506 may have a lock 5512 extending through an aperture 5510 of a lower tube 5506. For example, the upper tube 5506*a* may have a lock 5512*a* extending through an aperture 5510*b* disposed in the lower tube 5506*b*. A spring or coil (not shown) may push against the lock 5512*a*. Accordingly, the spring or coil may cause the lock 5512*a* to remain extended through the aperture 5510*b*. Additional apertures 5510 may be disposed through the lower tube 5506*b*. Accordingly, those apertures 5510 may each receive the lock 5512*a*. Pairs of adjacent tubes 5506*b-c*, 5506*a*'-*b*', 5506*b*'-*c*' may each have similar components and configuration as discussed above.

Thus, as shown in FIG. 55, the handles 5404*a*, 5404*b* may each have locks 5512*a-b*, 5512*a*'-*b*'. On each handle 5404, the locks 5512*a-b*, 5512*a*'-*b*' may be actuated by a button 5514. The button 5514 may be coupled, directly or indirectly, to an actuation device (not shown). The actuation device may be coupled, directly or indirectly, to the locks 5512*a-b*, 5512*a*'-*b*'. The actuation device may be of any kind used in telescopic luggage handles. Furthermore, the actuation device may be disposed in tubes 5506 of the handle 5404.

When pressed, the button 5514 would cause the actuation device to disengage a lock 5512 from a tube 5506 through which the lock 5512 extends. The disengaged lock 5512 may be pushed inward towards the central axis of the tube 5506. A crossbar 5502 of the handle 5404 may be pushed downward to cause an upper tube 5506 to be slid down into a lower tube 5506. Conversely, the crossbar 5502 may be pulled upward to cause an upper tube 5506 to be slid out of a lower tube 5506. In either case, a portion of the upper tube 5506 may be slid past the disengaged lock 5512.

Figure 56:
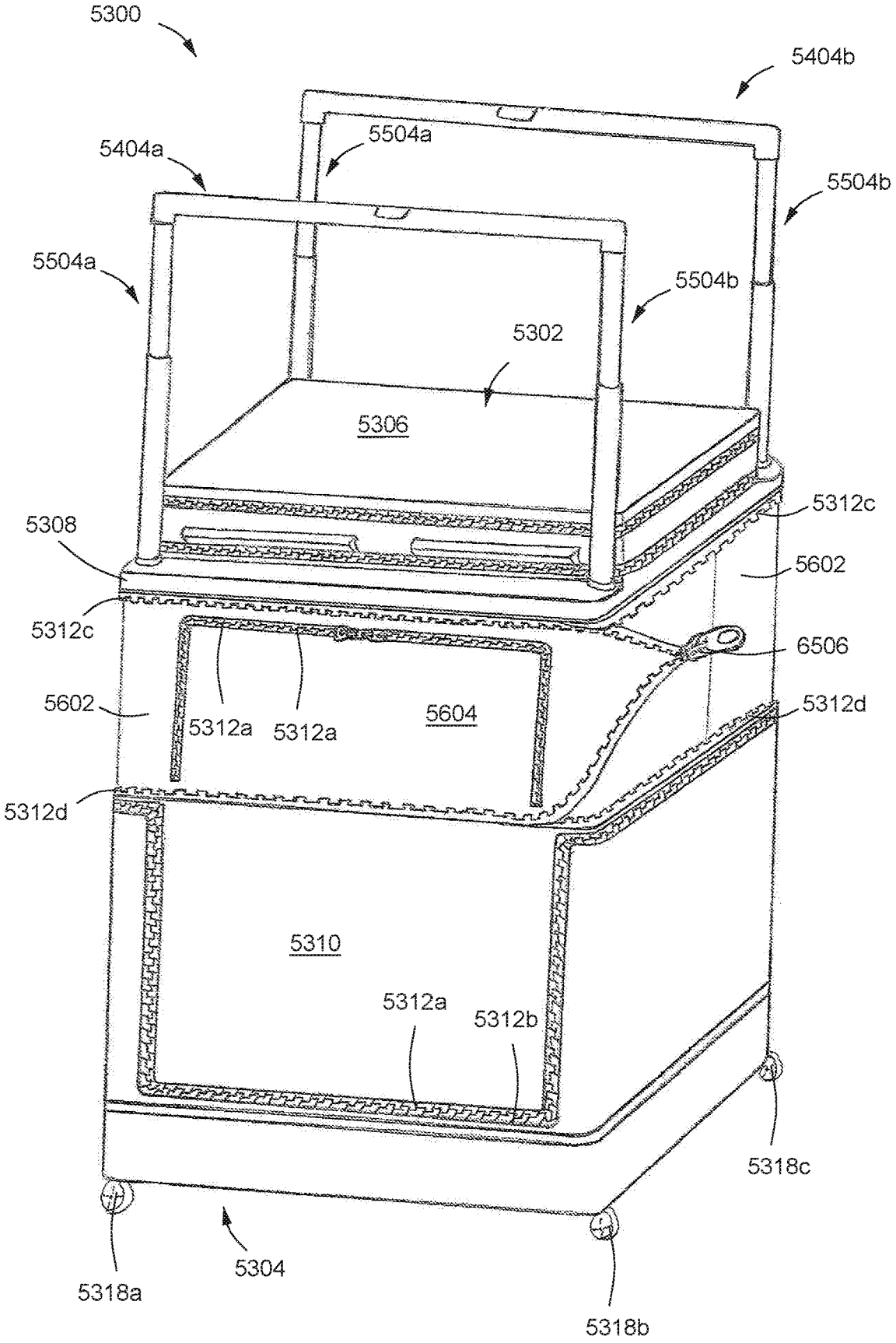
FIG. 56 illustrates a perspective view of a luggage assembly having an upper shell in an expanded configuration.

FIG. 56 illustrates a perspective view of a luggage assembly 5300 having an upper shell 5302 in an expanded configuration. The luggage assembly 5300 may include an upper shell 5302, a lower shell 5304, and handles 5404*a*, 5404*b*. The upper shell 5302 may include an upper portion 5306, a lower portion 5308, an expansion curtain 5602, and a flap 5310. Preferably, one or more edges of a lower portion of the flap 5310 are removably coupled to one or more edges of the lower shell 5304, e.g., via a zipper assembly 6308.

In addition, the flap 5310 may extend from the expansion curtain 5602. An upper portion of the flap 5310 may be disposed below the expansion curtain 5602. A lower edge of the lower portion 5308 of the upper shell 5302 may be coupled to the expansion curtain 5602, e.g., via sutures. The expansion curtain 5602 may extend circumferentially relative to the lower portion 5308. Thus, the expansion curtain 5602 may form a rectangular prism.

The expansion curtain 5602 may include a flap 5604. The flap 5604 may have edges that form a block-letter "U." A first zipper tape 5312*a* may be coupled to the edges of the flap 5604. The first zipper tape 5312*a* may be removably coupled to a second zipper tape 5312*b*. The second zipper tape 5312*b* may be coupled to the expansion curtain 5602. When the first zipper tape 5312*a* is uncoupled from the second zipper tape 5312*b*, the expansion curtain 5602 would have an opening. The opening may provide access into the inside of the luggage assembly 5300.

Also, the expansion curtain 5602 may have a first zipper tape 5312*c* and second zipper tape 5312*d*. The zipper tapes 5312*c*, 5312*d* may have portions extending parallel to the surface of the expansion curtain 5602. Preferably, the zipper tapes 5312*c*, 5312*d* may extend parallel to each other. Each zipper tape 5312 may form rings around the expansion curtain 5602.

The first zipper tape 5312*c* and the second zipper tape 5312*d* may have ends that are coupled, e.g., via a clip or staple.

In the expanded configuration, a portion of the first zipper tape 5312*c*, in some cases, may not be coupled to a portion of the second tape 5312*d*. Additionally, the slider 6506 may be abutted against the ends of the zipper tapes 5312*c*, 5312*d*, e.g., box and pin, stop, or staple. Accordingly, the lower portion 5308 of the upper shell 5302 may be extended away from the ground. Moreover, the lower portion 5308 may be extended away from the lower shell 5304, up to a height of the expansion curtain 5602. Thus, more volume may be created inside the luggage assembly 5300.

Furthermore, the handles 5404*a*, 5404*b* may each have telescopic shafts 5504*a*, 5504*b* extended. The telescopic shafts 5504 may have four tubes 5506*b*-*c*, 5506*b*'-*c*' (see FIG. 60) disposed between the upper shell 5302 and the lower shell 5304. The tubes 5506*b*-*c*, 5506*b*'-*c*' may be extended. Furthermore, the tubes 5506*b*, 5506*c* and the tubes 5506*b*', 5506*c*', in some cases, may be inhibited from being slid respectively towards each other, e.g., via lock pins. Moreover, the tubes 5506*b*, 5506*b*' may each have an upper radial face (see 5516, FIG. 55) abutted against an inner surface (not shown) of the upper shell 5302. Thus, the expansion curtain 5602 may be kept expanded.

Figure 63A:
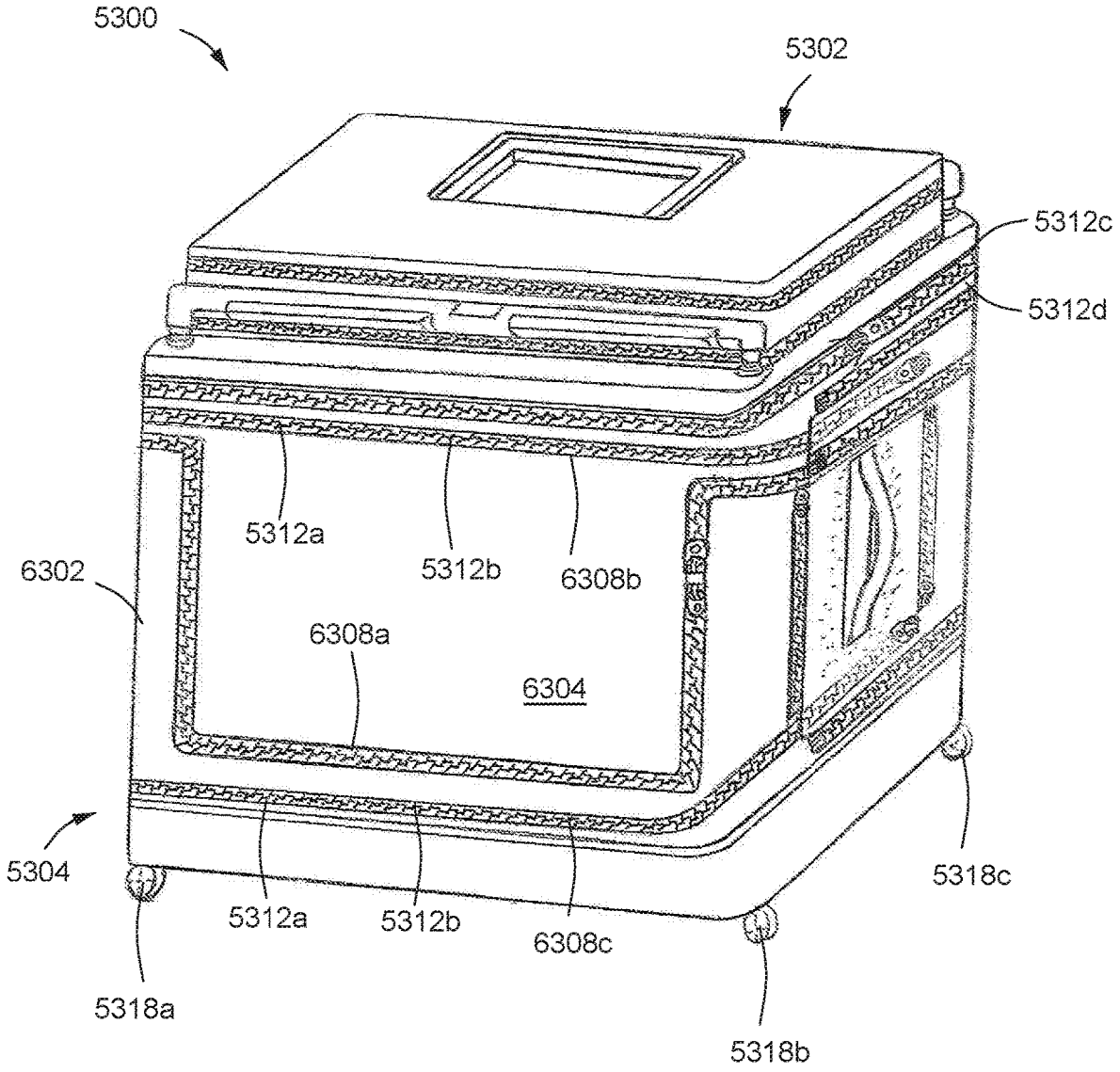
FIG. 63A illustrates a perspective view of a luggage assembly in a collapsed configuration having a middle shell.

Conversely, in the collapsed configuration, the lower portion 5308 of the upper shell 5302 may be dispose adjacent the lower shell 5304 (see FIG. 63A). For example, a traveler collapse the expansion curtain 5602 by pulling the slider 6506 away, e.g., to the left, from the ends of the zipper tapes 5312*c*, 5312*d*. Teeth of the zipper tapes 5312*c*, 5312*d* would be coupled, e.g., mesh. Moreover, an upper edge and a lower edge of the expansion curtain 5602 would be drawn towards each other. Accordingly, one or more portions between the upper edge and the lower edge of the expansion curtain 5602 would be crumpled.

Figure 57:
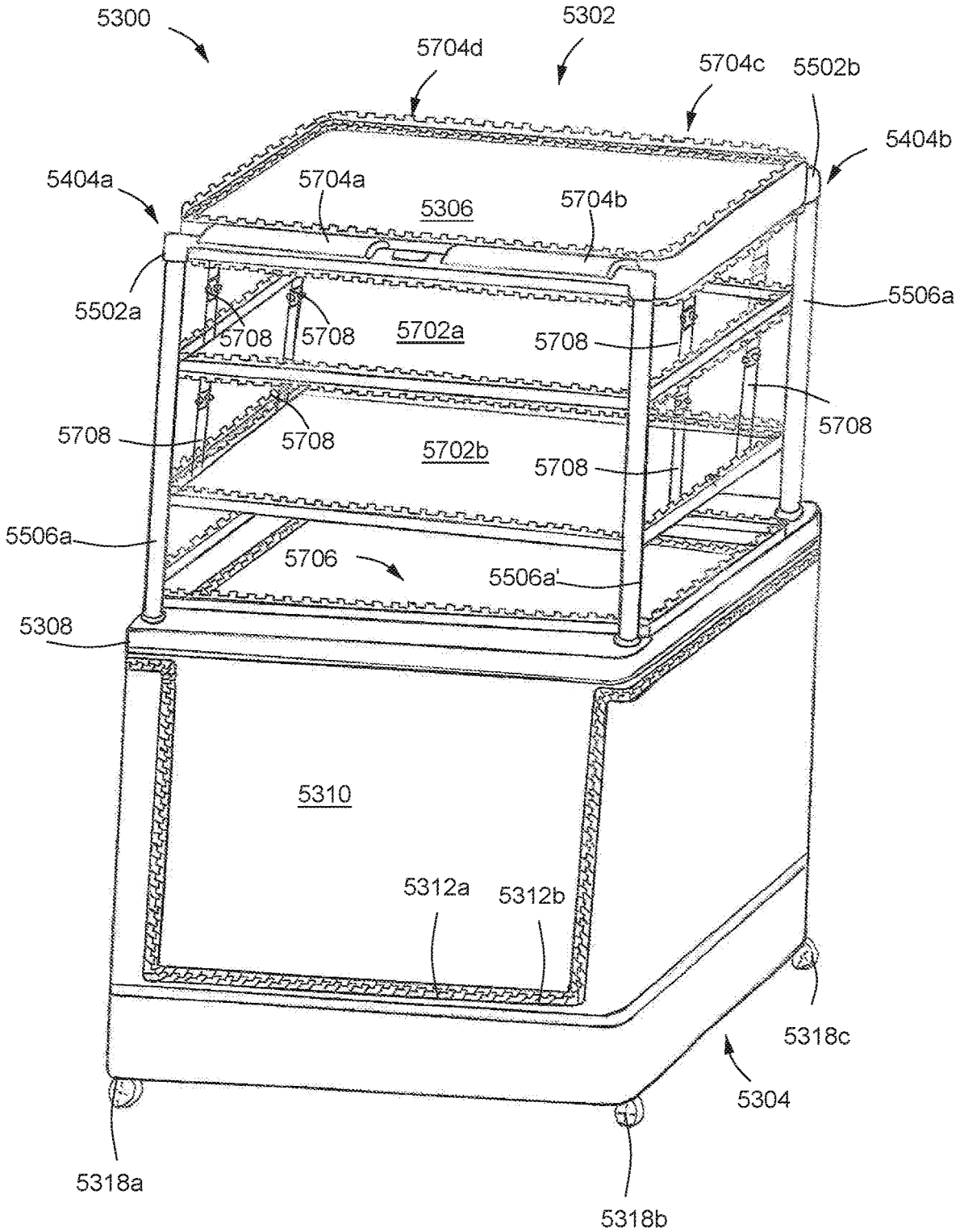
FIG. 57 illustrates a perspective view of a luggage assembly in a first level shelving configuration.

FIG. 57 illustrates a perspective view of a luggage assembly 5300 in a first level shelving configuration. The luggage assembly 5300 may include an upper shell 5302, a lower shell 5304, two handles 5404*a*, 5404*b*, and shelves 5702*a*, 5702*b*. Each handle 5404 may be in an extended configuration.

The upper shell 5302 may include an upper portion 5306, a lower portion 5308, and brackets 5704*a*-*d*. Preferably, the brackets 5704*a*, 5704*b* may extend from a first side of the upper portion 5306. Also, the brackets 5704*c*, 5704*d* may extend from a second side opposite the first side.

The upper portion 5306 may be uncoupled from the lower portion 5308. The lower portion 5308 would have an opening 5706 when uncoupled from the upper portion 5306. One or more shelves 5702 may be capable of ingress/egress through the opening 5706.

The brackets 5704*a*, 5704*b* may be coupled to a crossbar 5502*a* of the handle 5404*a*. The brackets 5704*c*, 5704*d* may be coupled to a crossbar 5502*b* of the handle 5404*b*. Thus, the upper portion 5306 may be set on the handles 5404*a*, 5404*b*.

As shown in FIG. 57, the brackets 5704*a*, 5704*b* curve downward (compared to the upward-curving brackets in FIG. 53). Although not shown, the brackets 5704*c*, 5704*d* would curve downward as well. The brackets 5704*a*-*d* may curve downward because the upper portion 5306 of the upper shell 5302 may be flipped upside-down. Thus, the inner surface of the upper portion 5306 may be flipped to face upward, e.g., away from the lower portion 5308.

A first shelf 5702*a* may be coupled to an inner surface of the upper portion 5306 of the upper shell 5302. Straps 5708 may be coupled to the upper portion 5306 and the shelf 5702*a*. The straps 5708 may be coupled to an outer surface of the upper portion 5306 flipped face-down. The straps 5708 may hang from the upper portion 5306. Thus, the shelf 5702*a* may be suspended from the upper portion 5306.

In addition, the second shelf 5702*b* may be coupled to, e.g., suspended from, the first shelf 5702*a* via additional straps 5708.

Figure 58:
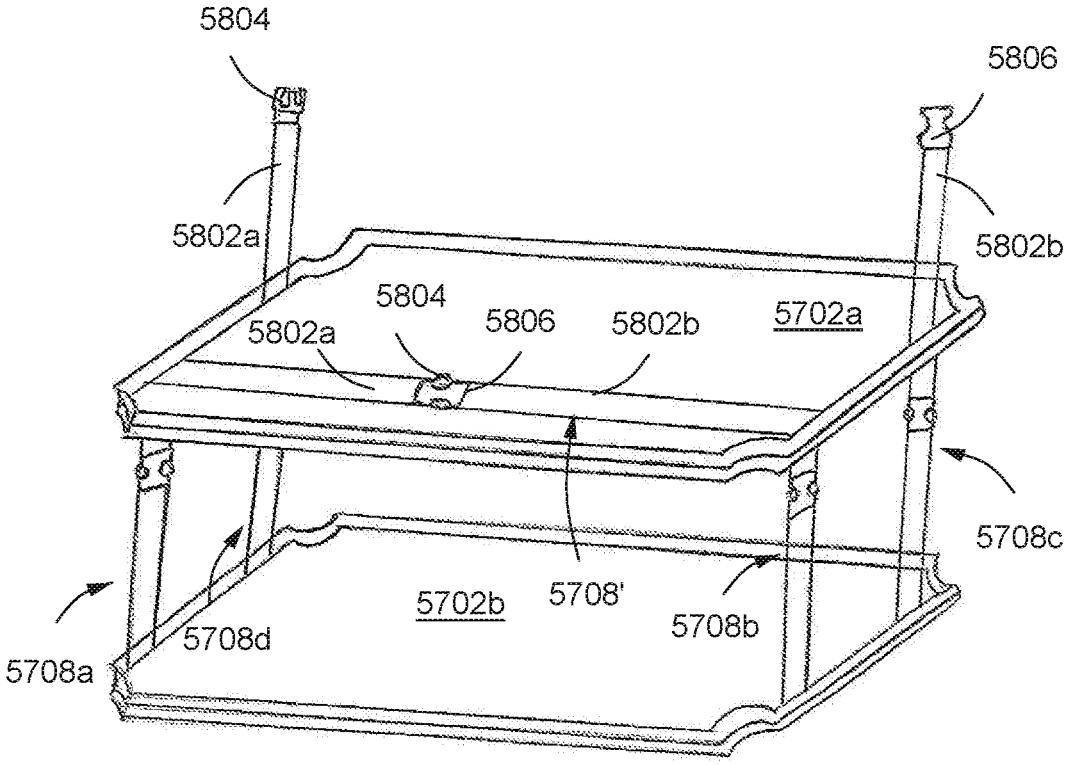
FIG. 58 illustrates a perspective view of shelves.

Referring to FIG. 58, straps 5708*a*-*d* may be coupled to two shelves 5702*a*, 5702*b*. The strap 5708*a*-*d* may be disposed between the two shelves 5702*a*, 5702*b*. The straps 5708*a*-*d* may be perpendicular to the shelves 5702*a*, 5702*b*. An end of each strap 5708 may be coupled to an inner surface of an upper shell 5302.

Each strap 5708 may include a first strap portion 5802*a*, a second strap portion 5802*b*, a clip 5804, and a buckle 5806. The first strap portion 5802*a* may have a portion coupled to the clip 5804. The second strap portion 5802*b* may have a portion coupled to the buckle 5806. The clip 5804 and the buckle 5806 may be removably coupled. The clip 5804 and the buckle 5806 may be part of a Delrin clip buckle. The clip 5804 may be inserted into the buckle 5806.

In addition, each strap portion 5802 may be threadably coupled to a slider (not shown). The slider may be configured to provide adjustment of the length of the strap portion 5802. Thus, the space between the shelves 5702*a*, 5702*b* may be adjusted via sliders.

Strap portions 5802 coupled to a shelf 5702 may be coupled to form a strap 5708'. For example, strap portions 5802*a*, 5802*b* may be coupled to form strap 5708'. Each end of the portions 5802*a*, 5802*b* may be coupled to a side of the shelf 5702*a*. The strap portion 5708' may be position parallel to the shelf 5702*a*.

Figure 59:
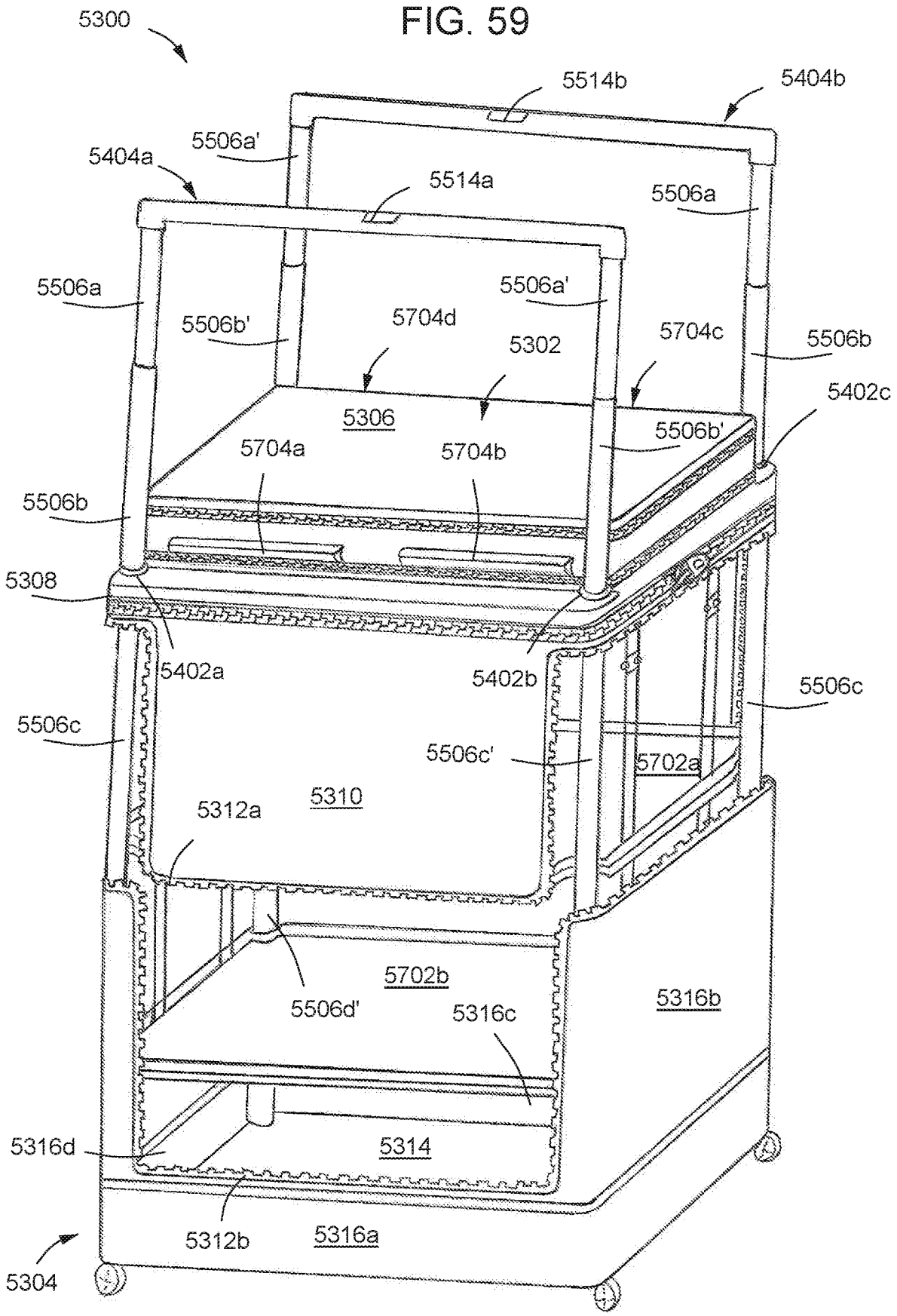
FIG. 59 illustrates a perspective view of a luggage assembly having an upper shell uncoupled from a lower shell.

FIG. 59 illustrates a luggage assembly 5300 having an upper shell 5302 uncoupled from a lower shell 5304. The luggage assembly 5300 may also include two handles 5404*a*, 5404*b* in extended positions.

The upper shell 5302 may include an upper portion 5306, a lower portion 5308, and a flap 5310. The upper portion 5306 may be removably coupled to the lower portion 5308, e.g., via a zipper assembly 6308. The flap 5310 may extend from the lower portion 5308. A first zipper tape 5312*a* may be coupled to the lower portion 5308. The first zipper tape 5312*a* may be coupled to edges of the lower portion 5308. Also, the first zipper tape 5312*a* may be coupled to the flap 5310. Moreover, the first zipper tape 5312*a* may be coupled to edges of the flap 5310. The first zipper tape 5312*a* may be coupled to a second zipper tape 5312*b*. The second zipper tape 5312*b* may be coupled to the lower shell 5304. In addition, the second zipper tape 5312*b* may be coupled to edges and/or sidewalls of the lower shell 5304.

The lower shell 5304 may include a base 5314 and four sidewalls 5316*a-d*. The base 5314 and the four sidewalls 5316*a-d* may be unitary. Each sidewall 5316 may extend from the base 5314. Preferably, each sidewall 5316 is perpendicular, e.g., orthogonal or tangential, to a plane of the base 5314. Thus, the base 5314 and the sidewall sidewalls 5316*a-d* may form a cube or a rectangular prism. Furthermore, the base 5314 and the sidewalls 5316*a-d* may each have an inner surface and an outer surface.

The sidewall 5316*a* may have an opening to receive the flap 5310. The zipper tape 5312*a* (coupled to edges of the flap 5310) may be removably coupled to a zipper tape 5312*b* (coupled to edges of the sidewall 5316*a*).

Each telescopic shaft 5504 of each handle 5404 may have plurality of tubes 5506*a-d*, 5506*a'-d'*. The tubes 5506*a-b*, 5506*a'-b'* may be disposed above the upper shell 5302. The tubes 5506*b*, 5506*b'* may extend through apertures 5402*a*, 5402*b*, respectively.

In addition, the tubes 5506*c-d*, 5506*c'-d'* may be disposed between the upper shell 5302 and the lower shell 5304. Additionally, the tubes 5506*c-d*, 5506*c'-d'* be disposed between the sidewalls 5316*a-d* of the lower shell 5304. The tubes 5506*d*, 5506*d'* may each have a lower end coupled to a base 5314 of the lower shell 5304 (see FIG. 53A). Furthermore, the tubes 5506*c*, 5506*c'* may have an upper radial face (see 5516, FIG. 55). The tubes 5506*c*, 5506*c'* may have diameters larger than diameters of the apertures 5402*a*, 5402*b*. In some cases, those tubes 5506*c*, 5506*c'* may not extend through the upper shell 5302. Accordingly, the tubes 5506*c*, 5506*c'* may be abutted against an inner surface of the upper shell 5302. Thus, in an extended configuration, the telescopic shafts 5504*a*, 5504*b* may support the upper shell 5302. The extended telescopic shafts 5504*a*, 5504*b* may keep the upper shell 5302 and the lower shell 5304 separated.

Figure 60:
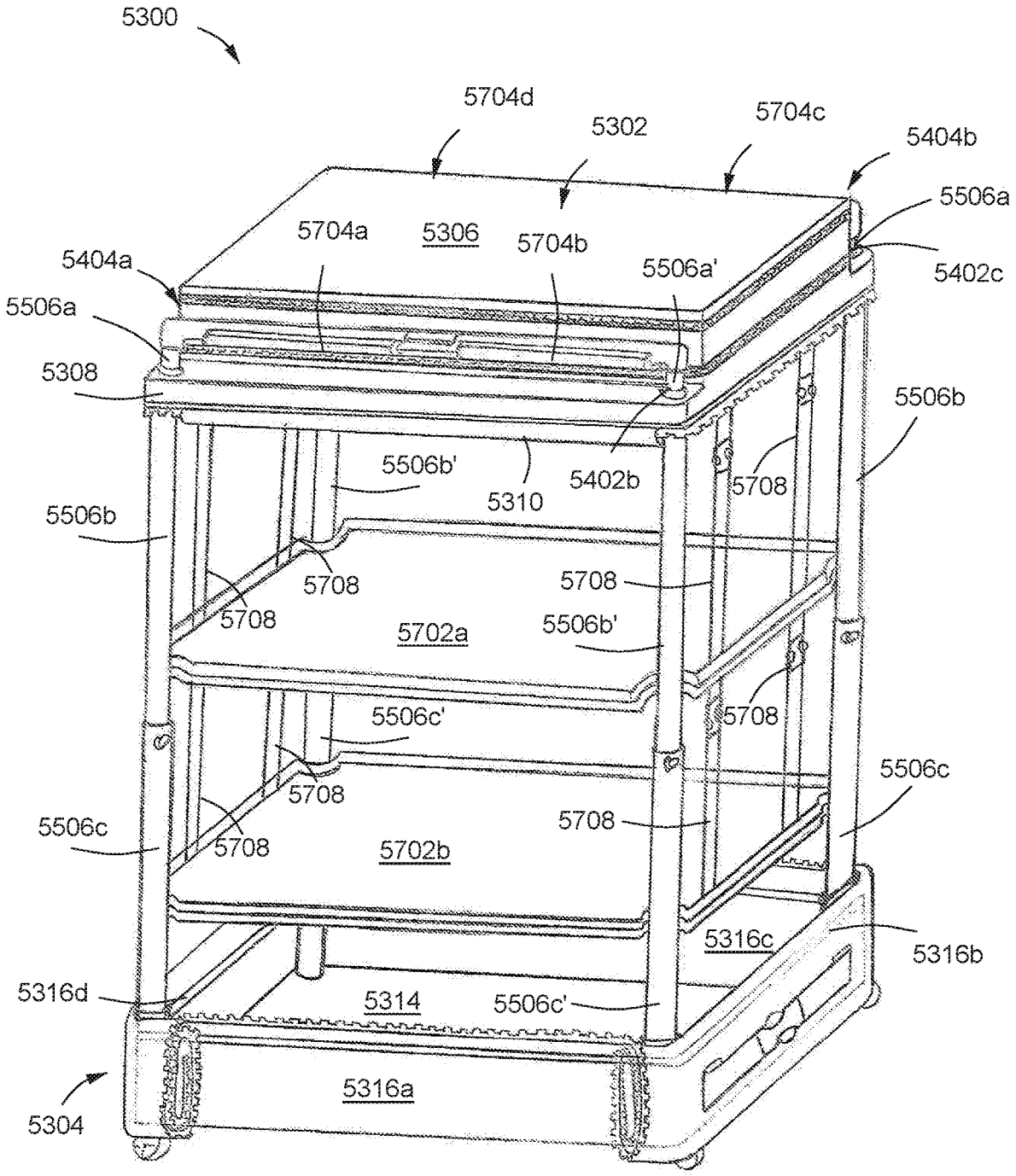
FIG. 60 illustrates a perspective view of a luggage assembly in a second level shelving configuration.

FIG. 60 illustrates a luggage assembly 5300 in a second level shelving configuration. The luggage assembly 5300 may include an upper shell 5302, a lower shell 5304, two handles 5404*a*, 5404*b*, and shelves 5702*a*, 5702*b*. The lower shell 5304 may have portions of sidewalls 5316*b*, 5316*d* folded or rolled away. The upper shell 5302 may have one or more flaps 5310 folded or rolled away.

Each telescopic shaft 5504 of each handle 5404 may have plurality of tubes 5506*a-c*, 5506*a'-c'*. The tubes 5506*a*, 5506*a'* may be slidably coupled to respective tubes 5506*b*, 5506*b'*. Portions of the tubes 5506*a*, 5506*a'* may be disposed in the respective tubes 5506*b*, 5506*b'*. The tubes 5506*b*, 5506*b'* may be slidably coupled to respective tubes 5506*c*, 5506*c'*. Portions of the tubes 5506*b*, 5506*b'* may be disposed in the respective tubes 5506*c*, 5506*c'*.

The tubes 5506*a*, 5506*a'* of each handle 5404 may having portions extending through the upper shell 5302. The tubes 5506*a*, 5506*a'* of each handle 5404 may have portions disposed below the upper shell 5302. The tubes 5506*a*, 5506*a'* of each handle 5404 may have portions disposed above the upper shell 5302. The tubes 5506*a*, 5506*a'* of the handle 5404*a* may extend and/or be collapsed through apertures 5402*a-b*, respectively. The tubes 5506*a*, 5506*a'* of the handle 5404*b* may extend and/or be collapsed through apertures 5402*c-d*, respectively.

In addition, the tubes 5506*b-c*, 5506*b'-c'* may be disposed between the upper shell 5302 and the lower shell 5304. Additionally, the tubes 5506*b-c*, 5506*b'-c'* be disposed between the sidewalls 5316*a-d* of the lower shell 5304. The tubes 5506*c*, 5506*c'* may each have a lower end coupled to a base 5314 of the lower shell 5304 (see FIG. 53A). Furthermore, the tubes 5506*b*, 5506*b'* may have an upper radial face (see 5516, FIG. 55). The tubes 5506*b*, 5506*b'* may have diameters larger than diameters of the apertures 5402*a*, 5402*b*. In some cases, those tubes 5506*b*, 5506*b'* may not extend through the upper shell 5302. Accordingly, the tubes 5506*b*, 5506*b'* may be abutted against an inner surface of the upper shell 5302. Thus, in an extended configuration, the telescopic shafts 5504*a*, 5504*b* may support the upper shell 5302. The extended telescopic shafts 5504*a*, 5504*b* may keep the upper shell 5302 and the lower shell 5304 separated.

A first shelf 5702*a* may be coupled to an inner surface of the upper shell 5302. Straps 5708 may be coupled to a lower portion 5308 of the upper shell 5302 and the shelf 5702*a*. Additionally, the straps 5708 may be coupled to an inner surface of the lower portion 5308. Also, the straps 5708 may hang from the upper shell 5302. Thus, the shelf 5702*a* may be suspended from the lower portion 5308.

In addition, the second shelf 5702*b* may be coupled, e.g., suspended from, the first shelf 5702*a* via additional straps 5708. The shelves 5702*a*, 5702*b* may be coupled as described above in reference to FIG. 58.

Figure 61:
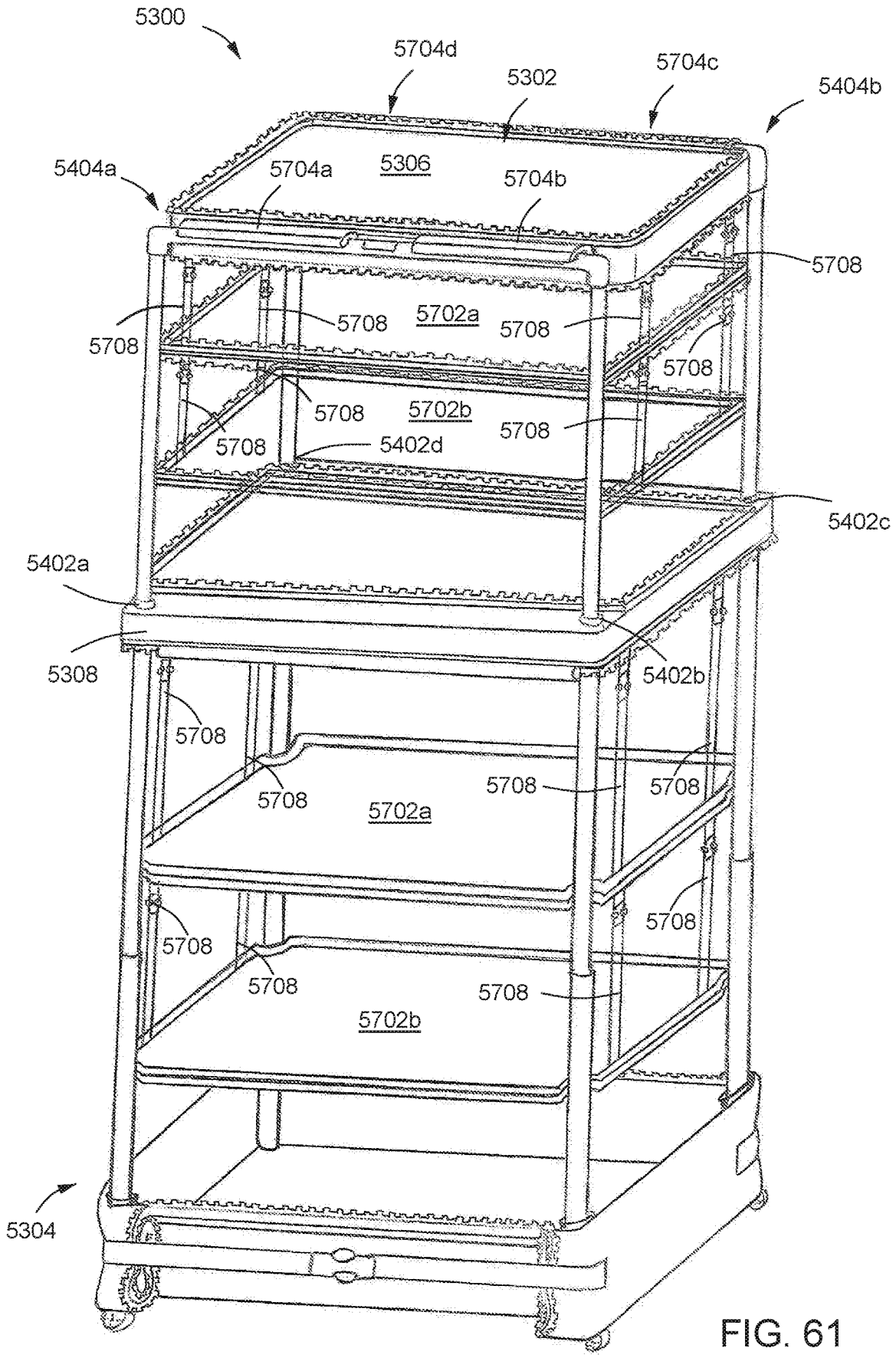
FIG. 61 illustrates a perspective view of a luggage assembly in a first level shelving configuration and a second level shelving configuration.

FIG. 61 illustrates a luggage assembly 5300 in a first level shelving configuration and a second level shelving configuration. The first level shelving configuration has shelves 5702 between an upper portion 5306 and lower portion 5308 of an upper shell 5302. Description of the first level shelving configuration may be referenced in the description above in connection with FIG. 57. The second level shelving configuration has shelves 5702 between the upper shell 5302 and a lower shell 5304. Description of the second level shelving configuration may be referenced in the description above in connection with FIG. 60.

Figure 62A:
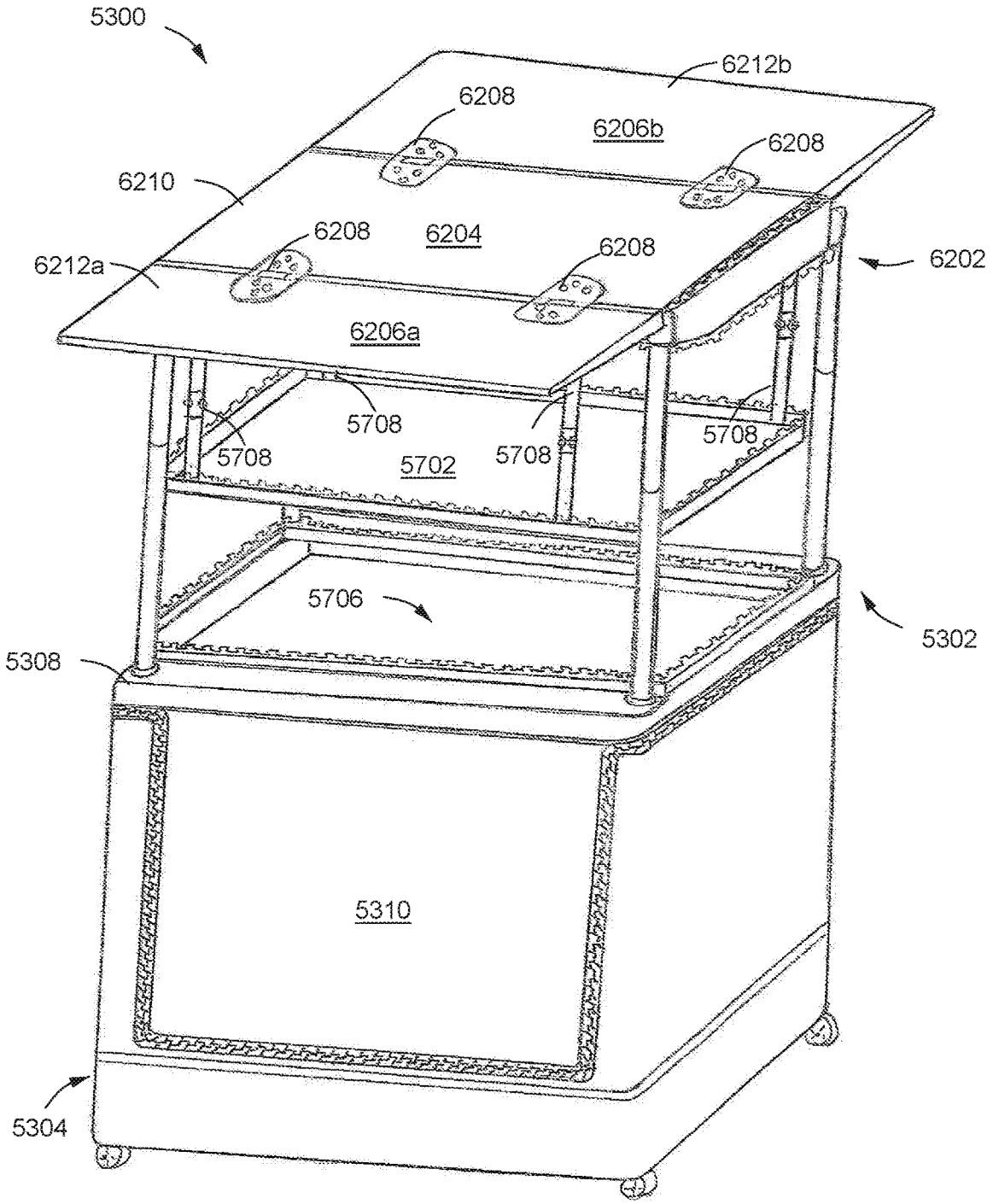
FIG. 62A illustrates a perspective view of a luggage assembly including a tabletop in an expanded configuration.

FIG. 62A illustrates a luggage assembly 5300 including a tabletop 6202 in an expanded configuration. The tabletop 6202 may include a base 6204, two table leaves 6206*a*, 6206*b*, hinges 6208, and straps 5708. Additionally, the tabletop 6202 may be an upper portion of an upper shell 5302 of the luggage assembly 5300. The tabletop 6202 may be capable of being coupled to a lower portion 5308 of the upper shell 5302. The tabletop 6202 may having edges having a first zipper tape coupled thereto. The first zipper tape may be capable of being coupled to a second zipper tape. The second zipper tape may be coupled to a lower portion 5308 of the upper shell 5302.

When coupled to the lower portion 5308, the tabletop 6202 may be flipped such that the table leaves 6206*a*, 6206*b* may be facing towards a lower shell 5304 of the luggage assembly 5300. Accordingly, the table leaves 6206*a*, 6206*b* may be adjacent an opening 5706 of a lower portion 5308 of an upper shell 5302 of the luggage assembly 5300. Alternatively, the table leaves 6206*a*, 6206*b* may be disposed in the opening 5706.

In the expanded configuration, the upper surfaces 6212*a*, 6212*b* of the table leaves 6206*a*, 6206*b* may be coplanar with an upper surface 6210 of the base 6204. The two table leaves 6206*a*, 6206*b* may be coupled to sides of the base 6204. Each table leaf 6206 may have a side disposed adjacent a side of the base 6204. Each table leaf 6206 may have a side parallel to a side of the base 6204. The side of the table leaf 6206 may be pivotably coupled to the side of the base 6204 via hinges 6208. Accordingly, each table leaf 6206 may be folded onto the upper surface 6210 of the base 6204.

Each table leaf 6206 may have a length and a width approximately equal to the length and width of the base 6204. In addition, each table leaf 6206 may have a first side adjacent the hinges 6208 and/or adjacent the base thicker than a second opposite side of the table leaf 6206. Thus, each table leaf 6206 may have a tapered profile extending from the base 6204.

A shelf 5702 may be coupled via straps 5708 to the base 6204. The straps 5708 may be coupled to sides of the base 6204 (not shown). Alternatively, the straps 5708 may be coupled to a lower surface of the base 6204 (not shown).

Figure 62B:
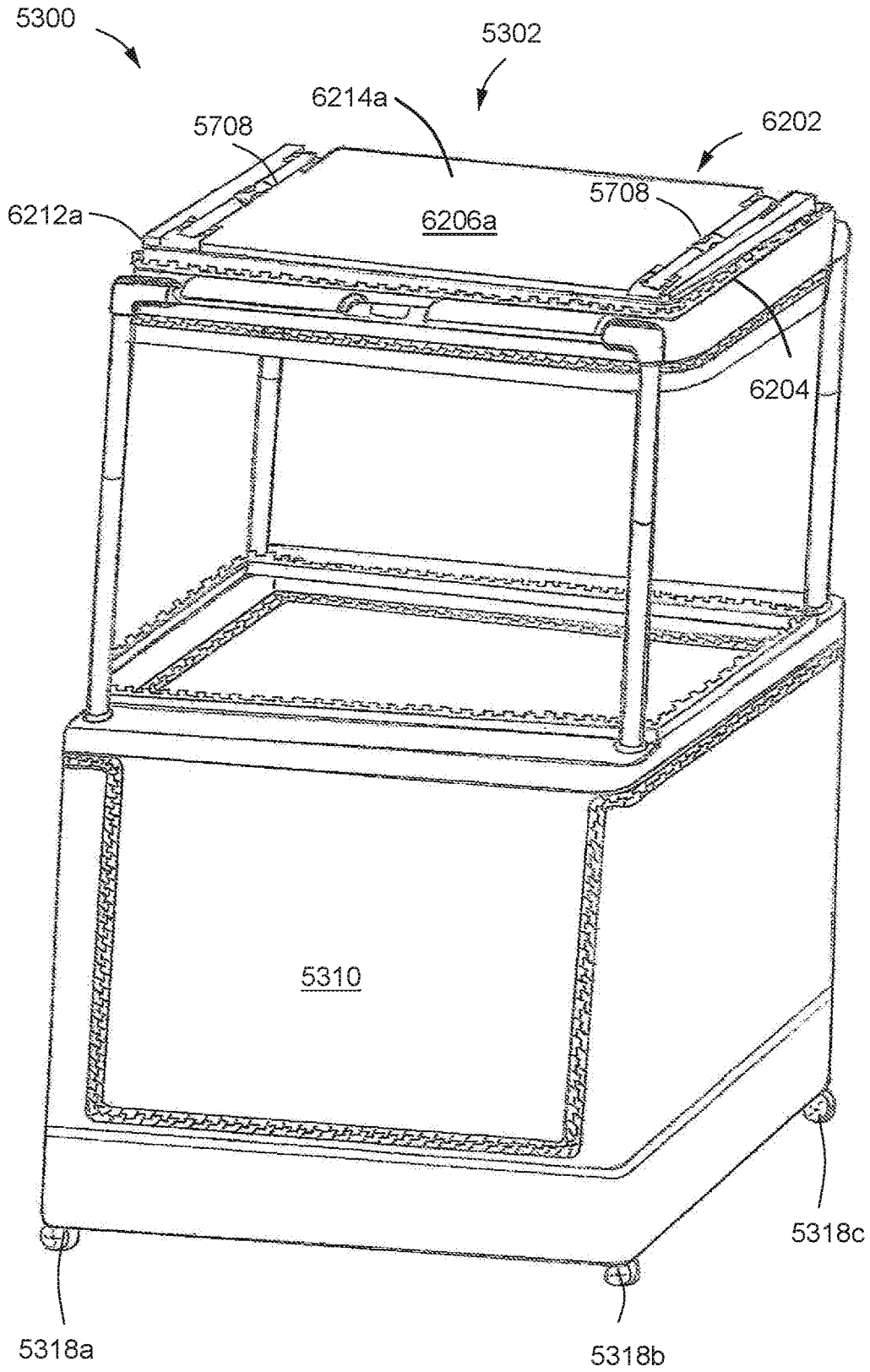
FIG. 62B illustrates a perspective view of a luggage assembly including a tabletop in a collapsed configuration.

FIG. 62B illustrates a luggage assembly 5300 including a tabletop 6202 in a collapsed configuration. The tabletop 6202 may include two table leaves 6206*a*, 6206*b* coupled to sides of a base 6204 of the tabletop 6202, e.g., via hinges (see FIG. 62A). Each table leaf 6206 may have a side disposed adjacent a side of the base 6204. Each table leaf 6206 may have a side parallel to a side of the base 6204. The side of the table leaf 6206 may be pivotably coupled to the side of the base 6204 via hinges 6208 (see FIG. 62A). Accordingly, each table leaf 6206 may be folded over the upper surface of the base 6204.

Additionally, each leaf 6206 may have a length and a width approximately equal to the length and width of the base 6204. Also, each leaf 6206 may have a side adjacent the hinges 6208 and/or the base that is thicker than an opposite side. Thus, each leaf 6206 would have tapered profile when its width is shown in profile.

In a collapsed position, the second table leaf 6206*b* may be folded against the base 6204. The second leaf 6206*b* may have an upper surface 6212*b* adjacent an upper surface 6210 of the base 6204. Moreover, the upper surface 6212*b* of the second table leaf 6206*b* may be parallel to the upper surface 6210 the base 6204. The first table leaf 6206*a* may be folded against the second leaf 6206*b*. The first table leaf 6206*a* may have an upper surface 6212*a* adjacent the lower surface (not shown) of the second table leaf 6206*b*. The lower surface 6214*a* of the first table leaf 6206*a* may be parallel to the lower surface of the second table leaf 6206*b*.

Additionally, the thinner side of the table leaf 6206*a* may be adjacent the thicker edge of the table leaf 6206*b*. Also, the thinner side of the table leaf 6206*b* may be adjacent the thicker side of the table leaf 6206*a*.

Also, the table leaves 6206*a*, 6206*b* may be retained in a collapsed configuration with straps 5708. Each strap 5708 may have a first portion coupled to the table leaf 6206*a* and a second portion coupled to the table leaf 6206*b*.

Furthermore, brackets 5704*a*, 5704*b* may extend from a first side of the base 6204. Also, brackets 5704*c*, 5704*d* may extend from a second side of the base 6204 opposite the first side.

The brackets 5704*a*, 5704*b* may be coupled to a crossbar 5502*a* of the handle 5404*a*. The brackets 5704*c*, 5704*d* may be coupled to a crossbar 5502*b* of the handle 5404*b*. Thus, the base 6204 may be coupled to, e.g., set on, the handles 5404*a*, 5404*b*.

FIG. 63A illustrates a luggage assembly 5300 in a collapsed configuration having a middle shell 6302. The luggage assembly 5300 may include an upper shell 5302, a lower shell 5304, two handles 5404*a*, 5404*b*, the middle shell 6302, two or more wheels 5318, and one or more shelves (not shown). The upper shell 5302, lower shell 5304, and the middle shell 6302 may be coupled to form an enclosure. Shelves and travel-ware, e.g., clothing, make-up, and personal accessories, may be stored in the enclosure.

The upper shell 5302 and the middle shell 6302 may be removably coupled via a zipper assembly 6308*b*. The zipper assembly 6308 may include a first zipper tape 5312*a* and a second zipper tape 5312*b*. The first zipper tape 5312*a* may include teeth, a slider, and a box (not shown). The second zipper tape 5312*b* may include teeth and a pin (not shown). The first zipper tape 5312*a* may be coupled to one or more lower edges of the upper shell 5302. The second zipper tape 5312*b* may be coupled to one or more upper edges of the middle shell 6302.

Additionally, the lower shell 5304 and the middle shell 6302 may be removably coupled via a zipper assembly 6308*c*. The zipper assembly 6308*c* may include a first zipper tape 5312*a* tape and a second zipper tape 5312*b*. The first zipper tape 5312*a* may include teeth, a slider, and a box (not shown). The second zipper tape 5312*b* may include teeth and a pin (not shown). The first zipper tape 5312*a* may be coupled to one or more lower edges of the middle shell 6302. The second zipper tape 5312*b* may be coupled, e.g., sewn or sutured, to one or more upper edges the lower shell 5304.

Also, the middle shell 6302 may have a first portion and a second portion. The first portion may be removably coupled to the second portion via a zipper assembly 6308*a*. The first portion may include a flap 6304. The flap 6304 may have edges that form a block-letter "U." The zipper assembly 6308*a* may be coupled to the edges of the flap 6304.

Figure 63B:
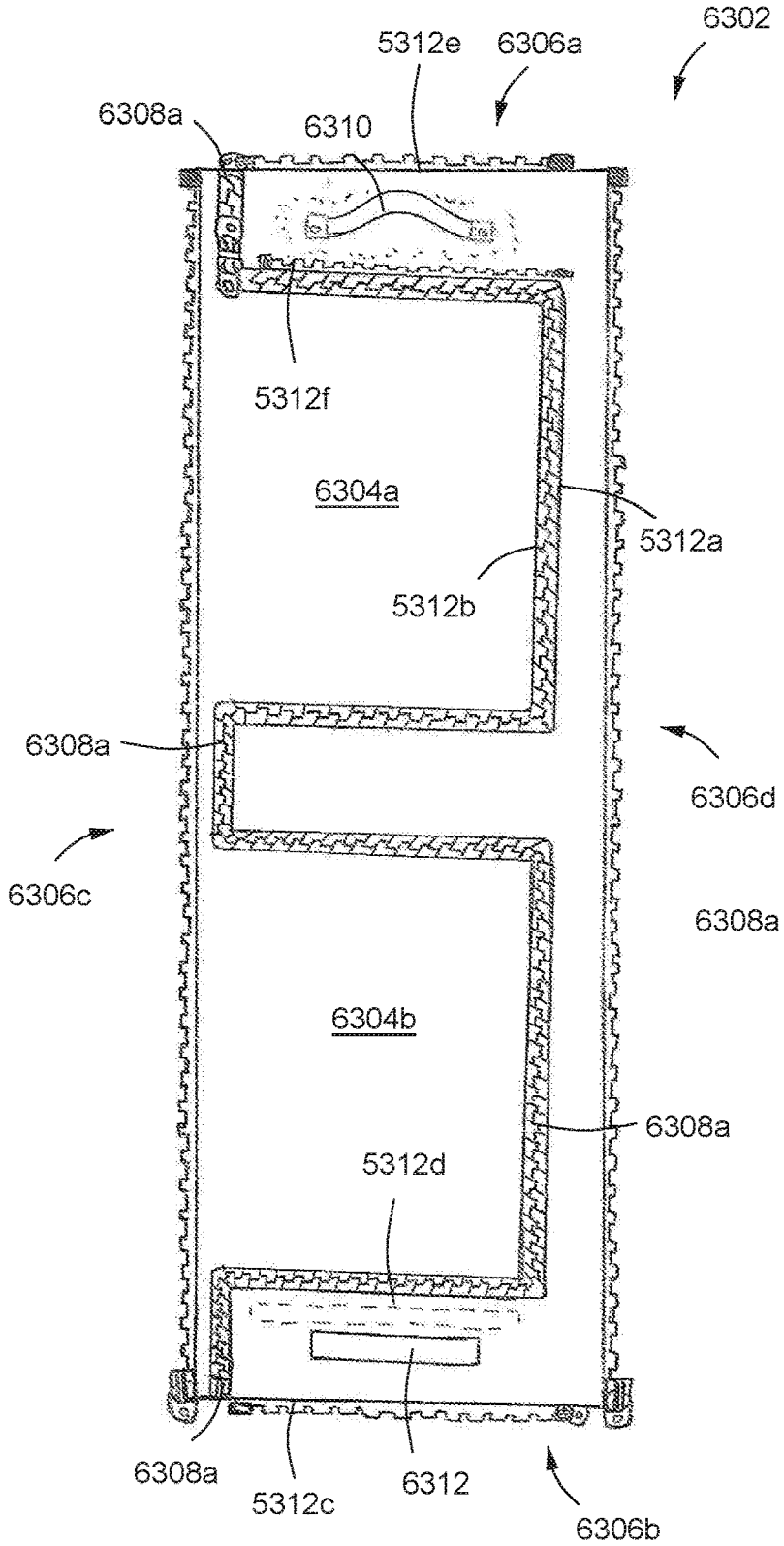
FIG. 63B illustrates a perspective view of a middle shell laid flat with its outer surface visible.

FIG. 63B illustrates a perspective view of a middle shell 6302 laid flat with its outer surface visible. The middle shell 6302 may include four sides 6306*a-d*, a zipper assemblies 6308*a*, a grip 6310, and flaps 6304*a*, 6304*b*. The zipper assembly 6308*a* may extend from the first short side 6306*a* to a second short side 6306*b* of the middle shell 6302. The path of the zipper assembly 6308*a* may form two block-letter "U" in the middle shell 6302. The zipper tapes of the zipper assembly 6308*a* may be uncoupled so that the middle shell 6302 may be separated into two portions.

During travel, a traveler may unzip one or more portions of the zipper assembly 6308*a* to uncouple portions of one or both of the flaps 6304*a*, 6304*b*. The traveler may lift each flap 6304 to view, insert, and/or remove items therethrough.

When the upper shell 5302, the lower shell 5304, and the middle shell 6302 are coupled (see FIG. 63A), the end portions of the middle shell 6302 would overlap. Accordingly, the grip 6310 may extend through an aperture 6312.

Additionally, a third zipper tape 5312*c* would be coupled to sixth zipper tape 5312*f*. A fourth zipper tape 5312*d* would be coupled to a fifth zipper tape 5312*e*. The respectively coupled zipper tapes 5312*c-f*, in some cases, would inhibit the short sides 6306*a*, 6306*b* of the middle shell 6302 from separating.

Figure 63C:
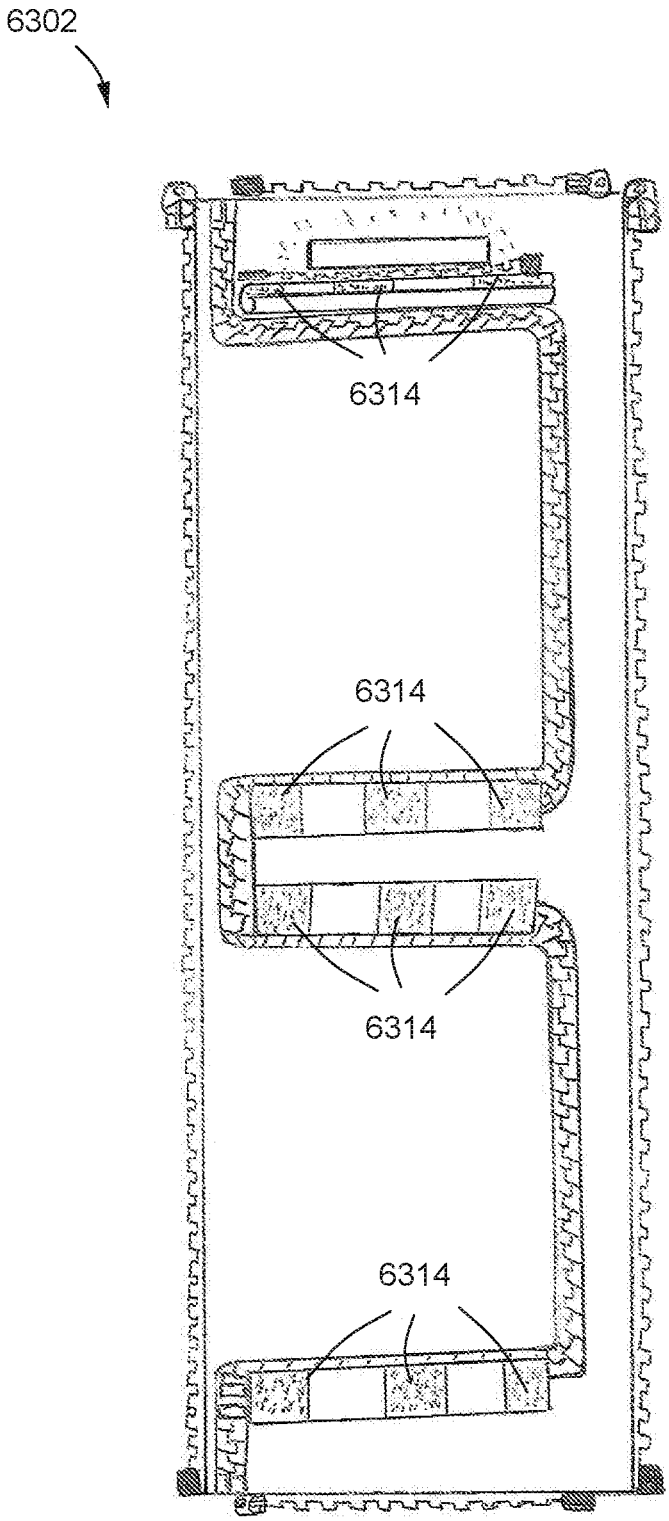
FIG. 63C illustrates a perspective view of a middle shell laid flat with its inner surface visible.

FIG. 63C illustrates a perspective view of a middle shell 6302 laid flat with its inner surface visible. Loop tapes 6314, e.g., Velcro tapes, may be coupled to the inner surface of the middle shell 6302. The loop tapes 6314 may be disposed adjacent sides of flaps 6304 of the middle shell 6302. The loop tapes 6314 may be aligned parallel to the short sides of the middle shell 6302.

In some versions, the loop tapes 6314 may be aligned with hook tapes (not shown) coupled to outer surfaces of tubes 5506*d*, 5506*d*' (see FIG. 60). The loop tapes 6314 and the hook tapes may be removably coupled. Thus, the coupled loop tapes 6314 and hook tapes may inhibit movement of the middle shell 6302 relative to an upper shell and/or a lower shell of a luggage assembly.

FIGS. 63D-F illustrate various zipper tape assemblies 6308. The zipper tape assemblies 6308 may be used to removably couple various luggage assembly components including an upper shell, a middle shell, and/or a lower shell. For example, each zipper assembly 6308 may be coupled to an upper shell 5302 with a lower shell 5304 (see FIGS. 53A-B). Additionally, each zipper assembly 6308 may be coupled to an upper shell 5302 and a middle shell 6302 (see FIG. 63A). Also, each zipper assembly 6308 may be coupled to a lower shell 5304 and a middle shell 6302 (see FIG. 63A). In addition, each zipper 6308 may be coupled to portions of a middle shell (see FIG. 63A-B).

Referring to FIG. 63D, a zipper tape assembly 6308 may have a first zipper tape 5312*a* and a second zipper tape 5312*b*. The first zipper tape 5312*a* may be capable of being removably coupled to the second zipper tape 5312*b*. The first zipper tape 5312*a* may include two boxes. Each box may receive a pin of the second zipper tape 5312*b*.

Additionally, the first zipper tape 5312*a* may have two sliders slidably coupled to teeth of the first zipper tape 5312*a*. The two sliders may be disposed between the two boxes.

Referring to FIG. 63E, a zipper tape assembly 6308 may have a first zipper tape 5312*a* and a second zipper tape 5312*b*. The first zipper tape 5312*a* may be capable of being removably coupled to the second zipper tape 5312*b*.

Each zipper tape 5312 may include a box, a pin, and a slider. The box may be disposed on a first end of the zipper tape 5312. The pin may be coupled to a second end of the zipper tape 5312. The slider may be disposed between the box and the pin. The slider may be slidably coupled to teeth of the zipper tape 5312.

The box of the first zipper tape 5312*a* may receive a pin of the second zipper tape 5312*b*. The box of the second zipper tape 5312*b* may receive a pin of the first zipper tape 5312*a*.

Referring to FIG. 63F, a zipper tape assembly 6308 may have a first zipper tape 5312*a* and a second zipper tape 5312*b*. The first zipper tape 5312*a* may be removably coupled to the second zipper tape 5312*b*.

Each zipper tape 5312 may include a box, a pin, and a slider. The box may be disposed on a first end of the zipper tape 5312. The pin may be coupled to a second end of the zipper tape 5312. The slider may be disposed between the box and the pin. The slider may be slidably coupled to teeth of the zipper tape 5312.

The box of the first zipper tape 5312*a* may receive a pin of the second zipper tape 5312*b*. The box of the second zipper tape 5312*b* may receive a pin of the first zipper tape 5312*a*.

Additionally, each zipper tape 5312 may have a zipper stop 6310. The zipper stop 6310 may be disposed between a first set of teeth and a second set of teeth of the zipper tape 5312.

When portions of the zipper tapes 5312*a*, 5312*b* are coupled by a slider, the slider would be slid until it is abutted against the zipper stop 6310. In some cases, the zipper stop 6310 may inhibit the slider from being slid past the zipper stop 6310.

Figure 64:
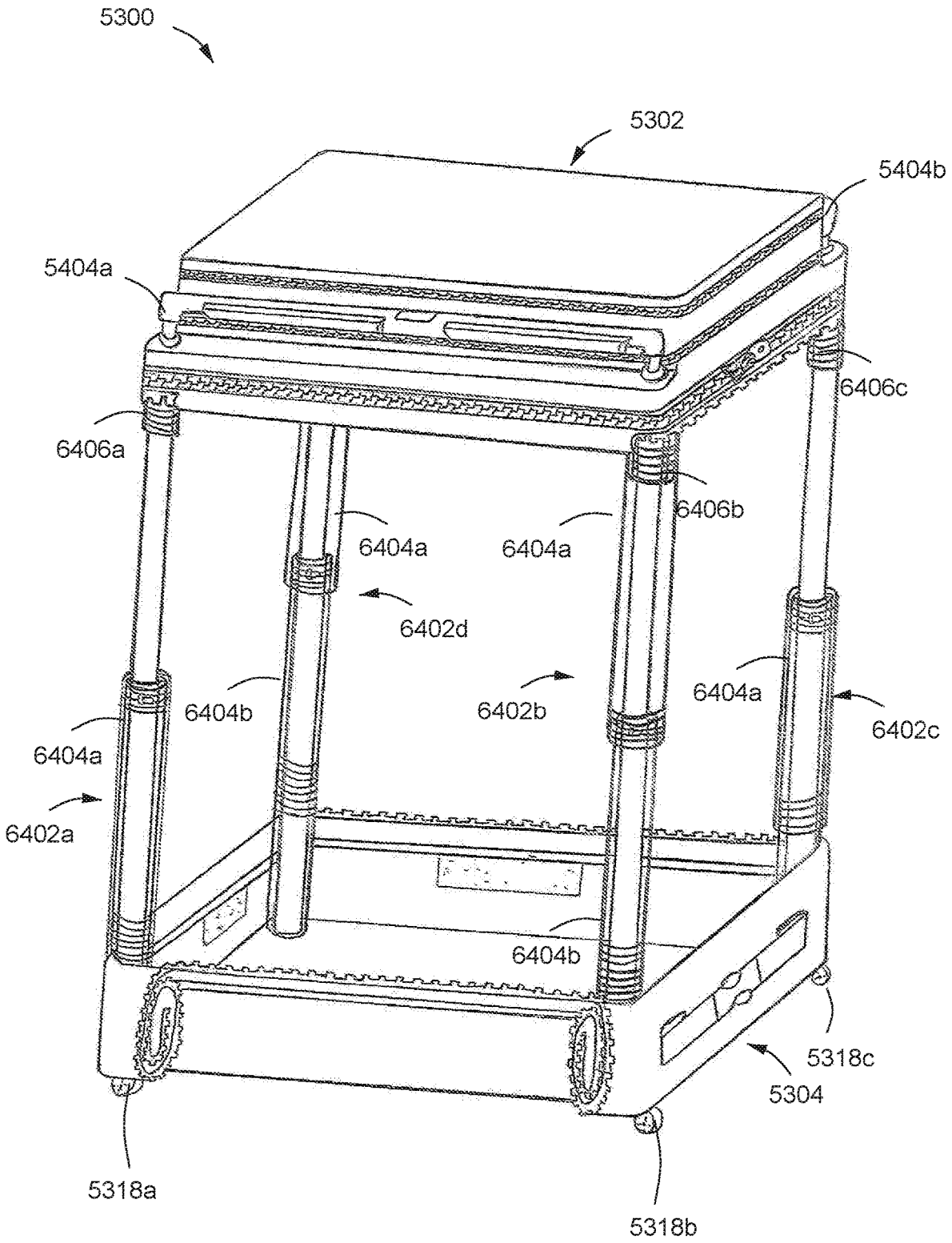
FIG. 64 illustrates a perspective view of a luggage assembly having telescoping support tube assemblies.

FIG. 64 illustrates a perspective view of a luggage assembly 5300 having telescoping support tube assemblies. The luggage assembly 5300 may include an upper shell 5302, a lower shell 5304, two handles 5404*a*, 5404*b*, and telescopic support shafts 6402. Each telescopic support shaft 6402 may include a plurality of support tubes 6404. Each support tube 6404 may be disposed around one or more portions of a telescopic shaft 5504 of a handle 5404. Also, each support tube 6404 may be slid relative to a telescopic shaft 5504.

Additionally, each support tube 6404 of the telescopic support shafts 6402 may have a threaded inner portion. The threaded inner portion may be coupled to a threaded assembly 6406. For example, the concentric support tube 6404*a* may be respectively coupled to a threaded assembly 6406*a*.

Figure 65:
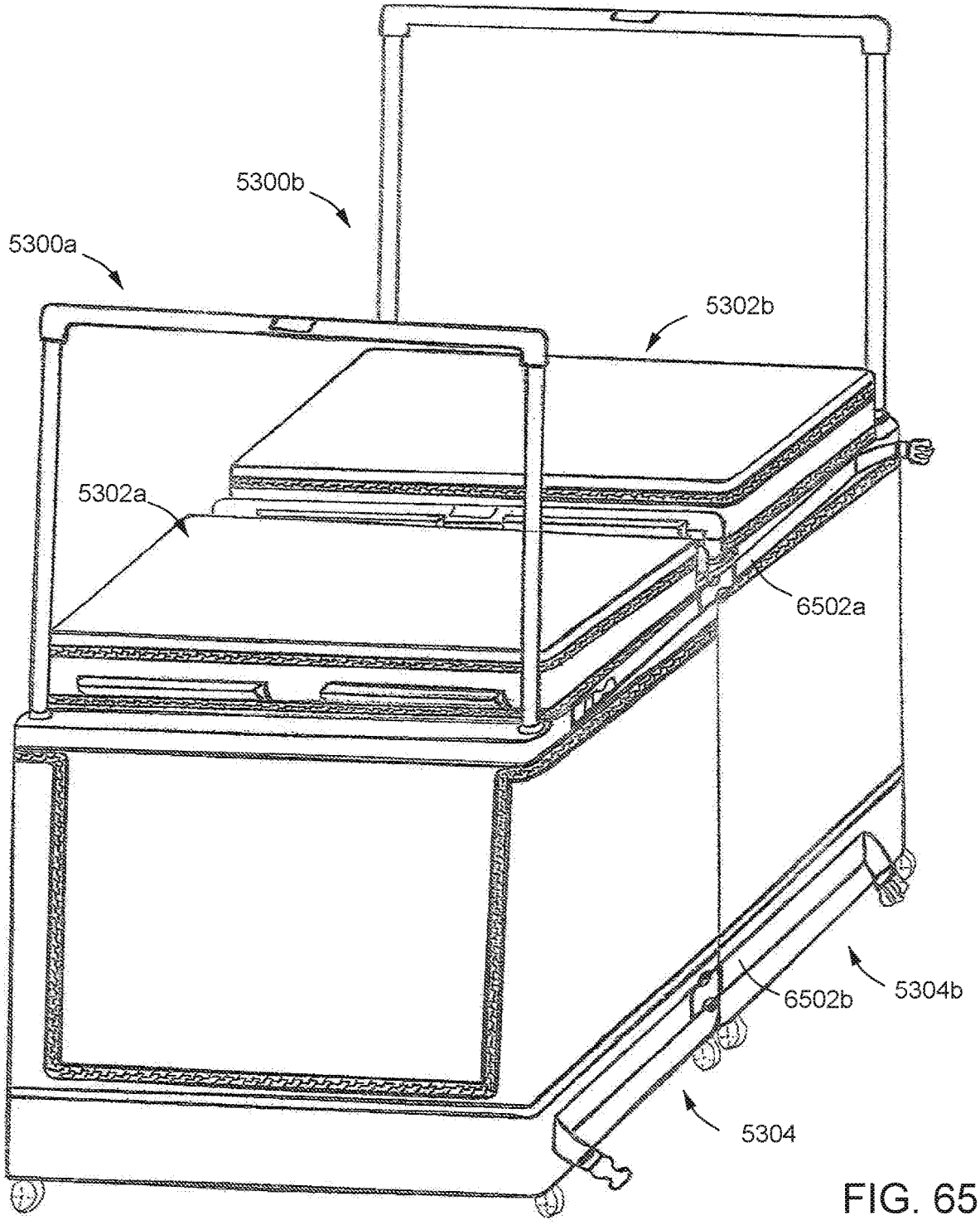
FIG. 65 illustrates a perspective view of two luggage assemblies removable coupled via straps.

FIG. 65 illustrates two luggage assemblies 5300*a*, 5300*b* removable coupled via straps 6502*a*, 6502*b*. The straps 6502*a*, 6502*b* may be coupled to adjacent, e.g., coplanar, sidewalls of the two luggage assemblies 5300*a*, 5300*b*. The strap 6502*a* may be coupled to an upper shell 5302 of the luggage assemblies 5300*a*, 5300*b*. The strap 6502*b* may be coupled to a lower shell 5304 of the luggage assemblies 5300*a*, 5300*b*. The strap 6502*a* may have a clip removably coupled to a buckle.

Although not shown, it should be understood that additional straps 6502 may be coupled to sides opposite the visible sides of the two luggage assemblies 5300*a*, 5300*b*.

Figure 52:
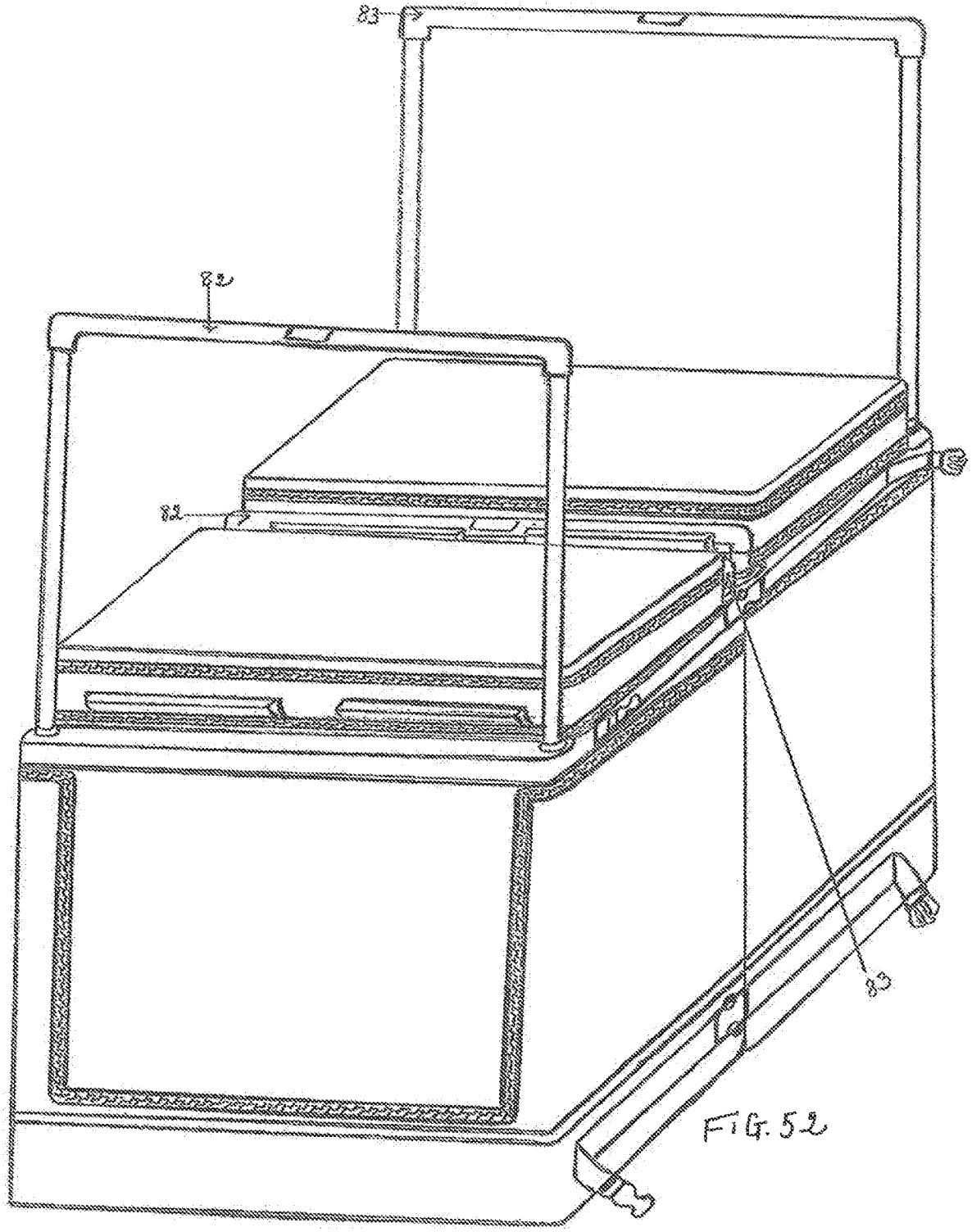

Other alternative versions of luggage assemblies may be described in reference to FIGS. 1-52.

Referring to FIGS. 1, 2, 4, 6, 8 a convertible shelving suitcase in accordance with the present disclosure is provided a suitcase 90 which comprises two retractable handle assemblies 80, 81, a hard-shell top portion 92 and a hard-shell base portion 93 which are detachably coupled together through the soft middle portion 94, two pair of lug portions 95, 96 are defined in the hard-shell top portion 92. One pair of lug portions 95 is located at the two front corners of the hard-shell top portion 92 and other pair of lug portions 96 is located at the two rear corners of the hard-shell top portion 92. Basically, one retractable handle assembly 80 is positioned to the front of the convertible shelving suitcase 90 through the passages 951 which are vertically defined in the two front lug portions 95; and the other retractable handle assembly 81 is positioned to the rear of the convertible shelving suitcase 90 through the passages 961 which are vertically defined in the rear lug portions 96. For the convertible shelving suitcase 90 to be extended vertically, it is provided that two pairs of outer tubes, one pair 70 is for the front retractable handle assembly 80 and the other pair 71 is for the rear retractable handle assembly 81, each pair has a lower ends fixed securely to the hard-shell base portion 93; and two pairs of inner tubes, one pair 60 is for the front retractable handle assembly 80 and the other pair 61 is for the rear retractable handle assembly 81, each pair 60, 61 has lower ends slidably mounted in the upper ends of a corresponding one of the two pairs 70, 71 of outer tubes. Each pair 60, 61 of inner tubes has upper ends securely received in the passages 951, 961 of a corresponding pair of lug portions 95, 96 of the hard-shell top portions 92. The main compartment 50 between the hard-shell top portion 92 and the hard-shell base portion 93 can be fully extended and accommodate the fully extended detachable suspending shelves 40. When two pairs 60, 61 of inner tubes slide upwardly in the corresponding pairs 70, 71 of outer tubes by exerting an upward force on the handle portion 82,83 and the movement is stopped when the bores 600, 610 defined in the lower ends of the associated inner tubes align with the bores 700, 710 defined in the upper ends of the associated outer tubes 70, 71 and to be inserted by the associated stubs 601, 611 by means of the returning force of the springs of the associated biasing members housed in the lower ends of the associated inner tubes 60, 61.

Referring to FIGS. 6, 10, 11, 12, 13, 22, before the frame of the main compartment 50 of the convertible shelving suitcase 90 can be extended, it is first required the hard-shell top portion 92 detached from the hard-shell base portion 93 through the soft middle portion 94. Therefore, it is another objective of the present disclosure to provide the soft middle portion 94 comprises long rectangular piece of luggage fabric with two longer sides 941, 942 and two shorter sides 943, 944. Two open end zipper halves with single sliders 945, 946, which are sewn on the edges of two longer sides 941, 942 of the rectangular piece of luggage fabric, are corresponding to two open end zipper halves 925, 926 sewn on the lower edge of the hard-shell top portion 92 and the upper edge of the hard-shell base portion 93. A suitcase side handle 947 is attached or sewn near the edge of one shorter side 943 with a corresponding rectangular opening 948 formed near the edge of the other shorter side 944. The open end zipper halves 945, 946 of the soft middle portion 94 are fastened to one ends 935, 936 of the corresponding open end zipper halves 925, 926 of the hard-shell top portion 92 and the hard-shell base portion 93 at one ends 955, 956 of the soft middle portion 94 and zipped closed around the main compartment 50 in such a manner that the other ends 965, 966 of the soft middle portion 94 is overlapped by the starting ends 955, 956. The overlapping achieves, but not limited to, three things. First, the overlapping allows the soft middle portion 94 to be removed for washing or replacing. However, there is other variation of the soft convertible shelving suitcase 90 which has the soft middle portion 94 that cannot be detached for washing or replacing. Second, the overlapping hides the zipper sliders 975, 976 for security purpose. To further protect the access to the hidden zipper sliders 975, 976 an open end zipper 981 is sewn along the edge of the overlapping shorter side 944 of the soft middle portion 94 with the rectangular opening 948 vertically from the hard-shell base portion 93 end to the hard-shell top portion 92 end, where the hole on the pull-tab of the slider 982 of the open end zipper 981 lines up with two lock holes of the two sliders 992, 993 of the two-way open end zipper 994 for the shackle of a padlock (not shown here) to pass through and lock. To make the side handle 947 sturdier, another open-end zipper 980 is sewn along the edge of the overlapped shorter side 943 of the soft middle portion 94 with the suitcase side handle 947 vertically from the hard-shell top portion 92 end to hard-shell base portion 93 end; to make the suitcase side handle 947 even sturdier, the Velcro 950 is sewn on the two corresponding contacting surfaces at the overlapping area surrounding the suitcase side handle 947. Third, the overlapping allows forming a suitcase side handle 947 by having one shorter side 943 of soft middle portion 94 with the suitcase side handle 947 be overlapped by the other shorter side 944 with the rectangular opening 948 so that the handle 947 fit through the rectangular opening 948 and form the suitcase side handle 947.

Referring to FIGS. 7, 10, 11, 12, 13, It is another objective of the present disclosure to provide the soft middle portion 94 to be further detached in the following manner that it will not only create easy access to the content in the main compartment 50 but it also provides another way to detach the hard-shell top portion 92 from hard-shell base portion 93 without removing the soft middle portion 94. The soft middle portion 94 can be further detached to create access to two sides of the convertible shelving suitcase 90, namely the front and the rear; the soft middle portion 94 is detached into top portion 999 and bottom portion 998 which are detachably coupled with two-way open-end zipper 994 halves. The two-way open-end zipper 994 used in this case is similar to the open-end zipper 945, 946 used in previous case in the following way, the zipper halves can be completely detached from each other. However, the only difference between the two is the two-way open-end zipper 994 has double sliders 992, 993 arranged in head to head relation whereas the open-end zipper 945, 946 has only single slider 975, 976. Two-way open-end zipper, 994 halves are sewn in the similar manner as the open-end zipper halves 945, 946, both are zipped closed around the main compartment 50 of the suitcase 90 and one end 943 with the suitcase side handle 947 is overlapped by the other end 944 with the rectangular opening 948. However, in the former case, the open end zipper halves 945, 946 are sewn in straight lines horizontally whereas, in the latter case, the two-way open end zipper 994 halves are sewn in zigzag-like manner to create the front flap 51, the rear flap, 52 and the side flaps 53, 54. Once the two-way open end zipper 994 halves have been sewn along the lower edge of the top portion 999 and upper edge of the bottom portion 998 in the zigzag-like manner, the top portion 999 and the bottom portion 998 of the soft middle portion 94 are fastened and zipped closed in the following manner by one of the two sliders 992, 993 starting at one of the ends 990 of soft middle portion 94 above the suitcase side handle 947 and one inch below the top edge of the longer side 942 of the soft middle portion 94 and zipped closed horizontally until reaching a point where the side portion ends and the front portion begins. They are then zipped closed vertically toward the bottom until one inch from bottom edge of the longer side 941 of the soft middle portion 94, then zipped closed horizontally away from the starting point until reaching a point where the front portion ends and another side portion begins. They are then zipped closed vertically toward the top until one inch from the top edge of the longer side 942 of the soft middle portion 94, then zipped closed horizontally away from the starting point until reaching a point where the side portion ends and another front portion begins. They are then zipped closed vertically toward the bottom until one inch from the bottom edge of the longer side 941 of the soft middle portion 94 then zipped closed horizontally away from the starting point until reaching a point where the front portion ends and the side portion begins. They are then zipped closed vertically toward top until one inch from the top edge of the longer side 942 of the soft middle portion 94, then zipped closed horizontally away from the starting point until reaching the other end 991 of soft middle portion 94 with the rectangular opening 948. As the result, the front flap 51 and rear flap 52 are formed as part of top portion 999 of the soft middle portion 94, and two side flaps 53, 54 are formed as part of the bottom portion 998 of the soft middle portion 94. However, only the front and rear flaps 51, 52 form access to the content of the main compartment 50 and the side flaps 53, 54 do not, because both side flaps 53, 54 are attached to four outer tubes 70 by the four Velcro sleeves 56, which are sewn onto the inside of the side flaps 53, 54, from top of outer tube 70 to bottom of outer tube 70. So, when the Velcro sleeves 56 wrap around the four outer tubes 70 from top to bottom, the side flaps 53, 54 are held tightly to the four outer tubes 70 from top to bottom in the main compartment 50. When the two-way open end zipper 994 is fully opened at both ends 990, 991 of the soft middle portion 94, it allows the hard-shell top portion 92 including the top portion 999 of the soft middle portion 94 and the hard-shell base portion 93 including the bottom portion 998 of the soft middle portion 94 to be detached completely and the frame of the main compartment 50 of the convertible shelving suitcase, 90 can then be fully extended. Furthermore, there can be four pockets 519, 529, 539, 549 sewn on the front flap 51, the rear flap 52, the side flap with the suitcase side handle 53 and the side flap without the suitcase side handle 54 respectively.

Referring to FIGS. 13, 14, 15, 16, 17, 18, 19, 23, 24, and 25, there is little protection for the two pairs of outer tubes 70, 71 in the main compartment 50 from handling, especially from the luggage handling by airport personnel; hence, it is another objective of the present disclosure to provide that two pairs of protective tubes 74, 75 which are needed for the two corresponding pairs of outer tubes 70, 71. The two pairs of protective tubes 74, 75 are called the protective outer tubes 74, 75. Since the hard-shell top portion, 92 and the hard-shell base portion 93 are made of polycarbonate, polypropylene or ABS, they can be molded easily. Like the two pairs of lug portions 95, 96 of the hard-shell top portion 92, which are molded as part of the hard-shell top portion 92; the two pairs of protective outer tubes 74, 75, which securely receive the two corresponding pairs of the outer tubes 70, 71, are molded as part of the hard-shell base portion 93.

It is another objective of the present disclosure to provide that there can also be two pairs of protective tubes 64, 65 for the inner tubes 60, 61 in the main compartment 50. The two pairs of protective tubes 64, 65 are called the protective inner tubes 64, 65. When the main compartment 50 is fully extended, the two pairs of protective inner tubes 64, 65 can securely receive the corresponding two pairs of lug portions 95, 96 of the hard-shell top portion 92 by securing the inner threads 640, 650 in the upper ends of the protective inner tubes 64, 65 to the outer threads 950, 960 on the corresponding lug portions 95, 96; and the inner threads 620, 630 in the lower ends of the protective inner tubes 64, 65 to the outer threads 740, 750 on the upper ends of the corresponding protective outer tubes 74, 75. As the result, the protective inner tubes 64, 65 further strengthen the frame of the fully extended main compartment 50. When the main compartment 50 is retracted, the two pairs of protective inner tubes 64, 65 slide back onto the corresponding protective outer tubes 74, 75 and can be securely fixed in place by securing the inner threads 620,630 in the lower ends of the protective inner tubes to the outer threads 720, 730 on the lower ends of the corresponding protective outer tubes 74, 75; and by securing the inner threads 640, 650 in the upper ends of the protective inner tubes, 64, 65 to the outer threads 740, 750 on the upper ends of the corresponding protective outer tubes 74, 75. As the result, the protective inner tubes 64, 65 further protect the outer tubes 70, 71 in the main compartment 50. Sometimes, suitcase such as a carry-on suitcase needs to be expanded to accommodate more goods and sent as check-in luggage. Therefore, an expandable compartment 99 can be added to the convertible shelving suitcase 90. The upper edge of the expandable compartment 99 is fixedly attached to and become part of the hard-shell top portion 92 and the lower edge of the expandable compartment 99 can be detachably coupled to the soft middle portion 94 in the same manner as the lower edge of the hard-shell top portion 92 before the expanded compartment 99 has been added. In this case, the protective inner tubes 64, 65 protect the inner tubes 60, 61 in the expanded compartment 99 from rough luggage handling by the airport personnel. The protective inner tubes 64, 65 are attached to both the lug portions 95, 96 of the hard-shell top portion 92 and the protective outer tubes 74, 75 in the same manner as when they are used to further strengthen the frame of fully extended main compartment 50 as mentioned above. There are differences between expanded main compartment 50 and extended main compartment 50. For the main compartment 50 to be extended and able to accommodate the fully extended detachable suspending shelves 40, the soft middle portion 94 has to be completely detached and the expandable compartment 99 has to be in the collapsed mode. These result in the hard-shell top portion 92 having the collapsed expandable compartment 99, the top portion 999 of the soft middle portion 94 with the front flap 51 and the rear flap 52; these also result in the hard-shell base portion 93 having the bottom portion 998 of the soft middle portion 94 with the side flaps 53, 54.

It is another objective of the present disclosure to provide that the detached front flap 51 and the detached rear flap 52 can be tucked and hidden below the hard-shell top portion 92 by Velcro straps or other types of straps. The detached side flaps 53, 54 are folded outward in such a manner that the folded side flaps 53, 54, with the side release buckle straps 530, 540 (not shown), which are sewn horizontally on the inner side of the side flaps 53, 54, position horizontally with ends 532, 542 (not shown) of the straps 530, 540 toward the front and the other ends 531, 541 (not shown) toward the rear. The folded side flaps 53, 54 are strapped to the sides of the hard-shell base portion 93 by the connections between two front ends 532, 542 (front to front connection) and between two rear ends 531, 541 (rear to rear connection). After the flaps 51, 52, 53, 54 are tucked away or folded and strapped, the fully extended compartment 50 is basically an open mobile shelving unit. Unlike the extension of the main compartment 50 as mentioned above, the expansion of the main compartment 50 is not required the soft middle portion 94 to be detached but required the expandable compartment 99 to be zipped open and expanded to accommodate more personal goods. The expanded convertible shelving suitcase 90 can be sent as check-in luggage. When the carry-on suitcase 90 is not used as check-in luggage, the expanded compartment 99 can be used as temporary storage for jackets, handbags or other personal items to free up the hands of travelers. When travelers walk in airport terminal, they usually have to pull the carry-on suitcase 90 with one hand and carry jackets or other bulky items with other hand. So instead of carrying these bulky items, the travelers can free up their hands by expanding the expandable compartment, 99 and use as a temporary compartment 99. They can collapse the temporary compartment 99 back to a carry-on size suitcase 90 when they are ready for boarding.

Referring to FIGS. 18, 20, 21, 22, it is another objective of the present disclosure is to provide the detachable lining interior 40 for the hard-shell base portion 93 of the convertible shelving suitcase 90. The detachable lining interior 40 is basically an open-end packing cube, with four zippers 434 with each located along one of four corners of the packing cube. Each zipper 434 is sewn vertically along each corner of the packing cube 40 in such a manner that the closed bottom 432 of each zipper 434 is sewn at the height of the rim of hard-shell base portion 93 and sewn vertically to the rim of the packing cube 40. This kind of packing cube 40 allows packing various amounts of clothing as long as the packing does not surpass the rim of the packing cube 40. The zippers 434 are zipped open at four corners of the packing cube 40 until reaching the packed clothing and formed four flaps 431 on four sides of the packing cube. These flaps 431 are then folded inward one flap 431 on top of another 431. The detachable lining interior 40 is detachably coupled the hard-shell base portion 93 with the Velcro strips 435 sewn on four sides and the bottom of the packing cube 40 and the inner sides and the bottom of the hard-shell base portion 93; or detachable lining interior 40 is detachably coupled the hard-shell base portion 93 by an open end zipper halves 433, 443 appropriately sewn horizontally around the packing cube 40 just below the closed bottoms 432 of the zippers 434, and horizontally around the inner rim of the hard-shell base portion 93.

Referring to FIGS. 1, 3, 4, 5, 6, 9, 26, 27, 28, 29, 30, 31, 32, 33A, 33B, 40, 48 it is another objective of the present disclosure is to provide the detachable secondary compartment 39, which can be detached and formed a second fully extended detachable suspending shelving unit 32 or a table top 34, with adjustable height. The following explains the relationships between second fully extended detachable suspending shelving unit 32, the secondary compartment 39, table top 34 with adjustable height and the retractable handle assemblies 80, 81. There are two handles 82, 83 for the two sets of retractable handle assembly 80, 81. One handle 82 is for the front retractable handle assembly 80 and one handle 83 is for the rear retractable handle assembly 81. Each handle 82, 83 is attached to the upper ends of a corresponding pair of second inner tubes 30, 31. Each pair of the second inner tubes 30, 31 has lower ends slidably mounted in the upper ends of a corresponding one of the two pairs of the first inner tubes 60, 61, which were securely received in the corresponding passages 951, 961 vertically defined in the two pairs of lug portions 95, 96. The length of the handle portions (the handles 82, 83 and inner tubes 30, 31 attached to the handles) can be adjusted to desired heights when two pairs of second inner tubes 30, 31 slide upwardly in the corresponding pairs of first inner tubes 60, 61 by exerting an upward force on the handle portions and the movement is stopped when the bores 300, 310 defined in the lower ends of the associated second inner tubes 30, 31 align with ones of the bores 600, 610 vertically defined along the length of the associated first inner tubes 60, 61 and to be inserted by the associated stubs 301, 311 by means of the returning force of the springs of the associated biasing members housed in the lower ends of the associated second inner tubes 30, 31, thereby locking each pair of the second inner tubes 30, 31 in place. By using the same process just mentioned above, a third inner tubes or more, if so desired, can be added to attain desired heights for the retractable handle assemblies 80, 81. A small detachable secondary compartment 39 is positioned at the top of the hard-shell top portion 92. The secondary compartment 39 is assembled from detachable suspending shelves 35. The first detachable shelf 350 is attached to the upper edge of the hard-shell top portion 92 with the two-way open-end zipper 322, 326. The first detachable shelf 350 is molded in such a manner that the front side has two extended supporting brackets 354 similar to the supporting brackets for curtain rods and rear side has two similar extended supporting brackets 355 (not shown). Two pairs of extended supporting brackets 354, 355, one pair on each side of the first detachable shelf 350, are received by the grooves 800, 801 of the corresponding handles 82, 83 to keep the bracket 354, 355 securely in place and allow the pairs of extended supporting brackets 354, 355 to grasp the undersides of the corresponding handles 82, 83 of the retractable handle assemblies 80, 81 protectively at both sides of the pressing members (buttons) 820, 830. The second shelf 351 is attached to the upper edge of the first shelf 350 with two-way open-end zipper 321, 325. The top of the second shelf 351 can be used as a table top 34. The third shelf 352 is smaller than the first 350 and second shelves 351 so that it can fit inside both first 350 and second 351 shelves. The upper edge of the third shelf 352 is attached to the lower edge of the second shelf 351 with the two-way open-end zipper 323, 328 which is positioned inner side of the two-way open-end zipper 321, 325 that attaches the lower edge of the second shelf 351 to the upper edge of the first shelf 350. When the lower edge of the second shelf 351 and the upper edge of the first shelf 350 are zipped closed the third shelf 352 is received inside the first shelf 350 and, therefore, hidden inside the detachable secondary compartment 39. The top and bottom of the third shelf 352 is enclosed with the detachable flaps 355, 356 in similar manner the bottom of the hard-shell top portion 92 is enclosed with a detachable flap 357. The flaps 355, 356, 357 can be removed by detaching the open-end zipper halves completely. The secondary compartment 39 forms a second fully extended detachable suspending shelving unit 32 when the first, second, third shelves 350, 351, 352 and hard-shell top portion 92 are fully detached from one another. The first shelf 350 becomes the top shelf of the second fully extended detachable suspending shelving unit 32 with its extended supporting brackets 354, 355 securely grasp onto the upper sides of the grooves 800, 801 of the two handles 82, 83 of the retractable handle assemblies 80, 81, the second shelf 351 becomes the bottom shelf and the third shelf 352 becomes middle shelf. The secondary compartment 32 can be used as a table top 34 with adjustable height by completely detaching the second shelf 351 from the upper edge of first shelf 350 and then attaching the second shelf 351 to the lower edge of the first shelf 350 and allowing the extended supporting brackets 354, 355 of the first shelf 350 to be received by the grooves 800, 801 of the corresponding handles 82, 83 to keep the brackets 354, 355 securely in place and allow the pairs of extended supporting brackets 354, 355 to grasp the upper side of the corresponding handles 82, 83 of the retractable handle assemblies 80, 81 at both sides of the pressing members (buttons) 820, 830.

Referring to FIGS. 1, 9, 33A, 33B, 34, 35, 36, 37, 38, 39, 40, it is another objective of the present disclosure to provide another variation for the secondary compartment 39 whereas there is no first shelf 350. The second shelf 351 is attached to the upper edge of the hard-shell top portion 92 with the two-way open-end zipper 325, 326. The detachable second shelf 351 is molded in such a manner that the front side has two extended supporting brackets 354 similar to the supporting brackets for curtain rods and rear side has two similar extended supporting brackets 355 (not shown). Two pairs of extended supporting brackets, 354,355, one pair on each side of the second detachable shelf 351, are received by the grooves 800, 801 of the corresponding handles 82, 83 to keep the brackets 354, 355 securely in place and allow the pairs of extended supporting brackets 354, 355 to grasp the undersides 339 of the corresponding handles 82, 83 of the retractable handle assemblies 80, 81 protectively at both sides of the pressing members (buttons) 820, 830. The detachable second shelf 351 is also molded in such a manner that the underside 330 of a main table top 333 of a folded table top 33, which comprises a main table top 333 attached both sides along its length by flap hinges 334 to two flaps 331, 332 having the same length and half of the width of the main table top 333, is fused to an underside 335 of the second shelf 351 within inner side of the two-way open end zipper 325, 326 that attaches the lower edge of the second shelf 351 to the upper edge of the hard-shell top portion 92.

When the lower edge of the second shelf 351 and the upper edge of the hard-shell top portion 92 are zipped closed the folded table 33 is received and hidden inside the hard-shell top portion 92. The folded table top 33 is strapped folded by two pairs of side release buckle straps 336 with each pair fixed to the corresponding undersides 337 of the flaps 331, 332 at the distal end portions along the lengths of the flaps 331, 332. A table top 33 with adjusting height is formed when the two-way open end zipper halves 325, 326 along the upper edge of the hard-shell top portion 92 and the lower edge of the second shelf 351 are detached completely and the detached second shelf 351 is flipped over with two pairs of extended supporting brackets 354, 355 securely grasping the upper side 338 of the grooves of the two corresponding handles 82, 83 of the retractable handles assemblies 80, 81. The decoupling of two pairs of side release buckle straps 336 allows two flaps 331, 332 to extend the main table top 333 on both sides and forms an extended table top 33. The extended table top 33 can be adjusted to desired heights when two pairs of inner tubes namely second inner tubes 30, 31, which are attached directly to the handles 82, 83, slide upwardly in the corresponding pairs of inner tubes namely first inner tubes 60, 61 by exerting an upward force on the handle portions 82,83 and the movement is stopped when the bores 300, 310 defined in the lower ends of the associated second inner tubes 30, 31 align with ones of the bores 600, 610 vertically defined along the length of the associated first inner tubes 60, 61 and to be inserted by the associated stubs 301, 311 by means of the returning force of the springs of the associated biasing members housed in the lower ends of the associated second inner tubes 30, 31, thereby locking each pair of the second inner tubes 30, 31 in place. If the second shelf 351 is used as an extended table top 33 then the pairs of the hanging detached side release buckle 336 should be neatly coupled to one another correspondingly. If the second shelf 351 is used as part of the secondary extended suspending shelving unit 32 the detached side release buckle straps 336 should be left hanging and correspondingly coupling to side release buckle straps 336 of a detached shelf or shelves 35.

Figure 41:
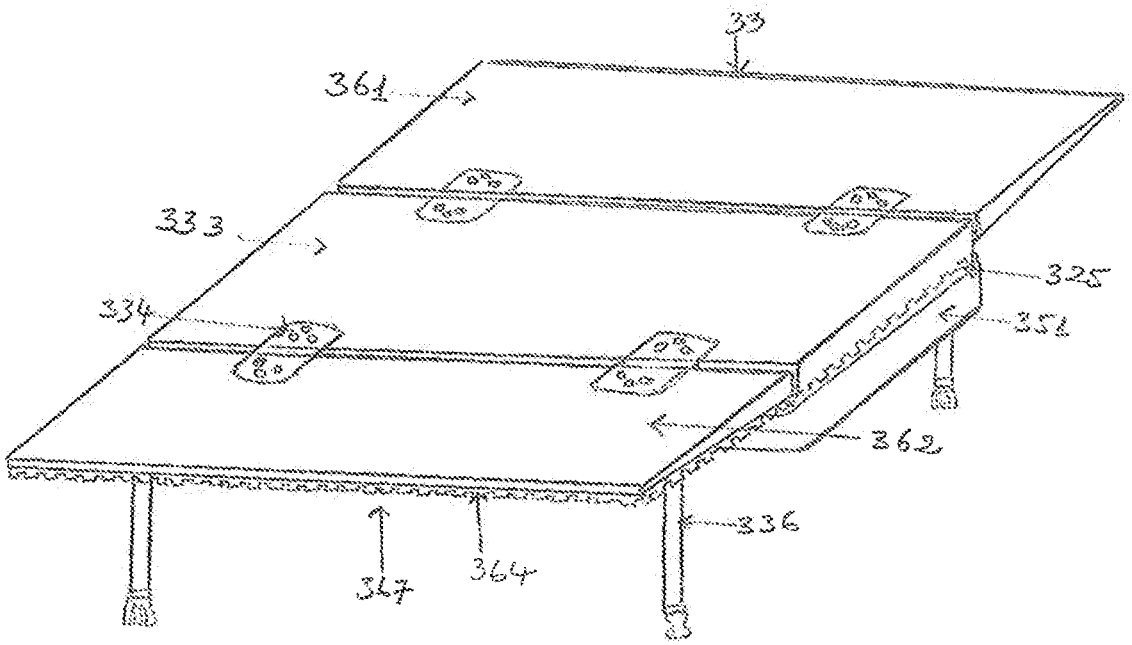
Figure 41:
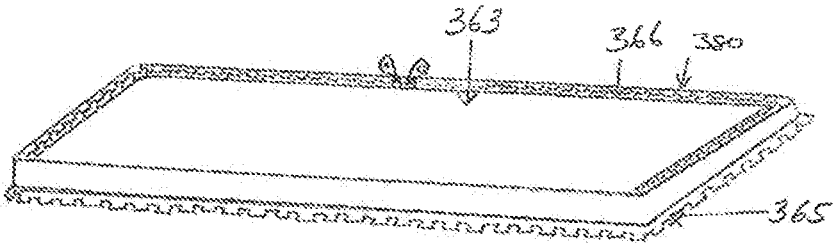
Figure 42:
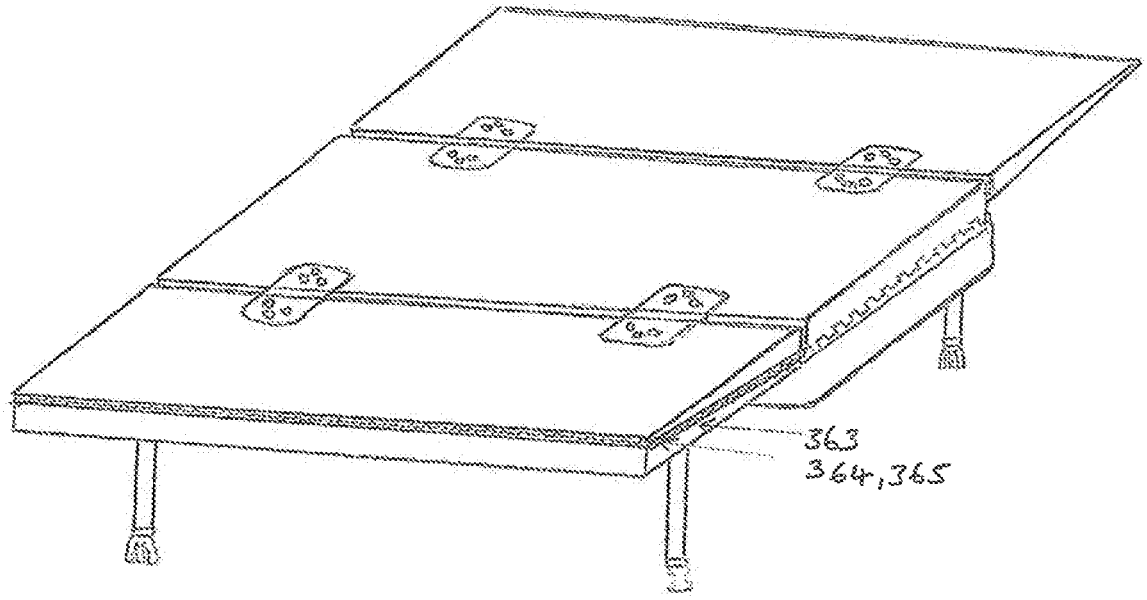
Figure 43:
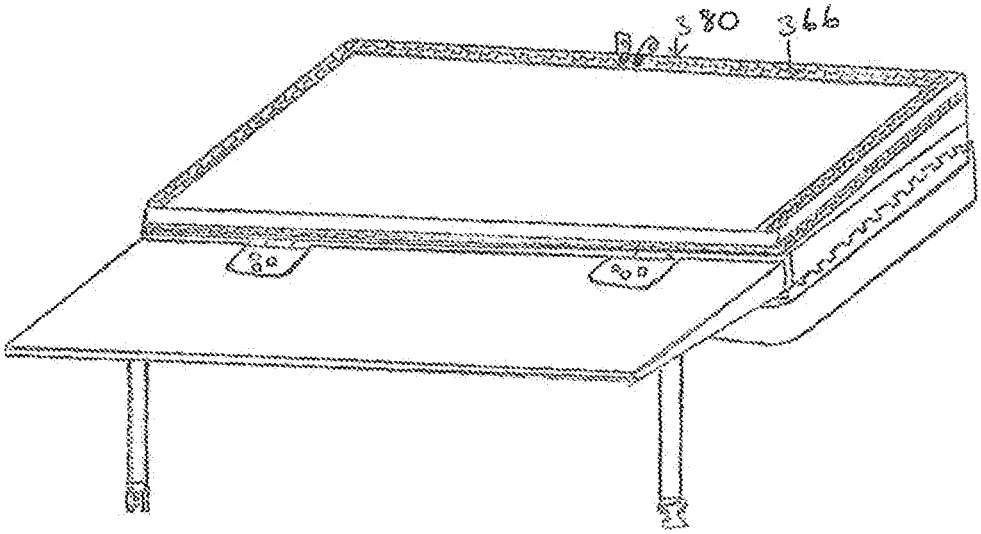
Figure 44:
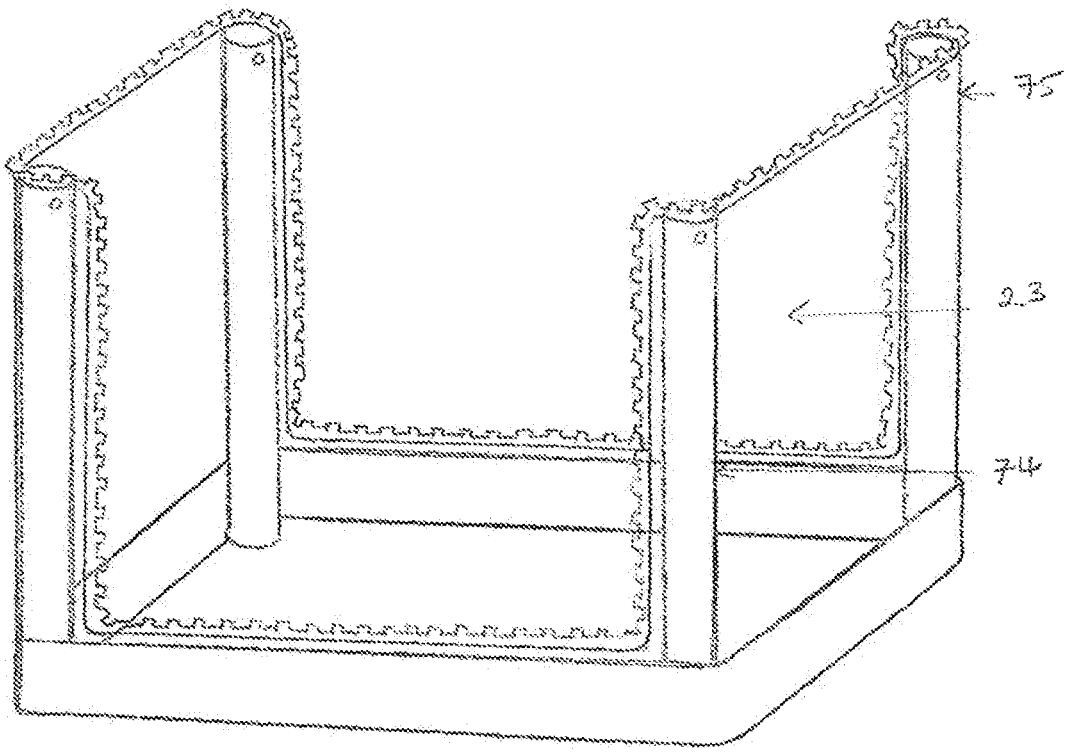
Figure 45:
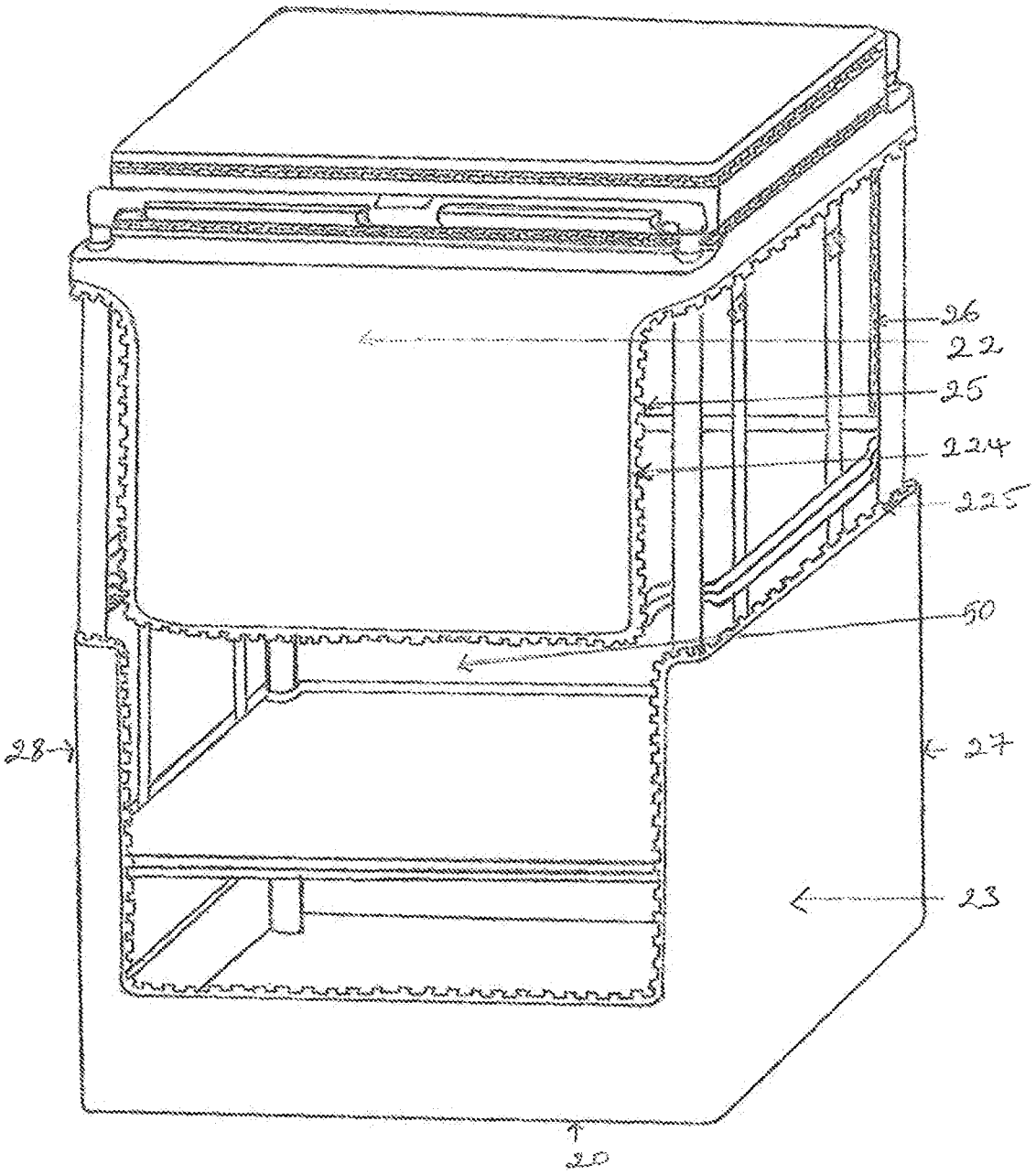
Figure 46:
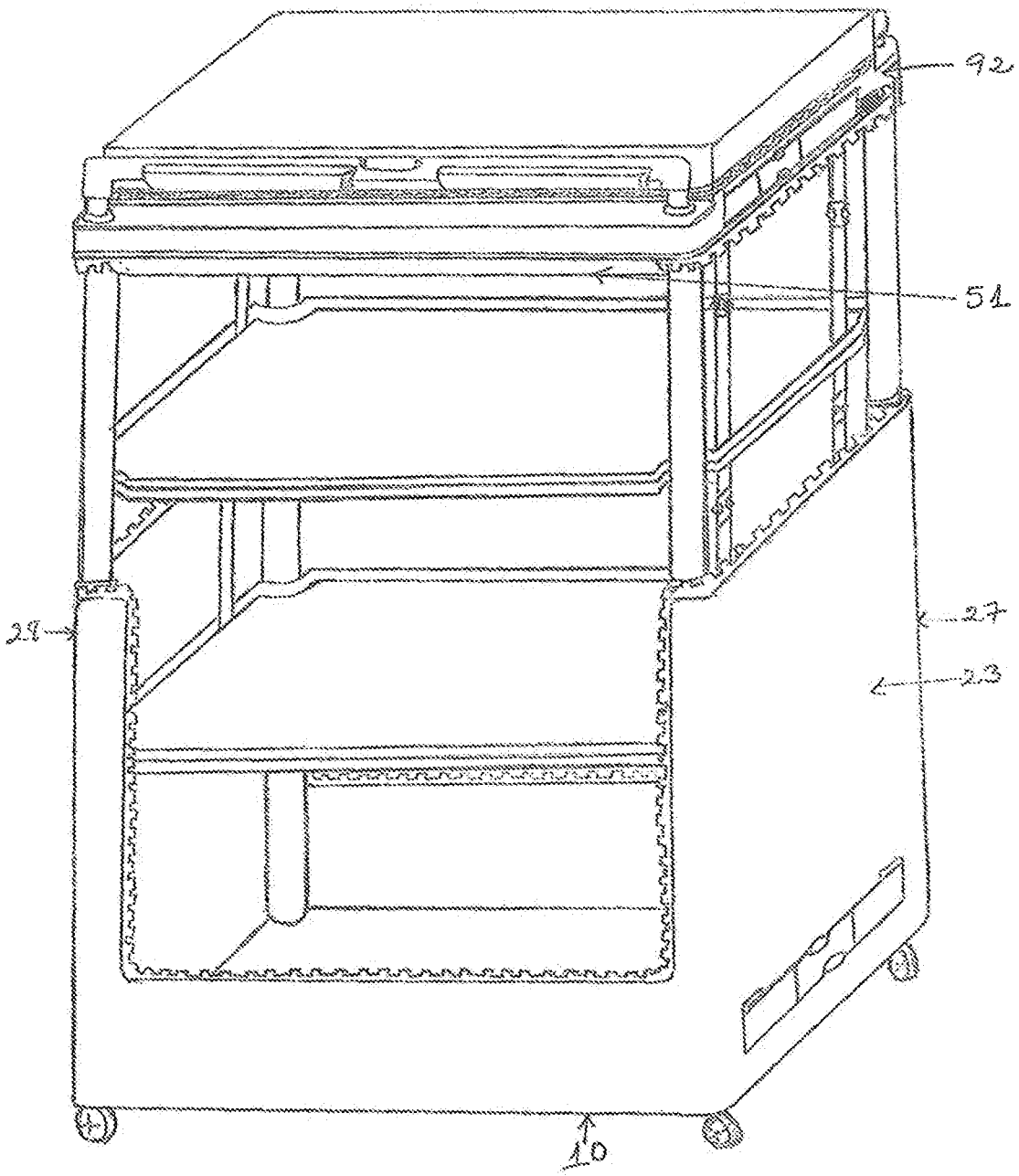
Figure 47:
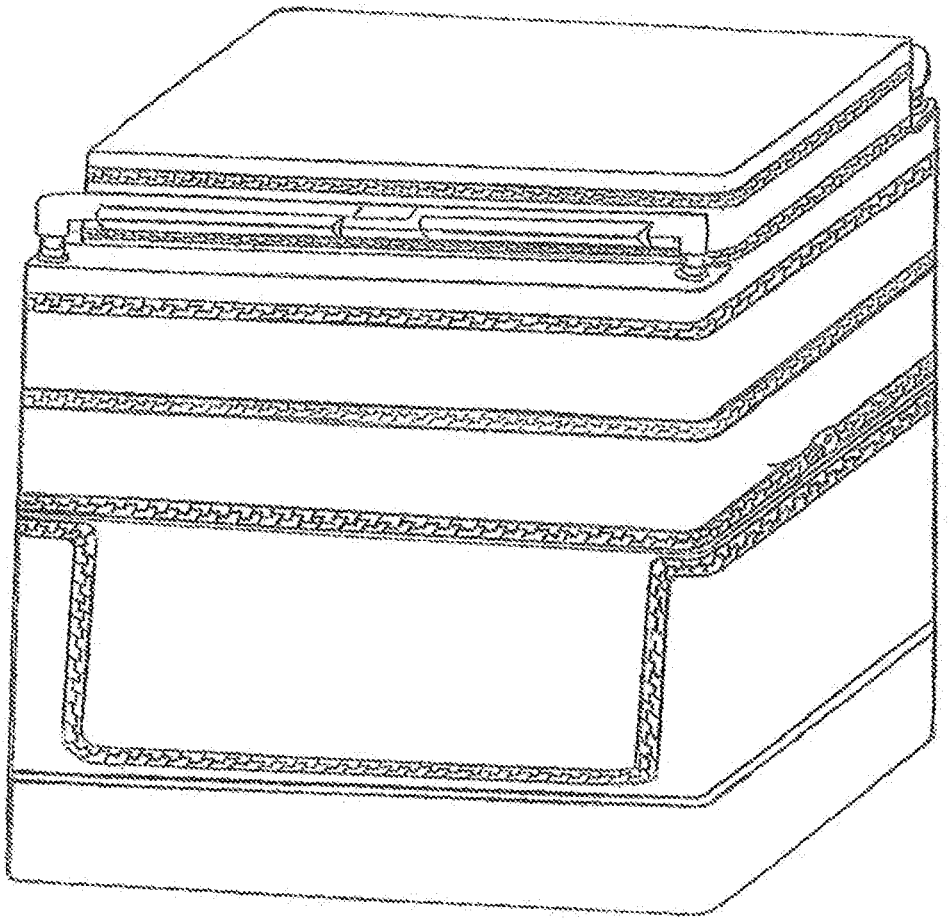
Figure 48:
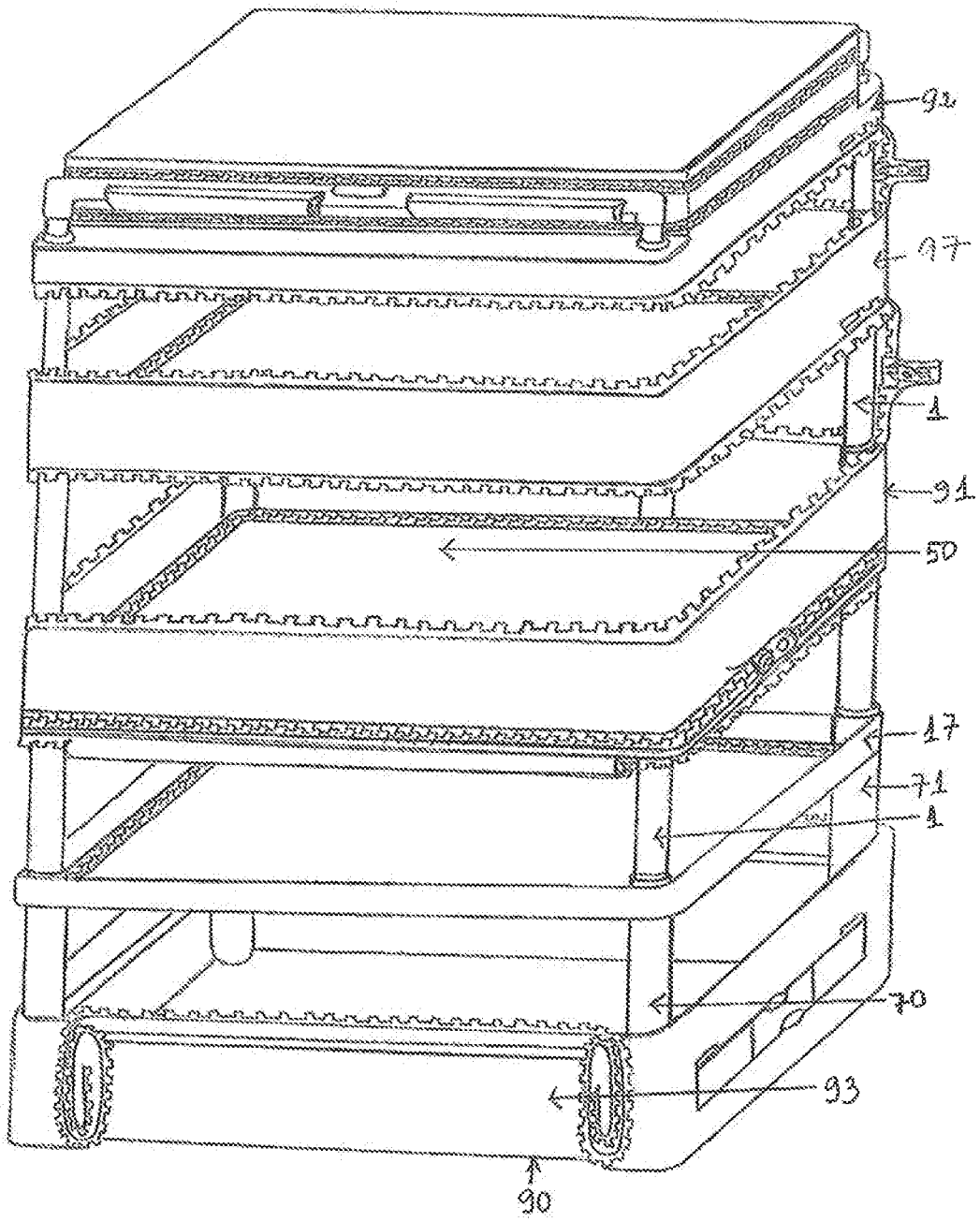
Figure 49:
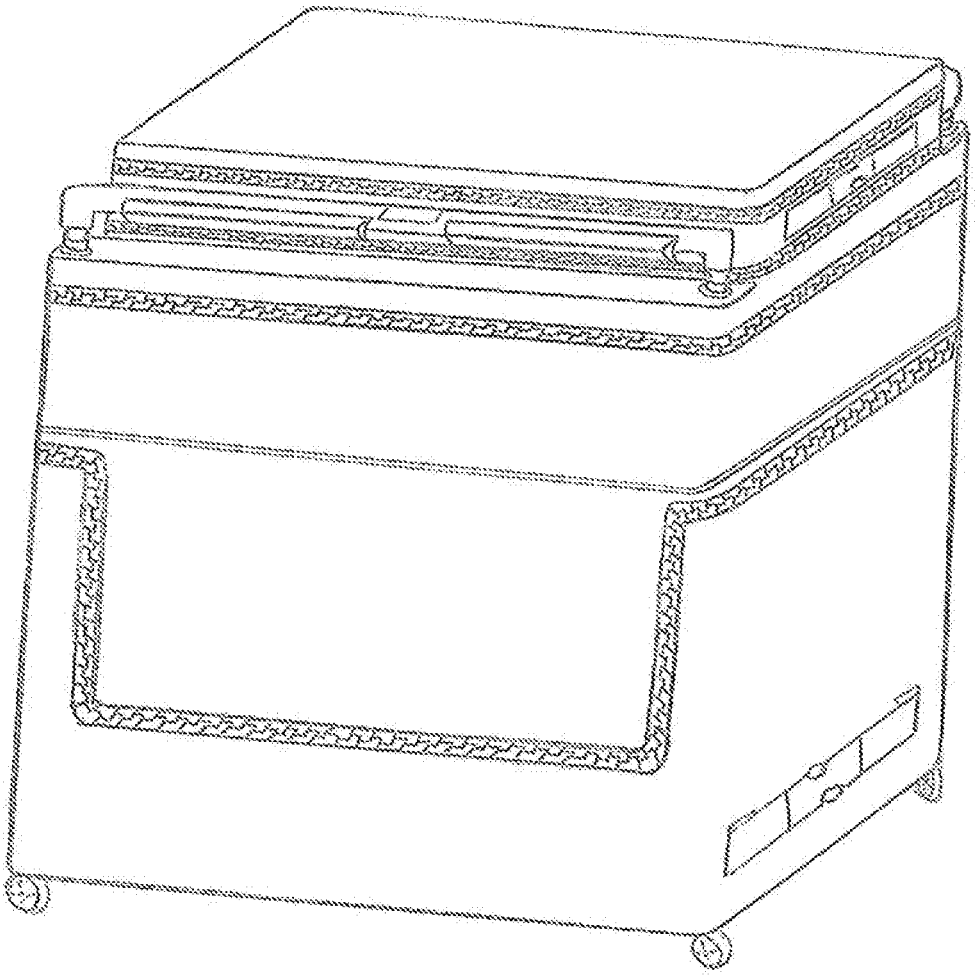
Figure 50:
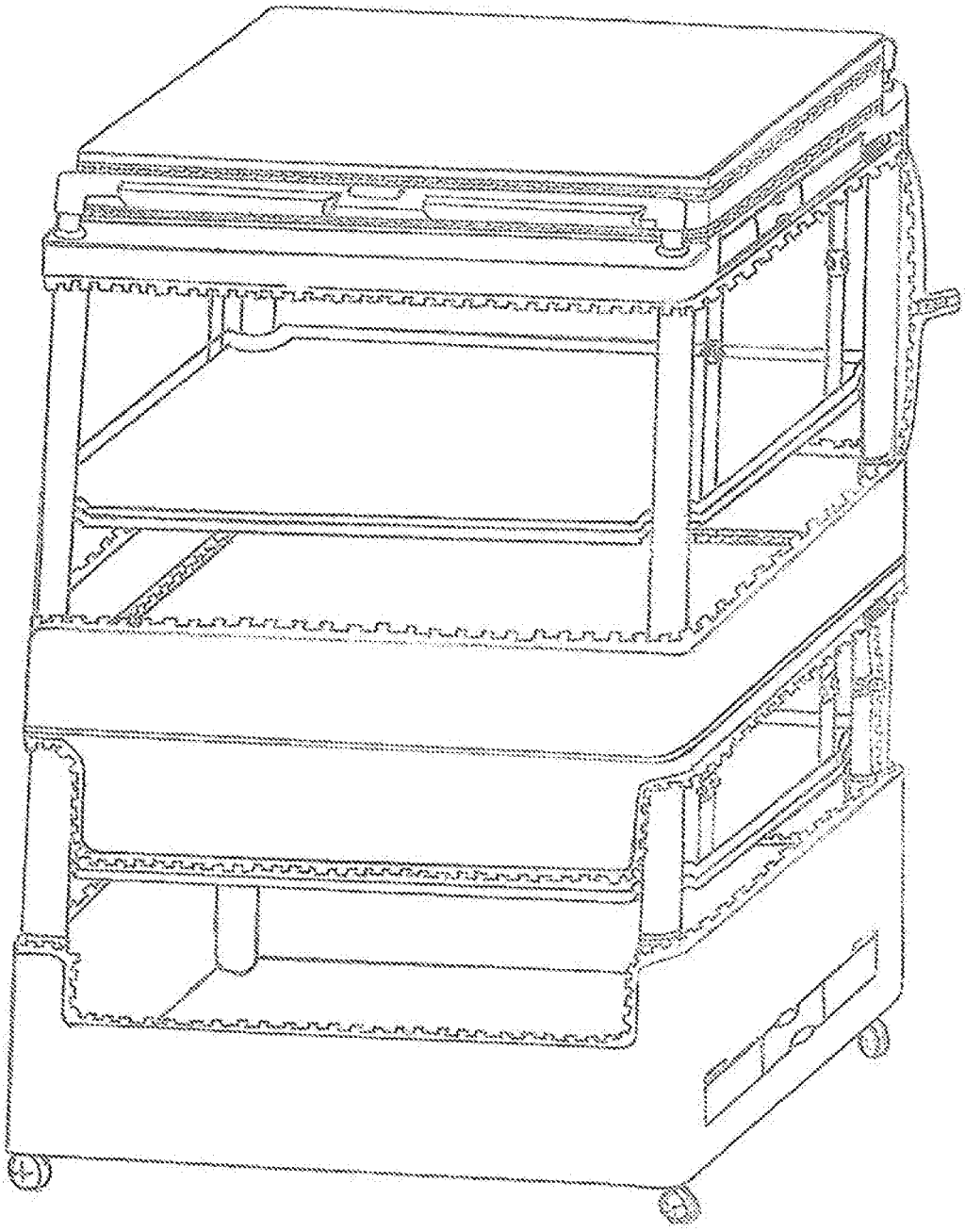

Referring to FIGS. 41, 42, 43, it is another objective of the present disclosure to provide another variation of the table top 33 with adjustable height. The new variant of the folded table top 33 is very much similar to the aforementioned folded table top 33 except that flaps 361, 362 attached to both sides of the main table top 333 have the same length and width as the main table top 333; and, the underside along the length of the flaps 361, 362, which is attached to the flap hinges 334, are slant upward and outward to allow the flaps 361, 362 folded and rested on the main table top 333 horizontally flat. Furthermore, a pocket 363 is attached to the underside 367 of one 362 of the two flaps 361, 362 with the open-end zipper 365, 364; the pocket 363 is positioned in such a manner that the opening 380 with zipper 366 is along the side of the flap 362 attached to the flap hinges 334.

Referring to FIGS. 1, 6, 7, 9, 11, 16, 44, 45, 46, it is another objective of the present disclosure to provide a number of variations of convertible shelving suitcase 90. In addition to the soft convertible shelving suitcase 90 as mentioned above, there is the hard-shell suitcase 20. One major difference between the soft suitcase 90 and the hard-shell suitcase 20 is the soft middle portion 94 in the main compartment 50. The hard-shell suitcase 20 only has the hard-shell top portion 22 and the hard-shell base portion 23 and no detachable soft middle portion 94. The hard-shell front flap 25 and the hard-shell rear flap 26 are molded as parts of the hard-shell top portion 22. The hard-shell side flaps 27, 28 are molded as parts of the hard-shell base portion 23. The hard-shell top portion 22 and hard-shell base portion 23 are detachable coupled by two-way open-end zipper 224, 225 which can be completely detached in the zigzag-like manner that creates the front flap 25, the rear flap 26 and the sides flaps 27, 28 as mentioned above. So when the hard-shell convertible shelving suitcase 20 is detachably decoupled by the two-way open end zipper 224, 225, and the frame of the main compartment 50 can be fully extended to accommodate the fully extended detachable suspending shelves 35 by extending the two sets of retractable handle assemblies 80, 81. Only the lower shelves can be seen from the front or from the rear of the hard-shell suitcase 20 because the hard-shell front flap 25 and the hard-shell rear flap 26 block the upper shelves. Only the upper shelves can be seen from the sides of the hard-shell suitcase 20 because the hard-shell side flaps 27, 28 blocks the lower shelves. Furthermore, the hard-shell suitcase 20 does not have protective inner tubes 64, 65 and Velcro sleeves 56 because protective outer tubes 74, 75 are molded in such a manner that their whole length is fused to the side flaps 27, 28. There is another variation of the convertible shelving suitcase 90 that is a hybrid 10 of the hard-shell convertible shelving suitcase 20 and soft convertible shelving suitcase 90. The hybrid convertible shelving suitcase 10 has the hard-shell top portion 92 similar to the one belongs to the soft convertible shelving suitcase 90 and has the hard-shell base portion 23 similar to the one belongs to the hard-shell convertible shelving suitcase 20. In the hybrid convertible shelving suitcase 10, all the shelves and their contents can be seen at the front and the rear since the soft front flap 51 and the soft rear flap 52 can be tucked and hidden below the hard-shell top portion 92 by Velcro straps or other types of straps. However, only the upper shelves and their contents can be seen at the sides of the main compartment 50 because the hard-shell side flaps 27, 28 block the lower shelves. The hybrid convertible shelving suitcase 10 does not have protective inner tubes 64, 65 and Velcro sleeves 56 as similarly mentioned in the hard-shell convertible shelving suitcase 20 segment.

Figure 51:
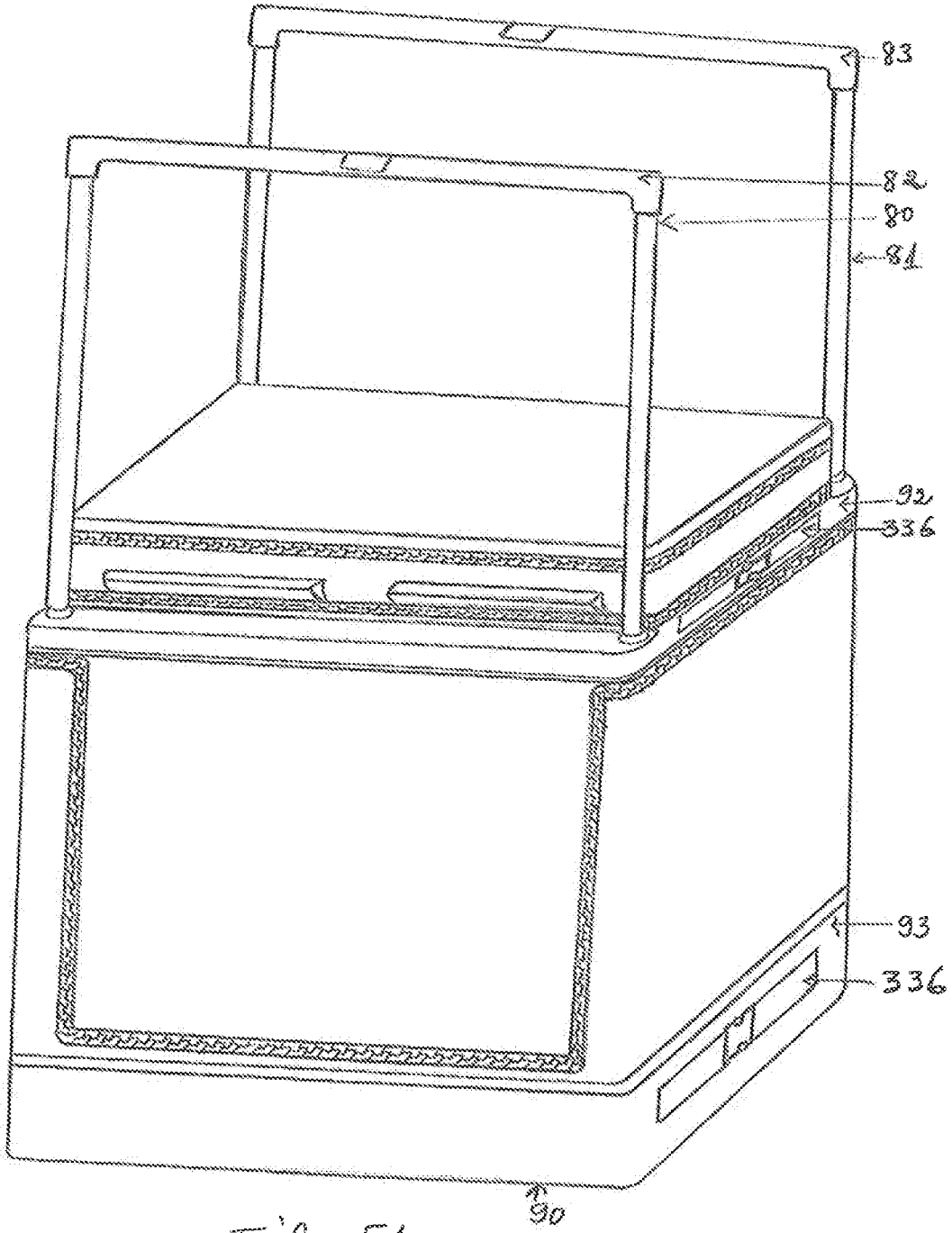

Referring to FIGS. 51 and 52, it is another objective of the present disclosure to provide the convertible shelving suitcase as a trolley helps to transport carryon bags and other smaller items. The convertible shelving suitcase 90 has two set of retractable handle assemblies 80, 81. One retractable handle assembly 80 is positioned to the front of the convertible shelving suitcase 90 and the other retractable handle assembly 81 is positioned to the rear of the convertible shelving suitcase 90. When the handle portions 82, 83 above the main compartment 50 are extended, they help to secure the smaller suitcases or bags in place while being pushed. The convertible shelving suitcases 90 can be coupled to one another by four pairs of the side release buckle straps 336 on each suitcase; two pairs are securely fixed to both sides of the hard-shell top portion 92 and the other two pair is securely fixed to both sides of the hard-shell base portion 93. The two convertible shelving suitcases 90 are line up bumper to bumper, the front of one suitcase to the rear of other suitcase and fastened with the side release buckle straps 336 of one suitcase 90 to their counterparts of another suitcase 90. The two inner handle 82, 83 portions are retracted and the two outer handle 82, 83 portions are extended to secure smaller suitcases and bags in place while being pushed. The same process can be used to couple the third convertible shelving suitcase 90.

Referring to FIGS. 3, 5, 8, 9, 47, 48, 49, 50, so far, the variations of convertible shelving suitcase 90 have been mentioned only with the detachable suspending shelves 35 for the main compartment 50 but not the hard-shell middle portion shelves 17, 91, 97. As the matter of fact, the hard-shell top portion 92 and hard-shell base portion 93 is the hard-shell top shelf and hard-shell bottom shelf respectively in the main compartment 50. The space between the hard-shell top portion 92 and the hard-shell base portion 93 is further divided for better organizing by the detachable suspending shelves 35. Similarly, the space between the hard-shell top portion 92 and the hard-shell base portion 93 can be further divided for better organizing by the hard-shell middle portion shelves 17, 91, 97 instead of the detachable suspending shelves 35. However, for each of hard-shell middle portion shelves 17, 91, 97 is added, two pairs of the tubes 1 are also added and attached to the hard-shell middle portion shelf 17, 91, 97 in the same manner the two pairs of inner tubes 60, 61 are attached to the hard-shell top portion 92. In another word, in order for the space between the hard-shell middle portion shelves 17, 91, 97 to be extended, each of the hard-shell middle portion shelves 17, 91, 97 must be attached to different set (two pairs) of tubes 1 just like the hard-shell top portion 92 is attached to two pairs of inner tubes 60, 61 whereas the hard-shell base portion 93 is attached to two pairs of the outer tubes 70, 71 as mentioned above in the segments regarding to the variations with the detachable suspending shelves 35. However, the space between the hard-shell middle portion shelves 17, 91, 97 cannot be extended If the hard-shell middle portion shelves 17, 91, 97 are attached to the same set (two pairs) of tubes 1 just like a hard-shell middle portion shelf 17 is attached to the outer tubes 70, 71 which are securely fixed to the hard-shell base portion 93. Therefore, many variants, including the ones in the FIGS. 47, 48, 49 and 50, of the convertible shelving suitcase 90 can be created by having combinations of the hard-shell top portions 22, 92, hard-shell base portion 23, 93, detachable suspending shelves 35, hard-shell middle portion shelves 17, 91, 97, detachable soft middle portion 94, and detachable secondary compartment 39.

What is claimed as the invention is:

1. An expandable luggage assembly, comprising:
- an upper shell having:
  - a plurality of upper sidewalls;
  - a lower portion having an opening; and
  - an upper portion covering the opening, wherein the upper portion is removably coupled to the lower portion;
- a lower shell having a plurality of lower sidewalls removably coupled to one or more of the plurality of upper sidewalls of the upper shell;
- a shelf coupled to the upper portion of the upper shell and capable of being suspended above the opening of the lower portion of the upper shell;
- a plurality of wheels coupled to the lower shell; and
- two handles, each handle of the two handles comprising:
  - a crossbar disposed above the upper shell;
  - a first tube coupled to the crossbar and slidably coupled to the upper shell;
  - a second tube slidably coupled to the first tube, the second tube having a radial face capable of being abutted against the upper shell;
  - a third tube slidably coupled to the second tube and coupled to the lower shell.

2. The expandable luggage assembly of claim 1, wherein the first tube extends through the upper shell.

3. The expandable luggage assembly of claim 1, wherein the radial face is capable of being abutted against an inner surface of the upper shell.

4. The expandable luggage assembly of claim 1, wherein a portion of the second tube is capable of being disposed between the plurality of lower sidewalls.

5. The expandable luggage assembly of claim 1, wherein the upper shell comprises:
- an upper portion;
- a lower portion removably coupled to the upper portion; and
- an expansion curtain coupled to the lower portion, wherein the expansion curtain is crumpled.

6. The expandable luggage assembly of claim 1, wherein a portion of the third tube is disposed between the plurality of lower sidewalls.

7. The expandable luggage assembly of claim 1, wherein the lower shell further comprises a base coupled to an end of the third tube.

8. An expandable luggage assembly, comprising:
- an upper shell, comprising:
  - a lower portion having an opening, and
  - an upper portion having one or more brackets, where in the upper portion covers the opening and is removably coupled to the lower portion;
- a shelf coupled to the upper portion of the upper shell and capable of being suspended above the opening of the lower portion of the upper shell;
- a lower shell;
- a plurality of wheels coupled to a base of the lower shell; and
- two handles, each handle of the two handles comprising:
  - a crossbar removably coupled to at least one bracket of the one or more brackets; and
  - a telescopic shaft having a first portion coupled to the crossbar and a second portion coupled to the base of the lower shell, wherein the second portion has a radial face capable of being abutted against an inner surface of the upper shell.

9. The expandable luggage assembly of claim 8, wherein the shelf is coupled to an inner surface of the upper portion of the upper shell.

10. The expandable luggage assembly of claim 8, further comprising a shelf coupled to an inner surface of the lower portion of the upper shell.

11. The expandable luggage assembly of claim 8, further comprising:
- a plurality of straps, wherein each strap of the plurality of straps comprises:
  - a first portion coupled to the upper portion of the upper shell;
  - a second portion coupled to the shelf; and
  - a clip buckle coupled to the first portion and the second portion.

12. The expandable luggage assembly of claim 8, further comprising:
- a first shelf coupled to the lower portion of the upper shell; and
- a second shelf removably coupled to the first shelf.

13. The expandable luggage assembly of claim 8, wherein the telescopic shaft of each handle has a portion extending through the upper shell.

14. The expandable luggage assembly of claim 8, further comprising a sleeve disposed around a portion of each telescopic shaft of each handle of the two handles.

15. The expandable luggage assembly of claim 8, wherein the second portion of the telescopic shaft is disposed within the lower shell.

16. An expandable luggage assembly, comprising:

an upper shell, comprising:

a lower portion that has an opening; and an upper portion covering the opening, wherein the upper portion is removably coupled to the lower portion;

a middle shell removably coupled to the upper shell;

a lower shell removably coupled to the middle shell;

a plurality of wheels coupled to a base of the lower shell; and two handles, wherein each handle of the two handles comprises:

a telescopic shaft coupled to an inner surface of the lower shell, the telescopic shaft having a first shaft portion extending through the upper shell and a second shaft portion having a radial face capable of being abutted against an inner surface of the upper shell; and a crossbar coupled to the telescopic shaft, wherein the upper portion of the upper shell is capable of being coupled to the crossbar;

a shelf coupled to the upper portion of the upper shell and capable of being suspended above the opening of the lower portion of the upper shell.

17. The expandable luggage assembly of claim 16, further comprising:

a first zipper tape coupled to the upper shell;

a second zipper tape coupled to an upper edge of the middle shell and removably coupled to the first zipper tape;

a third zipper tape coupled to a lower edge of the middle shell;

a fourth zipper tape coupled to the lower shell and removably coupled to the third zipper tape.

18. The expandable luggage assembly of claim 16, further comprising one or more shelves disposed within the middle shell.

19. The expandable luggage assembly of claim 16, wherein the second shaft portion is disposed within the middle shell.

20. The luggage assembly of claim 16, wherein the middle shell comprises:

a first side;

a second side having an aperture; and a grip coupled to the first side and having a portion extended through the aperture.

* * * * *